US009610674B2

(12) United States Patent
Raghavan et al.

(10) Patent No.: US 9,610,674 B2
(45) **Date of Patent: *Apr. 4, 2017**

(54) CONTROL VALVES FOR WATERJET SYSTEMS AND RELATED DEVICES, SYSTEMS, AND METHODS

(71) Applicant: OMAX Corporation, Kent, WA (US)

(72) Inventors: Chidambaram Raghavan, Seattle, WA (US); John H. Olsen, Vashon, WA (US); Douglas Kelley, Issaquah, WA (US); Olivier L. Tremoulet, Jr., Edmonds, WA (US); Andre Kashierski, Covington, WA (US); Kevin A. Hay, Des Moines, WA (US)

(73) Assignee: OMAX Corporation, Kent, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/553,916

(22) Filed: Nov. 25, 2014

(65) Prior Publication Data

US 2015/0151406 A1 Jun. 4, 2015

Related U.S. Application Data

(63) Continuation of application No. 13/969,477, filed on Aug. 16, 2013, now Pat. No. 8,904,912, which is a (Continued)

(51) Int. Cl.
*B26D 3/00* (2006.01)
*B26F 3/00* (2006.01)

(Continued)

(52) U.S. Cl.
CPC ..... *B24C 7/0023* (2013.01); *Y10T 83/0591* (2015.04); *Y10T 83/364* (2015.04)

(58) Field of Classification Search
CPC .. B24C 7/0023; Y10T 83/0591; Y10T 83/364

(Continued)

(56) References Cited

U.S. PATENT DOCUMENTS

| | | | |
|---|---|---|---|
| 433,022 | A | 7/1890 | Noyes |
| 1,544,519 | A | 6/1925 | McKinley et al. |

(Continued)

FOREIGN PATENT DOCUMENTS

| | | | |
|---|---|---|---|
| CN | 101811287 | A | 8/2010 |
| CN | 102507171 | A | 6/2012 |
| DE | 102507171 | A | 8/2003 |
| JP | 61222677 | | 10/1986 |
| WO | WO-9425209 | A1 | 11/1994 |
| WO | WO2013/109473 | | 7/2013 |

OTHER PUBLICATIONS

Final Office Action for U.S. Appl. No. 13/843,317 mailed Jun. 30, 2014, 31 pages.

(Continued)

*Primary Examiner* — Ghassem Alie
*Assistant Examiner* — Bharat C Patel
(74) *Attorney, Agent, or Firm* — Perkins Coie LLP

(57) ABSTRACT

Waterjet systems including control valves and associated devices, systems, and methods are disclosed. A waterjet system configured in accordance with a particular embodiment includes a fluid source, a jet outlet, and a fluid conveyance extending from the fluid source to the jet outlet. The system further includes a control valve positioned along the fluid conveyance downstream from the fluid source and upstream from the jet outlet. The fluid conveyance has a first portion upstream from the control valve and a second portion downstream from the control valve. The control valve is configured to controllably reduce a pressure of fluid within the second portion of the fluid conveyance relative to a pressure of fluid within the first portion of the fluid conveyance. The first portion of the fluid conveyance is configured to accommodate movement of the jet outlet relative to the fluid source.

30 Claims, 36 Drawing Sheets

Related U.S. Application Data continuation-in-part of application No. 13/843,317, filed on Mar. 15, 2013, now Pat. No. 9,095,955.

(60) Provisional application No. 61/684,133, filed on Aug. 16, 2012, provisional application No. 61/684,135, filed on Aug. 16, 2012, provisional application No. 61/684,642, filed on Aug. 17, 2012, provisional application No. 61/732,857, filed on Dec. 3, 2012, provisional application No. 61/757,663, filed on Jan. 28, 2013.

(51) Int. Cl.

| | |
|---|---|
| ***B26D 1/00*** | (2006.01) |
| ***A62C 31/02*** | (2006.01) |
| ***F23D 11/38*** | (2006.01) |
| ***B24C 7/00*** | (2006.01) |

(58) Field of Classification Search

USPC ..... 83/177, 53, 701; 239/587.1, 589, 600, 239/433, 587.4; 451/38, 75, 102; 251/205, 120–122; 175/424

See application file for complete search history.

(56) References Cited

U.S. PATENT DOCUMENTS 1,554,406 A 9/1925 Coberly
1,937,408 A 11/1933 Johnson
2,007,180 A 7/1935 Doran
2,009,932 A 7/1935 Klotzman
2,220,002 A 10/1940 Rollman et al.
2,308,347 A 1/1943 Asselin
2,359,352 A 10/1944 Buckman et al.
2,376,287 A 5/1945 Sorrentino
2,403,751 A 7/1946 Palmer
2,456,041 A 12/1948 Barker
2,544,414 A 3/1951 Bridgman et al.
2,558,035 A 6/1951 Bridgman
2,819,835 A 1/1958 Newhall
2,822,789 A 2/1958 Philips et al.
2,951,369 A 9/1960 Newhall
2,952,071 A 9/1960 Burt
2,985,050 A * 5/1961 Schwacha ..... B26F 3/004 125/23.01
3,081,990 A 3/1963 Bromley
3,086,749 A * 4/1963 Frye ..... F16K 41/04 251/205
3,088,854 A 5/1963 Spies, Jr.
3,095,900 A 7/1963 Newhall
3,106,169 A 10/1963 Prosser et al.
3,148,528 A * 9/1964 Reynolds ..... G01L 7/16 73/1.68
3,174,364 A 3/1965 Sims
3,296,855 A 1/1967 Newhall
3,323,809 A 6/1967 Brookfield
3,343,794 A 9/1967 Voitsethovsky
3,424,357 A 1/1969 Curtze et al.
3,449,742 A 6/1969 Stapleton
3,452,412 A 7/1969 Allman, Jr. et al.
3,521,853 A 7/1970 Gillis, Jr. et al.
3,530,273 A 9/1970 Bollinger et al.
3,564,971 A 2/1971 Wagner et al.
3,593,459 A 7/1971 Kulischenko
3,668,498 A 6/1972 Austin, Jr.
3,705,693 A * 12/1972 Franz ..... B05B 1/10 239/600
3,708,936 A 1/1973 Rogers
3,725,651 A 4/1973 Cutler
3,746,256 A 7/1973 Hall et al.
3,750,961 A * 8/1973 Franz ..... B05B 1/00 239/596
3,765,661 A 10/1973 Omura
3,785,707 A * 1/1974 Mitsuoka ..... F16C 32/0644 384/121
3,789,741 A 2/1974 Hallberg
3,851,899 A 12/1974 Franz
3,870,941 A 3/1975 Ikenga et al.
3,918,331 A 11/1975 Svanstrom
3,932,961 A 1/1976 Pagella et al.
3,997,111 A * 12/1976 Thomas ..... B05B 1/10 239/1
4,009,860 A 3/1977 Lingnau
4,026,322 A * 5/1977 Thomas ..... F04B 53/1022 137/512
4,031,369 A 6/1977 Heaman et al.
4,042,178 A * 8/1977 Veltrup ..... B05B 1/3046 251/44
4,050,001 A 9/1977 Kishi et al.
4,066,944 A 1/1978 Leenhouts
4,078,727 A 3/1978 Lingnau
4,081,200 A 3/1978 Cheung
4,081,892 A 4/1978 Mercer
4,084,083 A 4/1978 McNally et al.
4,162,763 A * 7/1979 Higgins ..... B05B 1/10 175/424
4,192,343 A 3/1980 Grahac
4,203,022 A 5/1980 Couch, Jr. et al.
4,205,828 A 6/1980 Hooper et al.
4,214,192 A 7/1980 Bromer et al.
4,216,415 A 8/1980 Shimonou et al.
4,216,906 A 8/1980 Olsen et al.
4,216,911 A 8/1980 Huperz et al.
4,237,913 A * 12/1980 Maasberg ..... B08B 9/0495 134/167 C
4,256,139 A * 3/1981 Huperz ..... F04B 53/103 137/512.3
4,262,757 A 4/1981 Johnson, Jr. et al.
4,272,017 A 6/1981 Franz
4,277,229 A 7/1981 Pacht
4,282,763 A 8/1981 Griebeler
4,306,627 A 12/1981 Cheung et al.
4,306,728 A 12/1981 Huperz et al.
4,313,570 A * 2/1982 Olsen ..... B05B 1/306 175/424
4,326,937 A 4/1982 Neumeier et al.
4,361,748 A 11/1982 Couch, Jr.
4,371,001 A 2/1983 Olsen
4,392,534 A 7/1983 Miida
4,392,784 A * 7/1983 Hanafi ..... F04B 53/06 137/565.33
4,401,345 A 8/1983 Archibald
4,404,507 A 9/1983 Dean et al.
4,412,792 A 11/1983 LaBorde et al.
4,415,867 A 11/1983 Rubin
4,435,902 A 3/1984 Mercer et al.
4,437,525 A 3/1984 O'Hanlon et al.
4,447,178 A 5/1984 Esser
4,456,132 A 6/1984 LaValle et al.
4,456,440 A * 6/1984 Korner ..... F04B 53/1002 417/540
4,456,863 A 6/1984 Matusek
4,478,368 A 10/1984 Yie
4,495,845 A 1/1985 Sherby
4,524,544 A 6/1985 Habib
4,534,427 A 8/1985 Wang et al.
4,540,056 A 9/1985 O'Hanlon
4,540,320 A 9/1985 Arnold
4,545,157 A 10/1985 Saurwein
4,555,758 A 11/1985 Inaba et al.
4,557,245 A 12/1985 Bieri
4,564,995 A 1/1986 Kase
4,573,886 A * 3/1986 Maasberg ..... F04B 53/10 417/454
4,574,825 A 3/1986 Haug
4,578,748 A 3/1986 Abe et al.
4,594,924 A * 6/1986 Windisch ..... B26F 3/004 239/533.1
4,598,380 A 7/1986 Holmes et al.
4,600,985 A 7/1986 Nozawa et al.
4,606,150 A 8/1986 Grimm

(56) References Cited

U.S. PATENT DOCUMENTS 4,614,128 A 9/1986 Fickler
4,626,756 A 12/1986 Inaba et al.
4,634,353 A * 1/1987 Huperz ..... F04B 37/12 417/564
H206 H 2/1987 Newhall et al.
4,644,460 A 2/1987 Kishi et al.
4,648,215 A 3/1987 Hashish et al.
4,651,601 A 3/1987 Sasaki
4,660,773 A 4/1987 O'Hanlon
4,665,944 A 5/1987 Wallace et al.
4,666,083 A 5/1987 Yie
4,669,783 A 6/1987 Kolle
4,697,769 A 10/1987 Blackwelder et al.
4,715,538 A 12/1987 Lingnau
4,728,872 A 3/1988 Kishi et al.
4,738,174 A 4/1988 Bloomquist
4,741,680 A 5/1988 Broker et al.
4,776,769 A 10/1988 Hilaris
4,798,094 A * 1/1989 Newhall ..... G01L 25/00 73/1.08
4,818,194 A * 4/1989 Saurwein ..... F04B 53/109 137/512.5
4,821,467 A 4/1989 Woodson et al.
4,852,800 A 8/1989 Murdock
4,893,753 A 1/1990 Munoz et al.
4,934,111 A 6/1990 Hashish et al.
4,955,164 A * 9/1990 Hashish ..... B24C 1/045 451/40
4,973,026 A 11/1990 Saurwein
5,018,670 A * 5/1991 Chalmers ..... B24C 5/04 239/433
5,037,276 A * 8/1991 Tremoulet, Jr. .... F04B 53/1022 137/312
5,037,277 A * 8/1991 Tan ..... F04B 53/1087 137/540
5,117,872 A * 6/1992 Yie ..... B24C 1/045 137/882
5,186,393 A 2/1993 Yie
5,199,642 A * 4/1993 Rankin ..... B05B 1/1609 137/269
5,209,406 A 5/1993 Johnson
5,226,799 A * 7/1993 Raghavan ..... F04B 53/102 137/1
5,253,808 A 10/1993 Pacht
5,297,777 A * 3/1994 Yie ..... B05B 1/3046 251/214
5,320,289 A 6/1994 Hashish et al.
5,351,714 A * 10/1994 Barnowski ..... F16K 17/042 137/467
5,380,159 A * 1/1995 Olsen ..... F04B 49/243 417/298
5,469,768 A * 11/1995 Schumacher ..... B24C 1/04 83/177
5,472,367 A * 12/1995 Slocum ..... B23K 26/10 451/14
5,524,821 A * 6/1996 Yie ..... B05B 1/3046 239/10
5,557,154 A * 9/1996 Erhart ..... F04B 7/00 310/68 B
5,564,469 A * 10/1996 Tremoulet, Jr. ..... F04B 49/24 137/540
5,636,789 A 6/1997 Shook
5,727,773 A * 3/1998 Dunnigan ..... F16K 1/12 251/205
5,730,358 A * 3/1998 Raghavan ..... B05B 1/00 239/1
5,799,688 A * 9/1998 Yie ..... B05B 1/3046 137/505.13
5,848,880 A * 12/1998 Helmig ..... F04B 53/007 417/560
5,904,297 A * 5/1999 Kendrick, Jr. ..... B05B 1/1681 239/124
5,927,329 A * 7/1999 Yie ..... A62C 31/02 137/624.13
5,970,996 A 10/1999 Markey et al.
5,975,429 A * 11/1999 Jezek ..... B05B 1/1609 137/882
6,077,152 A 6/2000 Warehime
6,126,524 A * 10/2000 Shepherd ..... B24C 1/00 134/172
6,220,529 B1 * 4/2001 Xu ..... B24C 1/045 137/872
6,244,927 B1 6/2001 Zeng
6,280,302 B1 * 8/2001 Hashish ..... B24C 5/04 451/102
6,283,832 B1 9/2001 Shepherd
6,379,214 B1 * 4/2002 Stewart ..... B23Q 5/58 451/10
6,415,820 B1 7/2002 Gluf, Jr.
6,431,465 B1 * 8/2002 Yie ..... A62C 5/008 169/33
6,588,724 B2 7/2003 Yie
6,684,133 B2 * 1/2004 Frye-Hammelmann ..... B08B 3/026 239/525
6,705,921 B1 * 3/2004 Shepherd ..... B24C 1/045 408/180
6,852,002 B2 * 2/2005 Stewart ..... B23Q 5/58 451/10
7,033,256 B2 * 4/2006 Miller ..... B24C 11/005 251/175
7,083,124 B2 8/2006 Bednorz et al.
7,094,135 B2 * 8/2006 Chisum ..... B24C 1/045 239/339
7,108,585 B1 * 9/2006 Dorfman ..... B24C 1/045 239/310
7,162,943 B1 1/2007 Reitmeyer et al.
7,357,697 B2 4/2008 Massa et al.
7,383,896 B2 * 6/2008 Tibbitts ..... E21B 7/18 175/206
7,464,630 B2 12/2008 Knaupp et al.
7,537,019 B2 * 5/2009 Ting ..... A23L 3/0155 137/14
7,544,112 B1 * 6/2009 Miller ..... B24C 1/086 451/10
7,585,201 B2 9/2009 Kanai et al.
7,594,614 B2 9/2009 Vijay et al.
7,703,363 B2 4/2010 Knaupp et al.
7,757,786 B2 * 7/2010 Harder ..... E21B 7/18 175/206
7,832,481 B2 * 11/2010 Martindale ..... B24C 1/045 166/298
7,896,726 B1 3/2011 Miller et al.
7,938,713 B2 5/2011 Trieb et al.
8,240,634 B2 * 8/2012 Jarchau ..... F04B 1/0452 137/614.21
8,439,726 B2 5/2013 Miller
8,541,710 B2 * 9/2013 Brandt ..... H05H 1/34 219/121.39
8,573,244 B2 11/2013 Taylor
8,904,912 B2 * 12/2014 Raghavan ..... B24C 7/0023 83/177
2003/0057295 A1 3/2003 Helmig
2003/0106591 A1 * 6/2003 Saurwein ..... F16K 17/06 137/540
2003/0106594 A1 * 6/2003 Saurwein ..... F16K 11/044 137/625.5
2003/0107021 A1 * 6/2003 Saurwein ..... F16K 1/38 251/360
2004/0108000 A1 * 6/2004 Raghavan ..... F04B 53/1032 137/540
2005/0173815 A1 * 8/2005 Mueller ..... F02M 3/09 261/64.1
2006/0237672 A1 * 10/2006 Moreno ..... F16K 31/0655 251/129.02
2007/0063066 A1 * 3/2007 Vijay ..... B26F 3/004 239/99
2008/0169581 A1 7/2008 Fukushima et al.

(56) References Cited

U.S. PATENT DOCUMENTS

| | | | | |
|---|---|---|---|---|
| 2008/0282855 | A1* | 11/2008 | Kanai | B26D 7/01 83/22 |
| 2009/0013839 | A1* | 1/2009 | Kanai | B24C 1/00 83/13 |
| 2009/0200084 | A1* | 8/2009 | Vuyk, Jr. | E21B 7/18 175/67 |
| 2009/0288532 | A1* | 11/2009 | Hashish | B24C 1/045 83/53 |
| 2010/0124872 | A1* | 5/2010 | Hashish | B24C 5/02 451/99 |
| 2011/0135505 | A1* | 6/2011 | Kieninger | B60K 15/077 417/182.5 |
| 2012/0199218 | A1* | 8/2012 | Gioberti | F16K 17/0486 137/511 |
| 2012/0217011 | A1* | 8/2012 | Dotson | E21B 43/114 166/305.1 |
| 2012/0238188 | A1 | 9/2012 | Miller | |
| 2014/0051334 | A1 | 2/2014 | Raghavan et al. | |

OTHER PUBLICATIONS

Miller, D.S., "New Abrasive Waterjet Systems to Compete with Lasers," 2005 WJTA American Waterjet Conference, Aug. 21-23, 2005, Houston, Texas, 11 pages.

Hasish, M., "Waterjet Machine Tool of the Future," 9th American Waterjet Conference, Aug. 23-26, 1997, Dearborn, Michigan, Paper No. 58, 15 pages.

International Search Report and Written Opinion for PCT/US13/55475 filed Aug. 16, 2013, mailing date: Dec. 6, 2013, 21 pages.

U.S. Non-Final Office Action for U.S. Appl. No. 13/843,317 filed Mar. 15, 2013, mailing date of Feb. 13, 2014, 8 pages.

* cited by examiner

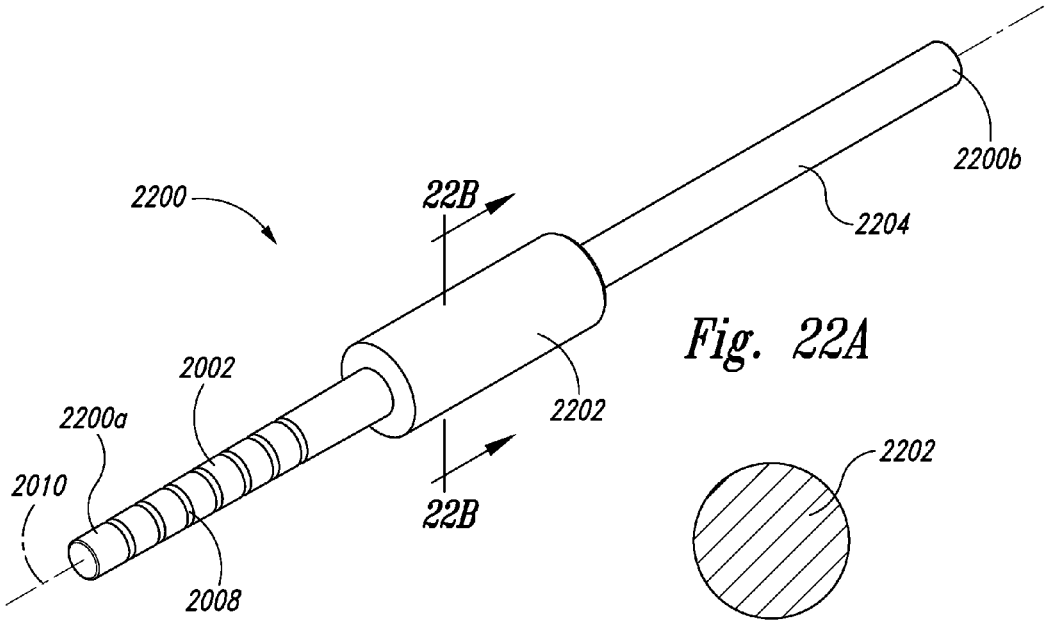
Fig. 22A
Fig. 22B
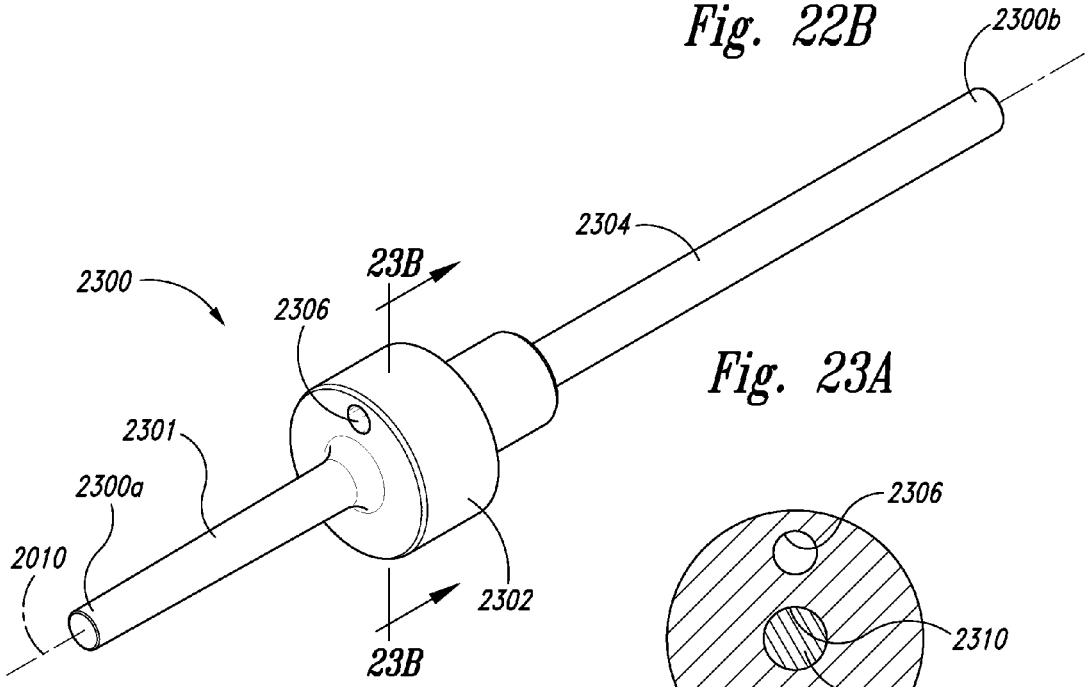
Fig. 23A
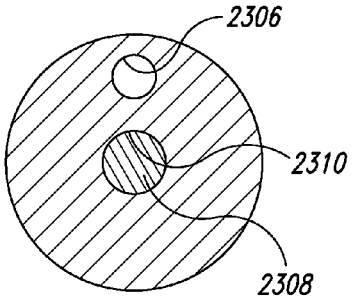
Fig. 23B

CONTROL VALVES FOR WATERJET SYSTEMS AND RELATED DEVICES, SYSTEMS, AND METHODS

CROSS-REFERENCE TO RELATED APPLICATIONS INCORPORATED BY REFERENCE

This application is a continuation of U.S. application Ser. No. 13/969,477, filed Aug. 16, 2013, now issued as U.S. Pat. No. 8,904,912, which is a continuation-in-part of U.S. application Ser. No. 13/843,317, filed Mar. 15, 2013, and claims the benefit of the following applications:

(a) U.S. Provisional Application No. 61/684,133, filed Aug. 16, 2012;

(b) U.S. Provisional Application No. 61/684,135, filed Aug. 16, 2012;

(c) U.S. Provisional Application No. 61/684,642, filed Aug. 17, 2012;

(d) U.S. Provisional Application No. 61/732,857, filed Dec. 3, 2012; and (e) U.S. Provisional Application No. 61/757,663, filed Jan. 28, 2013.

The foregoing applications are incorporated herein by reference in their entireties. To the extent the foregoing applications or any other material incorporated herein by reference conflicts with the present disclosure, the present disclosure controls.

TECHNICAL FIELD

The present technology is generally related to control valves for waterjet systems, control-valve actuators, waterjet systems (e.g., abrasive jet systems), and methods for operating waterjet systems.

BACKGROUND

Waterjet systems (e.g., abrasive jet systems) are used in precision cutting, shaping, carving, reaming, and other material-processing applications. During operation, waterjet systems typically direct a high-velocity jet of fluid (e.g., water) toward a workpiece to rapidly erode portions of the workpiece. Abrasive material is typically added to the fluid to increase the rate of erosion. When compared to other material-processing systems (e.g., grinding systems, plasma-cutting systems, etc.) waterjet systems can have significant advantages. For example, waterjet systems often produce relatively fine and clean cuts, typically without heat-affected zones around the cuts. Waterjet systems also tend to be highly versatile with respect to the material type of the workpiece. The range of materials that can be processed using waterjet systems includes very soft materials (e.g., rubber, foam, leather, and paper) as well as very hard materials (e.g., stone, ceramic, and hardened metal). Furthermore, in many cases, waterjet systems are capable of executing demanding material-processing operations while generating little or no dust, smoke, and/or other potentially toxic byproducts.

In a typical waterjet system, a pump pressurizes fluid to a high pressure (e.g., 40,000 psi to 100,000 psi or more). Some of this pressurized fluid is routed through a cutting head that includes an orifice element having an orifice. The orifice element can be a hard jewel (e.g., a synthetic sapphire, ruby, or diamond) held in a suitable mount (e.g., a metal plate). Passing through the orifice converts static pressure of the fluid into kinetic energy, which causes the fluid to exit the cutting head as a jet at high velocity (e.g., up to 2,500 feet-per-second or more) and impact a workpiece. After eroding through a portion of a workpiece, the jet typically is dispersed in a pool of fluid held within a catcher (e.g., a catcher tank) positioned below the workpiece, thereby causing the kinetic energy of the jet to dissipate. A jig including spaced apart slats can be used to support the workpiece over the catcher safely and non-destructively. The jig, the cutting head, the workpiece, or a combination thereof can be movable under computer and/or robotic control such that complex processing instructions can be executed automatically.

Certain materials, such as composite materials, brittle materials, certain aluminum alloys, and laminated shim stock, among others, may be difficult to process using conventional waterjet systems. For example, when a jet is directed toward a workpiece, the jet may initially form a cavity in the workpiece and hydrostatic and/or stagnation pressure from fluid within the jet may act on sidewalls of the cavity. This can cause weaker parts of composite materials to preferentially erode. In the case of layered composite materials, for example, hydrostatic and/or stagnation pressure from a jet may erode binders between layers within the workpiece and thereby cause the layers to separate. Similarly, in the case of fiber-containing composite materials, hydrostatic and/or stagnation pressure from a jet may exceed the bond strength between the fibers and the surrounding matrix, which can also cause delamination. As another example, when a jet is directed toward a workpiece made of a brittle material (e.g., glass), the load on the workpiece during piercing may cause the workpiece to spall and/or crack. Similarly, spalling, cracking, or other damage can occur when jets are used to form particularly delicate structures in both brittle and non-brittle materials. Other properties of jets may be similarly problematic with respect to certain materials and/or operations.

One conventional technique for mitigating collateral damage to a workpiece (e.g., a workpiece made of a composite and/or brittle material) includes piercing the workpiece with a jet formed at a relatively low pressure and then either maintaining the low pressure during the remainder of the processing or ramping the pressure upward after piercing the workpiece. At relatively low pressures, waterjet processing is often too slow to be an economically viable option for large-scale manufacturing. Furthermore, conventional techniques for ramping pressures upward can also be slow and typically decrease the operational life of at least some components of conventional waterjet systems. For example, at least some conventional techniques for ramping pressure upward include controlling a pump and/or a relief valve of a waterjet system to increase the pressure of all or substantially all of the pressurized fluid within the waterjet system. This causes a variety of components of the waterjet system (e.g., valves, seals, conduits, etc.) to be repeatedly exposed to the fluid at both low and high pressures. Over time, this pressure cycling can lead to fatigue-related structural damage to the components, which can cause the components to fail prematurely. Greater numbers of pressure cycles and greater pressure ranges within each cycle can exacerbate these negative effects. The costs associated with such wear (e.g., frequent part replacements, other types of maintenance, and system downtime) tend to make such approaches impractical for most applications. For example, in material-processing applications that involve repeatedly cycling a jet between piercing and cutting operations and/or starting and stopping a jet (e.g., to form spaced-apart openings in a workpiece made of a composite or brittle material), the associated cycling of fluid pressure can cause unacceptable wear to conventional waterjet systems and make use of such systems for these applications cost prohibitive.

BRIEF DESCRIPTION OF THE DRAWINGS

Many aspects of the present disclosure can be better understood with reference to the following drawings. The relative dimensions in the drawings may be to scale with respect to some embodiments. With respect to other embodiments, the drawings may not be to scale. For ease of reference, throughout this disclosure identical reference numbers may be used to identify identical or at least generally similar or analogous components or features.

FIG. 22A is an enlarged isometric perspective view illustrating a relief valve stem configured in accordance with an embodiment of the present technology.

FIG. 22B is a cross-sectional end view taken along line 22B-22B in FIG. 22A.

FIG. 23A is an enlarged isometric perspective view illustrating a relief valve stem configured in accordance with an embodiment of the present technology.

FIG. 23B is a cross-sectional end view taken along line 23B-23B in FIG. 23A.

DETAILED DESCRIPTION

Figure 1A:
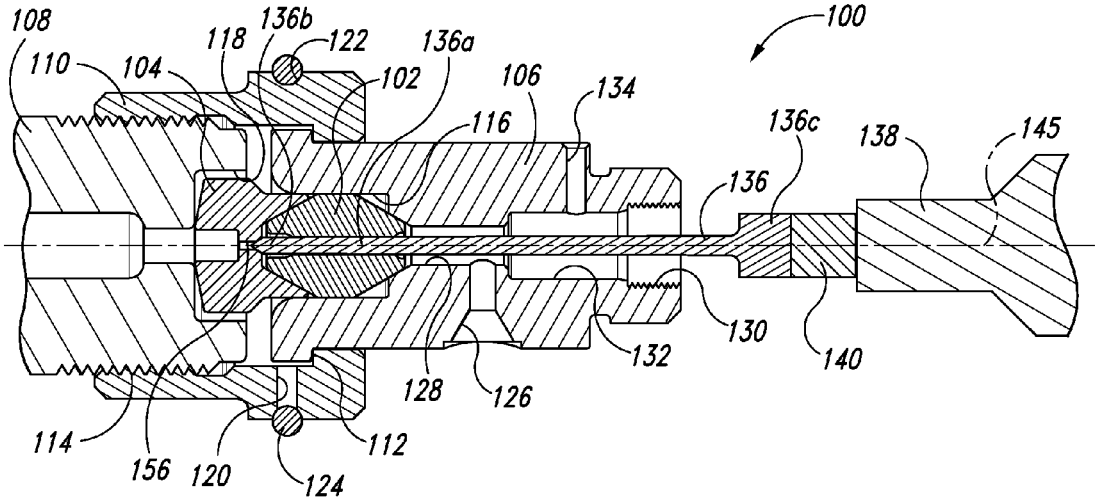
FIG. 1A is a cross-sectional side view illustrating a control valve including a pin at a shutoff position configured in accordance with an embodiment of the present technology.

Specific details of several embodiments of the present technology are disclosed herein with reference to FIGS. 1A-30. Although the embodiments are disclosed herein primarily or entirely with respect to waterjet applications, other applications in addition to those disclosed herein are within the scope of the present technology. For example, control valves configured in accordance with at least some embodiments of the present technology can be useful in various high-pressure fluid-conveyance systems. Furthermore, waterjet systems configured in accordance with embodiments of the present technology can be used with a variety of suitable fluids, such as water, aqueous solutions, hydrocarbons, glycol, and liquid nitrogen, among others. As such, although the term "waterjet" is used herein for ease of reference, unless the context clearly indicates otherwise, the term refers to a jet formed by any suitable fluid, and is not limited exclusively to water or aqueous solutions. It should be noted that other embodiments in addition to those disclosed herein are within the scope of the present technology. For example, embodiments of the present technology can have different configurations, components, and/or procedures than those shown or described herein. Moreover, a person of ordinary skill in the art will understand that embodiments of the present technology can have configurations, components, and/or procedures in addition to those shown or described herein and that these and other embodiments can be without several of the configurations, components, and/or procedures shown or described herein without deviating from the present technology.

Waterjet systems configured in accordance with embodiments of the present technology can at least partially address one or more of the problems described above and/or other problems associated with conventional technologies whether or not stated herein. A waterjet system configured in accordance with a particular embodiment of the present technology includes a control valve positioned relatively near to a waterjet outlet. The control valve can be configured to decrease the pressure of fluid downstream from the control valve while the pressure of fluid upstream from the control valve remains relatively constant. The upstream fluid pressure can remain relatively constant, for example, due to the operation of a relief valve or another suitable component of the system that operates in concert with the control valve. In this way, most if not all portions of a fluid conveyance within the system can be protected from fatigue damage associated with pressure cycling even while the system executes intricate operations that call for modulating (e.g., rapidly modulating) the power of a jet exiting the waterjet outlet. Many technical challenges and solutions associated with implementing such a system and related technology are described in detail below.

As used herein, the term "piercing," unless the context clearly indicates otherwise, refers to an initial striking, penetration, or perforation of a workpiece by a jet. As an example, piercing may include removing a portion of a workpiece with a jet to a predetermined or non-predetermined depth and in a direction that is at least generally aligned with (e.g., parallel to) a longitudinal axis of the jet. As another example, piercing may include forming an opening or hole in an initial outer portion and/or one or more initial outer layers of a workpiece using a jet. As yet another example, piercing may include penetrating completely through a workpiece as a preparatory action prior to cutting a feature (e.g., a slot) in the workpiece. The term "cutting," unless the context clearly indicates otherwise, generally refers to removal of at least a portion of a workpiece using a jet in a direction that is not at least generally aligned with (e.g., parallel to) a longitudinal axis of the jet. However, in some instances, cutting may also include, after an initial piercing, continued material removal from a pierced region (e.g., an opening) using a jet in a direction that is at least generally aligned with (e.g., parallel to) a longitudinal axis of the jet. The headings provided herein are for convenience only and should not be construed as limiting the subject matter disclosed herein.

Selected Examples of Control Valves

FIG. 1A is a cross-sectional side view illustrating a control valve 100 configured in accordance with an embodiment of the present technology. The control valve 100 can be configured for use at high pressure. For example, in at least some embodiments, the control valve 100 has a pressure rating or is otherwise configured for use at pressures greater than 20,000 psi (e.g., within a range from 20,000 psi to 120,000 psi), greater than 40,000 psi (e.g., within a range from 40,000 psi to 120,000 psi), greater than 50,000 psi (e.g., within a range from 50,000 psi to 120,000 psi), greater than another suitable threshold, or within another suitable range. In the illustrated embodiment, the control valve 100 includes a first seat 102 and a complementary second seat 104. The control valve 100 can further include an upstream housing 106 extending at least partially around the first seat 102, a downstream housing 108 extending at least partially around the second seat 104, and a collar 110 extending between the upstream housing 106 and the downstream housing 108. A first engagement feature 112 operably positioned between the collar 110 and the upstream housing 106 can be fixed, and a second engagement feature 114 operably positioned between the collar 110 and the downstream housing 108 can be adjustable. For example, the first engagement feature 112 can be a flanged abutment and the second engagement feature 114 can include complementary threads. Alternatively, the first engagement feature 112 can be adjustable and the second engagement feature 114 can be fixed, the first and second engagement features 112, 114 can both be adjustable, or the first and second engagement features 112, 114 can both be fixed. Furthermore, the upstream and downstream housings 106, 108 can be integral with one another or adjustably or fixedly connectable without the collar 110.

The upstream housing 106 can include a first recess 116 shaped to receive at least a portion of the first seat 102. Similarly, the downstream housing 108 can include a second recess 118 shaped to receive at least a portion of the second seat 104. The second engagement feature 114 can be adjusted (e.g., rotated) in a first direction to reduce the distance or gap between the first and second recesses 116, 118 and thereby releasably secure the first and second seats 102, 104 between the upstream and downstream housings 106, 108 (e.g., in an abutting relationship with one another). Similarly, the second engagement feature 114 can be adjusted (e.g., rotated) in a second direction opposite to the first direction to increase the distance or gap between the first and second recesses 116, 118 and ultimately separate the upstream and downstream housings 106, 108 to thereby release the first and second seats 102, 104 from the control valve 100 (e.g., for replacement, inspection, etc.). The collar 110 can include a first weep hole 120 configured to allow any fluid leakage between the upstream and downstream housings 106, 108 to escape from the control valve 100. The collar 110 can further include an annular groove 122 that passes across an outermost portion of the first weep hole 120 and accepts an o-ring 124.

In the illustrated embodiment, the upstream housing 106 includes a fluid inlet 126 that opens into a first chamber 128 operably positioned adjacent to and upstream from the first seat 102. The upstream housing 106 can further include a third recess 130 and a fourth recess 132, with the fourth recess 132 operably positioned between the first chamber 128 and the third recess 130. The fourth recess 132 can be configured to house a seal assembly (not shown) (e.g., a high-pressure seal assembly including static and/or dynamic sealing components), and the third recess 130 can be configured to house a retainer screw (not shown) configured to secure the seal assembly within the fourth recess 132. Similar to the collar 110, the upstream housing 106 can include a second weep hole 134 configured to allow any fluid leakage through the seal assembly to escape from the control valve 100. Furthermore, the control valve 100 can include a fluid filter (not shown) (e.g., a screen or mesh made of stainless steel or another suitable material) operably positioned in or at least proximate to the fluid inlet 126 or having another suitable position upstream from the first seat 102. In at least some cases, the control valve 100 can be susceptible to damage from particulates within fluid flowing through the control valve 100. The fluid filter can reduce the possibility of such particulates reaching the first and second seats 102, 104.

The control valve 100 can further include an elongate pin 136 (e.g., a tapered, at least generally cylindrical pin with a circular cross-section), a plunger 138, and a cushion 140 operably positioned between the pin 136 and the plunger 138. The pin 136 can include a shaft portion 136*a* extending through the first chamber 128 and into the first seat 102, an end portion 136*b* at one end of the shaft portion 136*a* operably positioned toward the second seat 104, and a base portion 136*c* at an opposite end of the shaft portion 136*a* operably positioned toward the cushion 140. In FIG. 1A, the pin 136 is at a shutoff position. As discussed in greater detail below, the end portion 136*b* of the pin 136 can interact with the second seat 104 to at least generally shut off flow of fluid through the control valve 100, and the shaft portion 136*a* of the pin 136 can interact with the first seat 102 to vary the flow rate of the fluid passing through the control valve 100 (e.g., by throttling the fluid). Accordingly, in some embodiments, the end portion 136*b* of the pin 136 and the second seat 104 are configured for enhanced shut-off functionality, and the shaft portion 136*a* of the pin 136 and the first seat 102 are configured for enhanced throttling functionality. In other embodiments, the shaft and end portions 136*a*, 136*b* of the pin 136 and the first and second seats 102, 104 can have other purposes. Changing the flow rate of the fluid passing through the control valve 100 can change a pressure of the fluid upstream from an associated jet orifice (not shown) and, thus, a velocity of a jet exiting the orifice.

In some embodiments, the cushion 140 is configured to compress between the base portion 136*c* of the pin 136 and the plunger 138 when the pin 136 is in the shutoff position and the plunger 138 is at a position of maximum extension. In this way, the cushion 140 can reduce the possibility of the plunger 138 forcing the end portion 136*b* of the pin 136 against the second seat 104 with excessive force, which has the potential to damage the pin 136 and/or the second seat 104. Suitable materials for the cushion 140 can include, for example, ultra-high-molecular-weight polyethylene, polyurethane, and rubber, among others. In other embodiments, the cushion 140 may be absent and the base portion 136*c* of the pin 136 and the plunger 138 may directly abut one another or be connected in another suitable manner. Additional details and examples related to controlling actuation of the pin 136, including controlling force between the end portion 136*b* of the pin 136 and the second seat 104 are provided below.

Figure 1B:
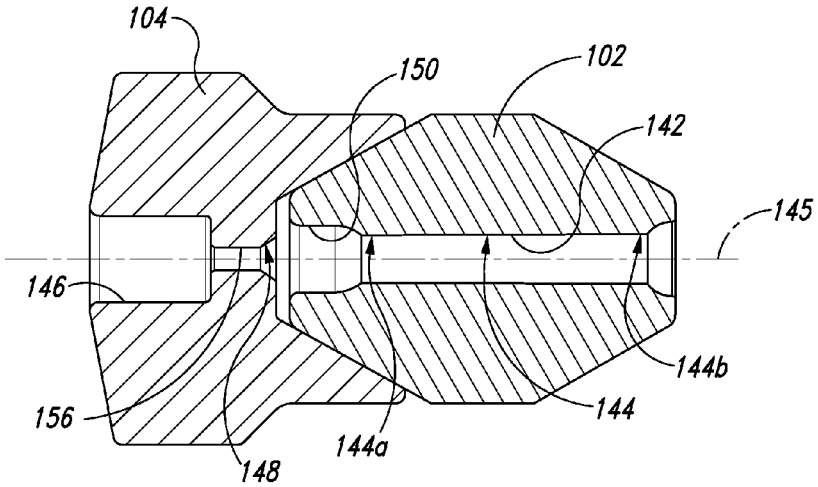
FIG. 1B is an enlarged cross-sectional side view illustrating first and second seats of the control valve shown in FIG. 1A.

FIG. 1B is an enlarged cross-sectional side view illustrating the first and second seats 102, 104 with other portions of the control valve 100 omitted for clarity of illustration. The first seat 102 can include a first passage 142 and a tapered inner surface 144 within the first passage 142. A first end portion 144*a* of the tapered inner surface 144 can extend around an opening of the first passage 142 positioned toward the second seat 104. The tapered inner surface 144 can have a second end portion 144*b* opposite to the first end portion 144*a* and can taper inwardly toward a longitudinal axis 145 of the pin 136 from the second end portion 144*b* toward the first end portion 144*a*. The second seat 104 can include second passage 146 and a contact surface 148 within or adjacent to the second passage 146. The tapered inner surface 144 can have a suitable angle for throttling functionality. For example, the angle of the tapered inner surface 144 can be within a range from 0.01 degree to 10 degrees, from 0.01 degree to 5 degrees, from 0.01 degree to 2 degrees, from 0.1 degree to 0.59 degree, from 0.1 degree to 0.5 degree, or within another suitable range of angles relative to the longitudinal axis 145 of the pin 136. In a particular embodiment, the tapered inner surface 144 has an angle of 0.5 degree relative to the longitudinal axis 145 of the pin 136. The contact surface 148 can have a suitable angle for receiving the end portion 136*b* of the pin 136 and at least generally shutting off fluid flow through the control valve 100. For example, the angle of the contact surface 148 can be within a range from 10 degrees to 90 degrees, from 15 degrees to 90 degrees, from 20 degrees to 40 degrees, from 25 degrees to 35 degrees, or within another suitable range of angles relative to the longitudinal axis 145 of the pin 136. In a particular embodiment, the contact surface 148 has an angle of 30 degrees relative to the longitudinal axis 145 of the pin 136.

With reference to FIGS. 1A and 1B together, the tapered inner surface 144 can be spaced apart from the contact surface 148 in a direction parallel to the longitudinal axis 145 of the pin 136. For example, the first seat 102, the second seat 104, or both can at least partially define a second chamber 150 between the first end portion 144*a* of the tapered inner surface 144 and the contact surface 148. The first passage 142 can have a larger cross-sectional area at the second chamber 150 relative to the longitudinal axis 145 of the pin 136 than at the tapered inner surface 144. Spacing the tapered inner surface 144 and the contact surface 148 can be useful, for example, to facilitate manufacturing. For example, the first and second seats 102, 104 can be separately manufactured and then joined (e.g., in an interlocking configuration). In some embodiments, the first and second seats 102, 104 are adjustably connectable such that adjusting a connection between the first and second seats 102, 104 varies the spacing between the tapered inner surface 144 and the contact surface 148. In other embodiments, the first and second seats 102, 104 can be fixedly connected (e.g., by welding). The engagement feature operably positioned between the first and second seats 102, 104 can be at least partially compression fit, include complementary threads, or have another suitable form. In some cases, the first and second seats 102, 104 are detachable from one another and separately replaceable. In other cases, the first and second seats 102, 104 can be non-detachable from one another.

Figure 1C:
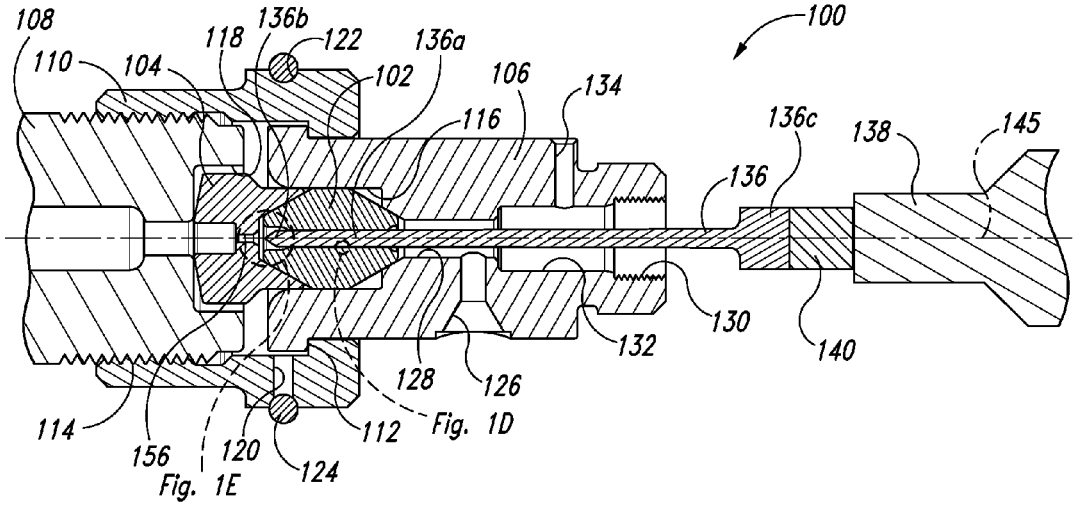
FIG. 1C is a cross-sectional side view illustrating the control valve shown in FIG. 1A with the pin at a given throttling position.
Figure 1D:
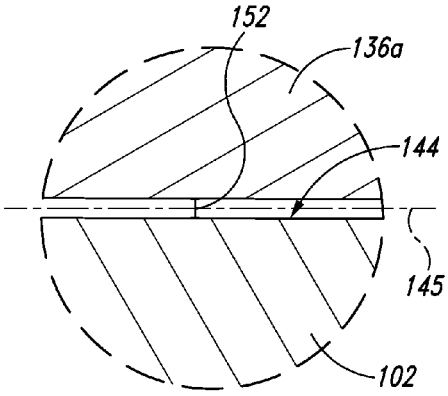
FIGS. 1D and 1E are enlarged views of portions of FIG. 1C.
Figure 1E:
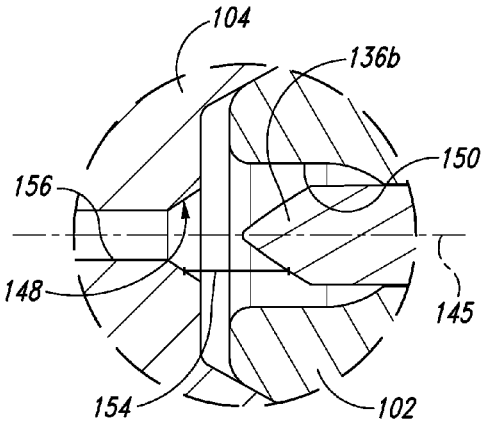

The pin 136 can be movable relative to the first and second seats 102, 104 between the shutoff position and one or more throttling positions in which the end portion 136*b* of the pin 136 is positioned away from the contact surface 148. For example, the pin 136 can be movable between the shutoff position and two or more throttling positions incrementally or infinitely varied within a range of throttling positions. FIG. 1C is a cross-sectional side view illustrating the control valve 100 with the pin 136 at a given throttling position. FIGS. 1D and 1E are enlarged views of portions of FIG. 1C. With reference to FIG. 1D, when the pin 136 is in the throttling position shown, the shaft portion 136*a* of the pin 136 and the tapered inner surface 144 can at least partially define a first gap 152 perpendicular to the longitudinal axis 145 of the pin 136 (e.g., a circumferential gap, an annular clearance, a free passage area, and/or the spacing between the shaft portion 136*a* of the pin 136 and the tapered inner surface 144). With reference to FIG. 1E, when the pin 136 is in the throttling position shown, the end portion 136*b* of the pin 136 and the contact surface 148 can at least partially define a second gap 154 parallel to the longitudinal axis 145 of the pin 136 (e.g., a longitudinal gap, a free passage area, and/or the spacing between the end portion 136*b* of the pin 136 and the contact surface 148). The second seat 104 can include a channel 156 along the second passage 146 adjacent to and downstream from the contact surface 148. The shaft and end portions 136*a*, 136*b* of the pin 136 can have outer surfaces angled to at least generally match the angles of the tapered inner surface 144 and the contact surface 148, respectively. For example, the shaft portion 136*a* of the pin 136 can have a tapered outer surface with an angle relative to the longitudinal axis 145 of the pin 136 equal to an angle of the tapered inner surface 144 relative to the longitudinal axis 145 of the pin 136.

Moving the pin 136 from one throttling position to another throttling position can proportionally vary the first and second gaps 152, 154. For example, moving the pin 136 from one throttling position to another throttling position (e.g., left-to-right in FIG. 1C) can vary (e.g., increase) the annular cross-sectional area of the first gap 152 in a plane perpendicular to the longitudinal axis 145 of the pin 136. In this way, the first gap 152 can act as a throttling gap. The shapes of the end portion 136*b* of the pin 136, the shaft portion 136*a* of the pin 136, the tapered inner surface 144, and the contact surface 148 can be selected to cause the second gap 154 to be proportionally greater than the first gap 152 when the pin 136 is at a given throttling position. In at least some embodiments, the second gap 154 can be at least 5 times greater (e.g., within a range from 5 times to 100 times greater), at least 10 times greater (e.g., within a range from 10 times to 80 times greater), at least 20 times greater (e.g., within a range from 20 times to 40 times greater), at least another suitable threshold multiple greater, or within another suitable range of multiples greater than the first gap 152 when the pin 136 is at a given throttling position. For example, in one embodiment, the second gap 154 is 28 times greater than the first gap 152 when the pin 136 is at a given throttling position.

At the high pressures and velocities typically used in waterjet systems, components within waterjet systems can erode rapidly. This erosion can compromise important tolerances or even lead to component failure. Typically, both the speed of a fluid flowing past a solid surface and the surface area of the surface affect its rate of erosion. When the cross-sectional area of a flow passage is restricted for a given pressure, the speed of the fluid increases proportionally with the restriction. With these variables in mind, the shapes of the end portion 136*b* of the pin 136, the shaft portion 136*a* of the pin 136, the tapered inner surface 144, and the contact surface 148 can be selected to enhance the operation and/or lifespan of the control valve 100. For example, in most cases, when the pin 136 is at a given throttling position and the second gap 154 is greater than the first gap 152, the speed of the fluid flowing through the first gap 152 is proportionally greater than the speed of the fluid flowing through the second gap 154. The surface areas of the tapered inner surface 144 and the contact surface 148 can be selected to at least partially compensate for differences in erosion associated with these differences in speed. For example, the surface area of the tapered inner surface 144 can be selected to cause the erosion rate of the tapered inner surface 144 and an erosion rate of the contact surface 148 to be within 50% of one another, within 25% of one another, or otherwise at least generally equal. When the erosion rates of the tapered inner surface 144 and the contact surface 148 are at least generally equal, the overall control valve 100 can wear relatively evenly, which can improve the operation of the control valve 100 and/or increase the lifespan of the control valve 100. The surface area of the tapered inner surface 144 can be variable over a wide range by changing the length of the tapered inner surface 144. In general, larger surfaces erode more slowly than smaller surfaces. Thus, the surface area of the tapered inner surface 144 can be selected to be at least 5 times (e.g., within a range from 5 times to 100 times), at least 10 times (e.g., within a range from 10 times to 100 times), at least 20 times (e.g., within a range from 20 times to 100 times), at least another suitable threshold multiple, or within another suitable range of multiples greater than the surface area of the contact surface 148.

With reference to FIG. 1C, the plunger 138 can be controlled by an actuator (not shown) of the control valve 100, and the pin 136 can be secured to the plunger 138 such that the actuator controls movement of the pin 136 (e.g., between a throttling position and the shutoff position and/or between two or more throttling positions) via the plunger 138. The actuator, for example, can have one or more of the features described below with reference to FIGS. 10-14B. In some embodiments, an adapter (not shown) attaches the base portion 136*c* of the pin 136 to the plunger 138 such that the actuator can both push and pull the pin 136 via the plunger 138. In other embodiments, the adapter can be absent and the base portion 136*c* of the pin 136 and the plunger 138 may be connected in another suitable manner. The first gap 152 can be slightly open when the pin 136 is in the shutoff position (e.g., the shaft portion 136*a* of the pin 136 and the tapered inner surface 144 can be slightly spaced apart along their lengths). Alternatively, the first gap 152 can be closed when the pin 136 is in the shutoff position (e.g., the shaft portion 136*a* of the pin 136 and the tapered inner surface 144 can be in contact along at least a portion of their lengths). The second gap 154 can be fully closed when the pin 136 is in the shutoff position shown in FIG. 1A (e.g., the end portion 136*b* of the pin 136 can contact the contact surface 148) and open when the pin 136 is at a given throttling position (e.g., the end portion 136*b* of the pin 136 can be spaced apart from the contact surface 148). When the first gap 152 is slightly open when the pin 136 is in the shutoff position, at least generally all of the force from the plunger 138 can be exerted against the contact surface 148. Even when the first gap 152 is closed when the pin 136 is in the shutoff position, a greater amount of force per surface area can be exerted against the contact surface 148 than against the tapered inner surface 144.

Relatively high compression force between the end portion 136*b* of the pin 136 and the contact surface 148 can be advantageous to facilitate complete or nearly complete sealing against fluid flow through the control valve 100. In at least some embodiments, the actuator and the contact surface 148 can be configured such that a compression force between the end portion 136*b* of the pin 136 and the contact surface 148 is at least 75,000 psi (e.g., within a range from 75,000 psi to 200,000 psi), at least 100,000 psi (e.g., within a range from 100,000 psi to 200,000 psi), at least another suitable threshold force, or within another suitable range of forces when the pin 136 is in the shutoff position. The second seat 104 can be configured to withstand this force. For example, in the illustrated embodiment, the contact surface 148 can be buttressed in a direction parallel to the longitudinal axis 145 of the pin 136 by a wall around the channel 156. The cross-sectional area of the second passage 146 can be smaller along a segment adjacent to and downstream from the contact surface 148 than another segment further downstream from the contact surface 148. The channel 156 can have a cross-sectional area adjacent to the contact surface 148 and perpendicular to the longitudinal axis 145 of the pin 136 less than 75% (e.g., within a range from 10% to 75%), less than 50% (e.g., within a range from 10% to 50%), less than another suitable threshold percentage, or within another suitable range of percentages of a cross-sectional area of the first passage 142 at the first end portion 144*a* of the tapered inner surface 144 and perpendicular to the longitudinal axis 145 of the pin 136.

Figure 2:
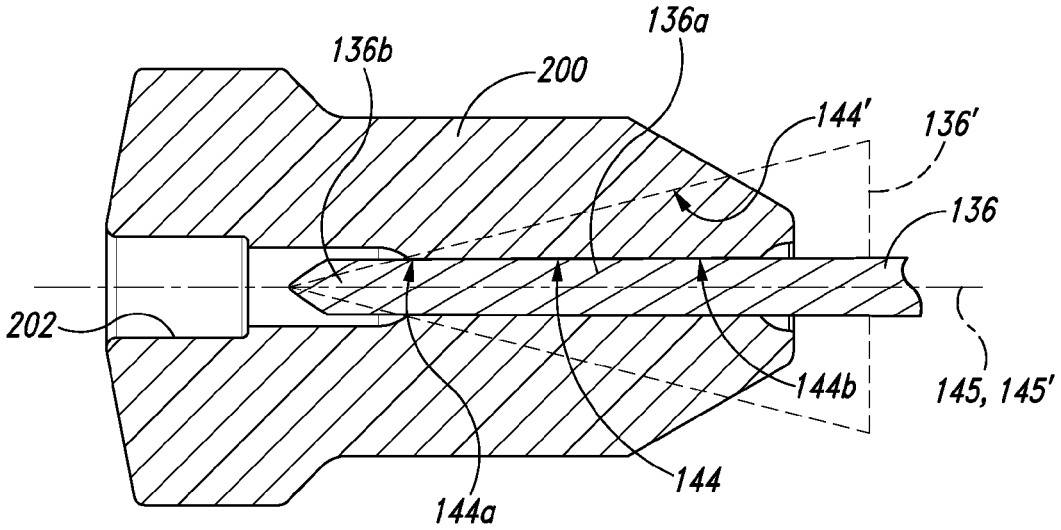
FIG. 2-9 are enlarged cross-sectional side views illustrating control-valve seats and pins configured in accordance with embodiments of the present technology.

FIGS. 2-9 are enlarged cross-sectional side views illustrating control-valve seats and pins configured in accordance with additional embodiments of the present technology. With reference to FIG. 2, a seat 200 can include a passage 202 and the tapered inner surface 144 within the passage 202. The seat 200 can be configured for use without a complementary seat having the contact surface 148 (FIG. 1B). In these embodiments, an actuator (not shown) can be configured to press the shaft portion 136*a* of the pin 136 against the tapered inner surface 144 with sufficient force to at least generally shut off flow of fluid though the passage 202. As discussed above, however, greater force is generally necessary to seal between larger surface areas. Furthermore, the tapers of the tapered inner surface 144 and the shaft portion 136*a* of the pin 136 can make it difficult to achieve a sufficient sealing force without causing the pin 136 to become jammed within the passage 202 (e.g., without causing static friction between the tapered inner surface 144 and the shaft portion 136*a* of the pin 136 to exceed a maximum pulling force of the actuator). Accordingly, in some embodiments, the seat 200 is configured to throttle fluid between the tapered inner surface 144 and the shaft portion 136*a* of the pin 136 without being configured to shut off flow of fluid though the passage 202. For example, shutting off flow of fluid though the passage 202 may be unnecessary (e.g., as discussed below with reference to FIG. 8) or may be achieved using a separate downstream component (e.g., as discussed below with reference to FIG. 28).

As discussed above with reference to FIG. 1A, when the tapered inner surface 144 and the contact surface 148 are both present, they may have different angles to facilitate different purposes (e.g., throttling in the case of the tapered inner surface 144 and shut off in the case of the contact surface 148). In most cases, angles suitable for throttling are relatively small (e.g., less than 5 degrees relative to the longitudinal axis 145 of the pin 136) and angles suitable for shut off are relatively large (e.g., greater than 10 degrees relative to the longitudinal axis 145 of the pin 136). As the angle of an interface between a pin and a complementary seat decreases, the amount by which the transverse cross-sectional area of a gap between the pin and the seat changes as the pin is retracted or advanced a given incremental distance typically also decreases. Thus, the relatively small angle of the tapered inner surface 144 can facilitate fine control over throttling. Separately, as the angle of an interface between a pin and a complementary seat increases, the area of a contact interface between the pin and the seat typically decreases. Thus, the relatively large angle of the contact surface 148 can decrease the force necessary to shut off flow through the control valve 100. The relatively large angle of the contact surface 148 also can decrease the force necessary to open the control valve 100 (e.g., by decreasing static friction at the contact interface). These factors can favor using different angles for throttling and shut off, as is the case with respect to the tapered inner surface 144 and the contact surface 148, respectively, in the embodiment illustrated in FIG. 1. In other embodiments, however, a single surface (e.g., a surface at a single angle or a surface having a continuous curve) may be used for both shut off and throttling functionality. Such a surface, for example, may have an angle between an angle described herein for throttling alone and an angle described herein for shut off alone.

With reference to FIG. 2, the seat 200 and the pin 136 can be modified such that interaction between the seat 200 and the pin 136 along a surface without an abrupt change in angle can provide both adequate throttling and adequate shut off functionality. For example, the tapered inner surface 144 can be replaced with a tapered inner surface 144' and the pin 136 can be replaced with a pin 136' having an outer surface complementary to the tapered inner surface 144'. In some embodiments, the angle of the tapered inner surface 144' is within a range from 2 degrees to 20 degrees, from 5 degrees to 15 degrees, from 20 degrees to 40 degrees, from 25 degree to 35 degrees, or within another suitable range of angles relative to a longitudinal axis 145' of the pin 136'. In a particular embodiment, the tapered inner surface 144' has an angle of 7.5 degrees relative to the longitudinal axis 145'. Furthermore, the angle of the tapered inner surface 144' and the angle of the complementary surface of the pin 136' can be slightly different. This feature, for example, may advantageously reduce static friction between the tapered inner surface 144' and the pin 136' when the pin 136' is at a shutoff position. The difference between the angle of the tapered inner surface 144' and the angle of the complementary surface of the pin 136', for example, can be within a range from 0.1 degree to 3 degrees, from 0.2 degree to 2 degrees, from 0.3 degree to 1 degree, or within another suitable range of angles relative to the longitudinal axis 145'. In a particular embodiment, the difference between the angle of the tapered inner surface 144' and the angle of the complementary surface of the pin 136' is 0.5 degree. In some cases, the angle of the tapered inner surface 144' is greater than the angle of the complementary surface of the pin 136' such that friction between the tapered inner surface 144' and the pin 136' when the pin 136' is in the shutoff position increases along the longitudinal axis 145' in a downstream direction. In other cases, the angle of the tapered inner surface 144' can be less than the angle of the complementary surface of the pin 136' such that friction between the tapered inner surface 144' and the pin 136' when the pin 136' is in the shutoff position decreases along the longitudinal axis 145' in the downstream direction.

Figure 3:
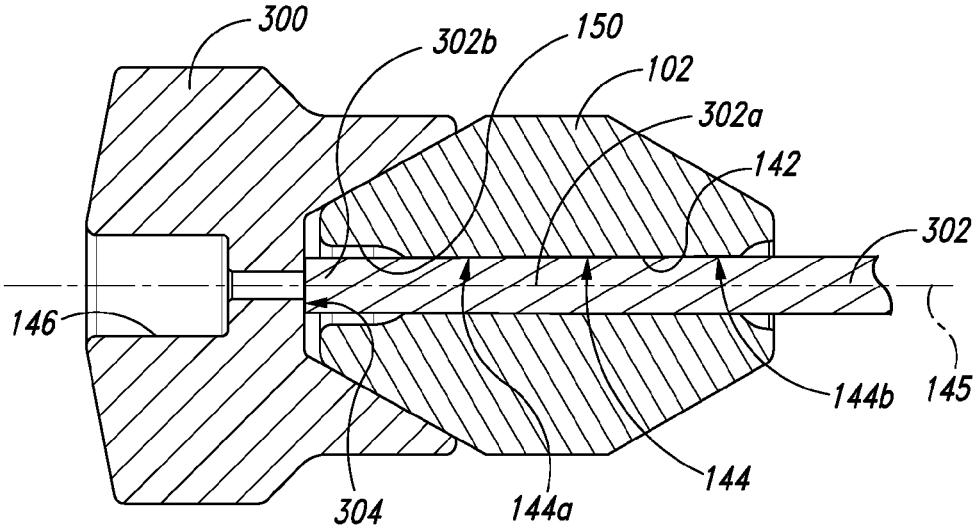
Figure 4:
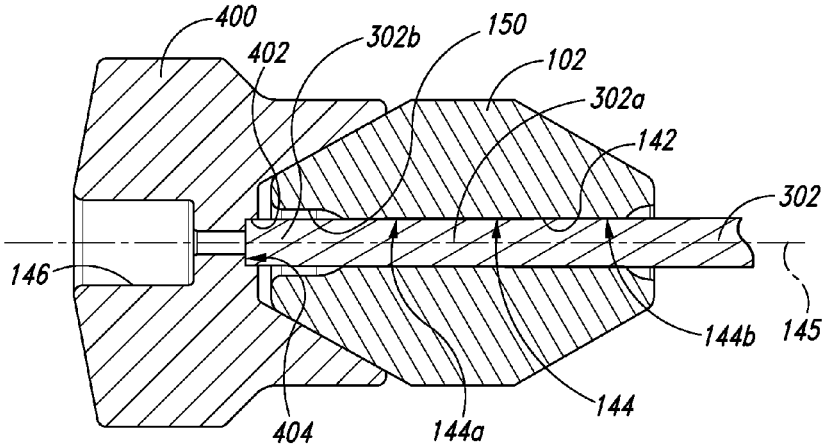

FIGS. 3 and 4 illustrated still other embodiments of seats and complementary pins configured in accordance with embodiments of the present technology. In particular, FIG. 3 illustrates the first seat 102 in conjunction with a second seat 300 and a pin 302 having a shaft portion 302*a* and an end portion 302*b*. The second seat 300 can have a contact surface 304 at least generally perpendicular to the longitudinal axis 145 of the pin 302. The end portion 302*b* of the pin 302 can be flat or otherwise shaped to sealingly engage the contact surface 304. FIG. 4 illustrates the first seat 102 and the pin 302 in conjunction with a second seat 400 including an inset 402 and a contact surface 404 within the inset 402. The contact surface 404 can be configured to engage the end portion 302*b* of the pin 302 such that the end portion 302*b* of the pin 302 is at least partially disposed within the inset 402 when the pin 302 is at a shutoff position. Seats and pins in other embodiments can have a variety of other suitable forms.

Figure 5:
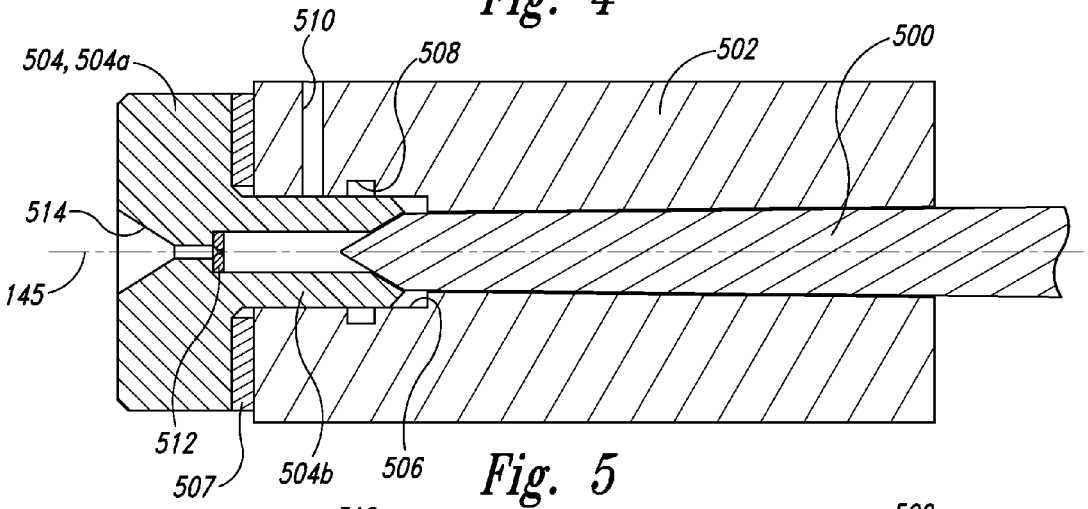
Figure 6:
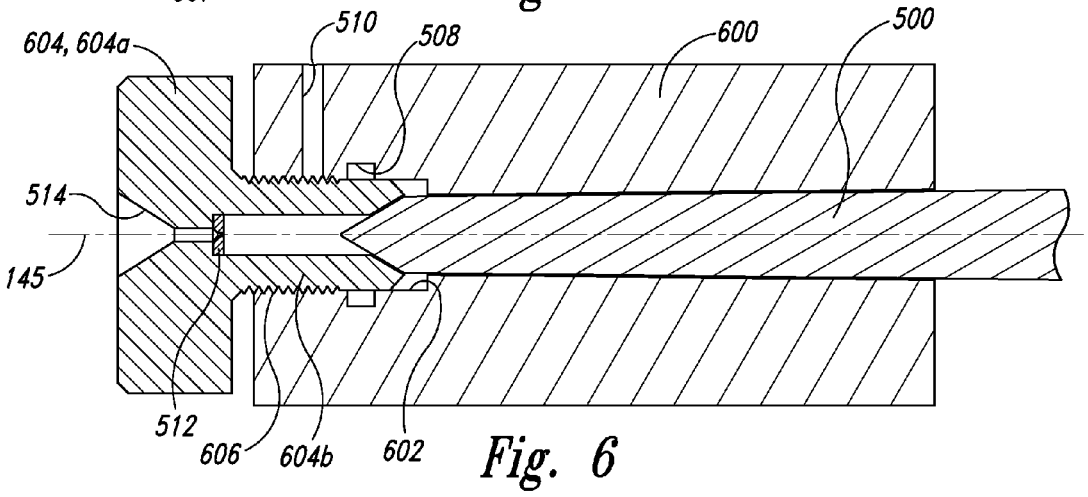

In the control valve 100 shown in FIGS. 1A-1E, the first seat 102 is partially inset within the second seat 104. In other embodiments, the second seat 104 can be partially inset within the first seat 102. For example, FIG. 5 illustrates a pin 500, a first seat 502, and a second seat 504 partially inset within the first seat 502. The second seat 504 can include a base portion 504*a* and a projecting portion 504*b*. The first seat 502 can include an opening 506 configured to receive the projecting portion 504*b* of the second seat 504. A spacer 507 (e.g., one or more shims) can be operably positioned between the first seat 502 and the base portion 504*a* of the second seat 504. The first seat 502 can include an annular recess 508 and a weep hole 510 connected to the opening 506. The annular recess 508 can be configured to receive a high-pressure seal (not shown). The second seat 504 can include an orifice element 512 downstream from the first and second seats 102, 104, and a jet outlet 514 downstream from the orifice element 512. FIG. 6 illustrates a first seat 600 including an opening 602 and a second seat 604 including a base portion 604*a* and a projecting portion 604*b*. The projecting portion 604*b* of the second seat 604 can be connected to the first seat 600 at an engagement feature 606 including complementary threads operably positioned within the opening 602. The spacer 507 (FIG. 5) and the engagement feature 606 (FIG. 6) can facilitate adjusting the relative positions of the first seats 502, 600 and the second seats 504, 604, respectively.

Figure 7:
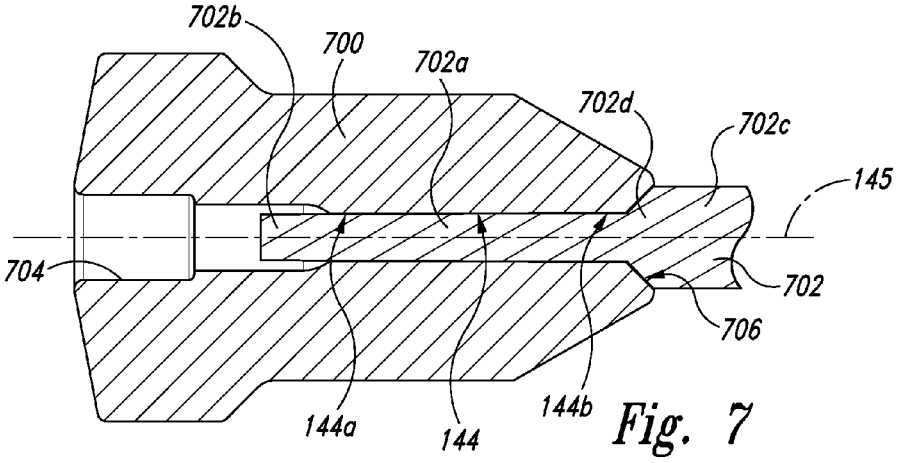

As discussed above with reference to FIGS. 1A-1E, in some embodiments, the contact surface 148 (FIG. 1B) is operably positioned downstream from the tapered inner surface 144 (FIG. 1B). In other embodiments, the contact surface 148 can be operably positioned upstream from the tapered inner surface 144. For example, FIG. 7 illustrates a seat 700 and a pin 702 partially received within a passage 704 of the seat 700. The seat 700 can include a contact surface 706 operably positioned upstream from the tapered inner surface 144. The pin 702 can include a first portion 702*a* operably positioned toward a downstream end portion 702*b*, a second portion 702*c* operably positioned toward an upstream end portion (not shown), and a third portion 702*d* therebetween. The downstream end portion 702*b* can be at least generally flat, conical, or have another suitable shape. The first portion 702*a* can be tapered and can be configured to interact with the tapered inner surface 144 to throttle fluid flow through the passage 704. The third portion 702*d* can be configured to interact with the contact surface 706 to shut off fluid flow through the passage 704.

Figure 8:
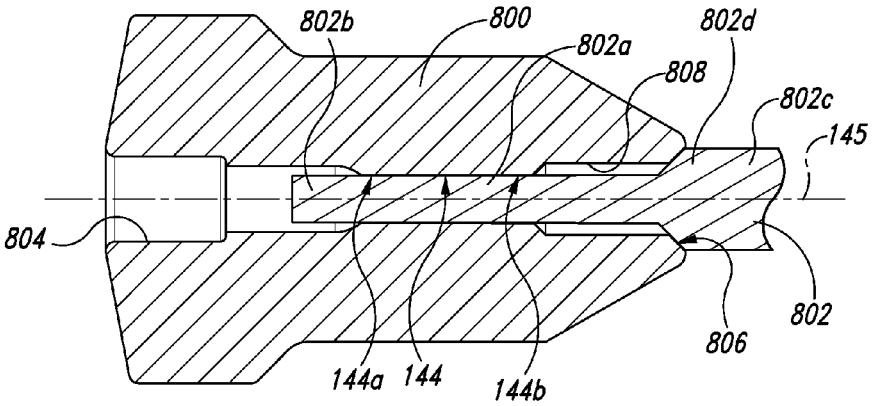

In the embodiment illustrated in FIG. 7, the contact surface 706 is adjacent to the second end portion 144*b* of the tapered inner surface 144. In other embodiments, the contact surface 706 can be spaced apart from the second end portion 144*b* of the tapered inner surface 144. For example, FIG. 8 illustrates a seat 800 and a pin 802 partially received within a passage 804 of the seat 800. The seat 800 can include a contact surface 806 upstream from the tapered inner surface 144 and an enlarged opening 808 between the contact surface 806 and the tapered inner surface 144. The pin 802 can include a first portion 802*a* operably positioned toward a downstream end portion 802*b*, a second portion 802*c* operably positioned toward an upstream end portion (not shown), and a third portion 802*d* therebetween. The first portion 802*a* of the pin 802 can be longer than the first portion 702*a* of the pin 702 (FIG. 7) to extend through the enlarged opening 808.

Figure 9:
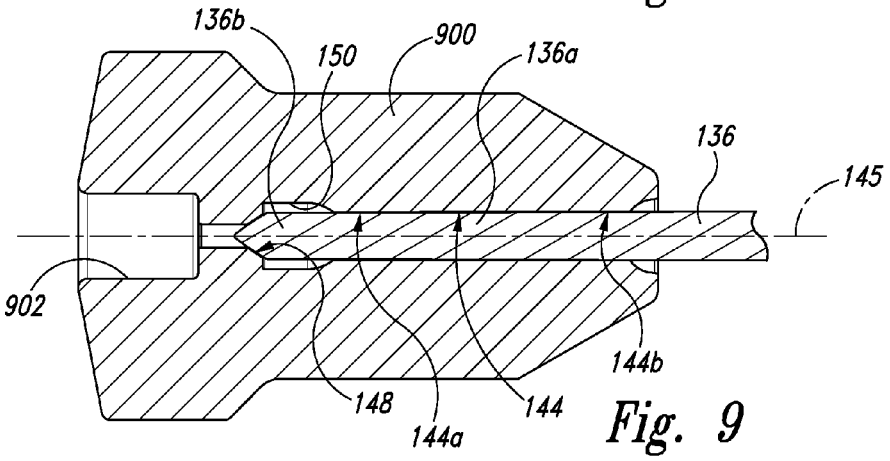

Positioning the contact surface 806 at an upstream end of the passage 804 may facilitate manufacturing the seat 800 as a single piece. Accordingly, in the illustrated embodiment, the seat 800 is at least generally free of seams between the contact surface 806 and the tapered inner surface 144. In other embodiments, the seat 800 can be replaced with an upstream seat including the contact surface 806 and a downstream seat including the tapered inner surface 144 connected in a suitable manner (e.g., as discussed above in the context of connecting the first and second seats 102, 104 shown in FIG. 1B). The first and second seats 102, 104 shown in FIG. 1B may be a single piece without any seams. For example, FIG. 9 illustrates a seat 900 having a passage 902. In the illustrated embodiment, the contact surface 148 and the tapered inner surface 144 are part of a single piece with the contact surface 148 positioned downstream from the tapered inner surface 144.

With reference to FIGS. 1A-1E, although in some cases fluid flows through the control valve 100 from the fluid inlet 126 toward the second passage 146, in other cases fluid can flow through the control valve 100 in the opposite direction. Similarly, with reference to FIGS. 2-9, although in some cases fluid flows past the pins 136, 302, 500, 702 and 802 in the same direction as the direction in which the pins 136, 302, 500, 702 and 802 taper inwardly (i.e., the direction in which the width of the pins 136, 302, 500, 702 and 802 decreases), in other cases, fluid can flow past the pins 136, 302, 500, 702 and 802 in the opposite direction. Accordingly, although some control-valve features and components described above and elsewhere in this disclosure are described with terms such as upstream, downstream, inlet, outlet, and the like, the opposite terms can be attributed to the features and components when flow is reversed. For example, the fluid inlet 126 can be a fluid outlet, the upstream housing 106 can be a downstream housing, and the downstream housing 108 can be an upstream housing. In some embodiments, the control valve 100 includes certain modifications to facilitate reverse flow. For example, the upstream housing 106 can be configured to be coupled to a cutting head (not shown) extending away from the upstream housing 106 toward a jet outlet (also not shown) such that fluid at a pressure controlled by the control valve 100 exits the control valve 100 via the fluid inlet 126 and flows through the cutting head toward the jet outlet.

Selected Examples of Control-Valve Actuators

Control valves configured in accordance with at least some embodiments of the present technology can include actuators (e.g., linear actuators) that precisely and accurately move a pin to one or more positions relative to a seat and at least generally maintain the pin at the position(s). In some cases, the actuators include electromechanical and/or hydraulic actuating mechanisms alone or in combination with pneumatic actuating mechanisms. In other cases, the actuators can be entirely pneumatic, or be configured to operate by one or more other suitable modalities. Suitable electromechanical actuating mechanisms can include, for example, stepper motors, servo motors with position feedback, direct-current motors with position feedback, and piezoelectric actuating mechanisms, among others. In a particular embodiment, a control valve includes an actuator having a Switch and Instrument Motor Model 87H4B available from Haydon Kerk Motion Solutions (Waterbury, Conn.).

Different types of actuating mechanisms can have different advantages when incorporated into control valves in accordance with embodiments of the present technology. For example, electromechanical and hydraulic actuating mechanisms are typically more resistant to moving in response to variable opposing forces than pneumatic actuating mechanisms. Pneumatic actuating mechanisms, however, typically operate more rapidly than hydraulic actuating mechanisms as well as many types of electromechanical actuating mechanisms. Furthermore, relative to electromechanical actuating mechanisms, pneumatic actuating mechanisms typically are better suited for precisely controlling the level of force on a pin. As discussed in further detail below, actuators configured in accordance with at least some embodiments of the present technology can have one or more features that reduce or eliminate one or more disadvantages associated with conventional actuators in the context of actuating the control valves discussed above with reference to FIGS. 1A-9 and/or other control values configured in accordance with embodiments of the present technology.

It can be useful for an actuator to have a combination of different actuating mechanisms. For example, with reference to FIGS. 1A-1E, the actuator (not shown) can move the pin 136 relative to the first and second seats 102, 104 through a range of positions between a shutoff position and a given throttling position. The actuator of the control valve 100 can include a first actuating mechanism (also not shown) (e.g., a hydraulic and/or electromechanical actuating mechanism) configured primarily to move the pin 136 from one throttling position to another throttling position, and a second actuating mechanism (also not shown) (e.g., a pneumatic actuating mechanism) configured to move the pin 136 through the range of throttling positions to and/or from the shutoff position. For example, the first actuating mechanism can be configured to exert a variable force on the pin 136 to at least partially counteract a variable opposing force on the pin 136, thereby maintaining the pin 136 at an at least generally consistent position during throttling. The second actuating mechanism can be configured to exert a more consistent force on the pin 136 than the first actuating mechanism so as to press the end portion 136*b* of the pin 136 against the contact surface 148 with an at least generally consistent force when the pin 136 is in the shutoff position. It can be useful to move the pin 136 through at least some of the throttling positions rapidly (e.g., to reduce erosion on the contact surface 148). Accordingly, the second actuating mechanism can be configured to move the pin 136 at a faster speed than the first actuating mechanism. In some embodiments, the second actuating mechanism can include a snap-acting-diaphragm, such as a metal snap-acting-diaphragm available from Hudson Technologies (Ormond Beach, Fla.). Snap-acting-diaphragms, for example, can facilitate rapid small-stroke actuating without sliding parts. In other embodiments, control valves configured in accordance with the present technology can utilize other types of actuators in other manners.

Figure 10:
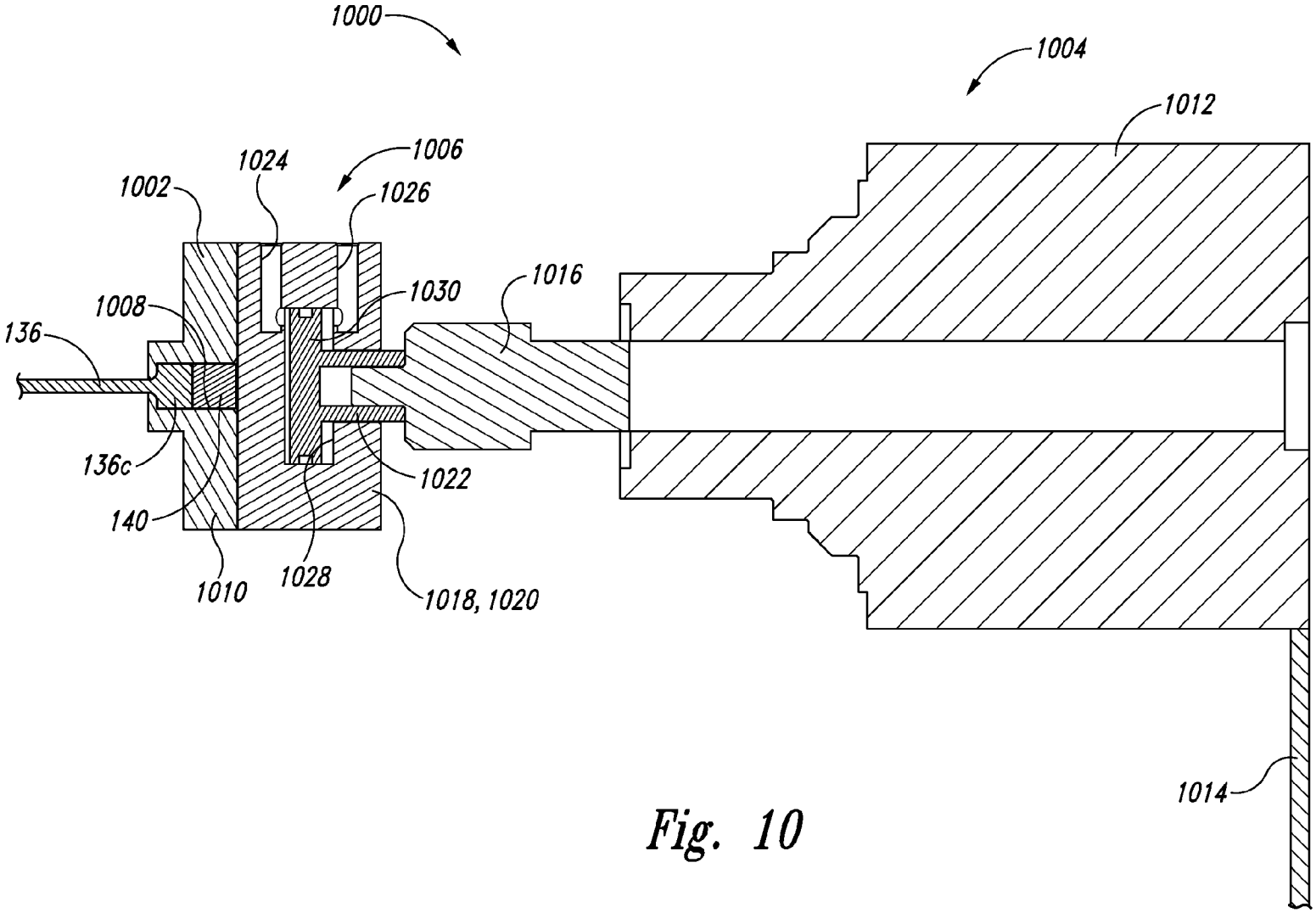
FIGS. 10 and 11 are cross-sectional side views illustrating control-valve actuators configured in accordance with embodiments of the present technology.

FIG. 10 is a cross-sectional side view illustrating an actuator 1000 configured in accordance with an embodiment of the present technology that can be useful, for example, in conjunction with the control valve 100. The actuator 1000 can include an adapter 1002, a first actuating mechanism 1004, and a second actuating mechanism 1006 operably positioned between the adapter 1002 and the first actuating mechanism 1004. The adapter 1002 can include a central recess 1008 configured to receive both the base portion 136*c* of the pin 136 and the cushion 140. The adapter 1002 can further include a flange 1010 secured (e.g., bolted) to the second actuating mechanism 1006. The first actuating mechanism 1004 can include a stepper motor 1012 (shown without internal detail for clarity), a power cord 1014 (e.g., an electrical cord), and a first plunger 1016. The second actuating mechanism 1006 can include a pneumatic cylinder 1018 having a body 1020 and a second plunger 1022. The body 1020 can include a first fluid port 1024, a second fluid port 1026, and a chamber 1028 operably positioned between the first and second fluid ports 1024, 1026. The second plunger 1022 can include a movable member, such as a piston 1030, configured to move back and forth within the chamber 1028. A difference between a pressure on one side of the piston 1030 associated with the first fluid port 1024 relative to a pressure on an opposite side of the piston 1030 associated with the second fluid port 1026 can cause the second plunger 1022 to move relative to the body 1020 so as to approach or achieve pressure equilibrium. In the illustrated embodiment, the first actuating mechanism 1004 is electromechanical and the second actuating mechanism 1006 is pneumatic. In other embodiments, the first actuating mechanism 1004 can be pneumatic and the second actuating mechanism 1006 can be electromechanical. In still other embodiments, the first and second actuating mechanisms 1004, 1006 can be the same type (e.g., electromechanical, hydraulic, pneumatic, etc.) with one or more different characteristics (e.g., force, travel, and/or resistance to static and/or dynamic loads).

Figure 11:
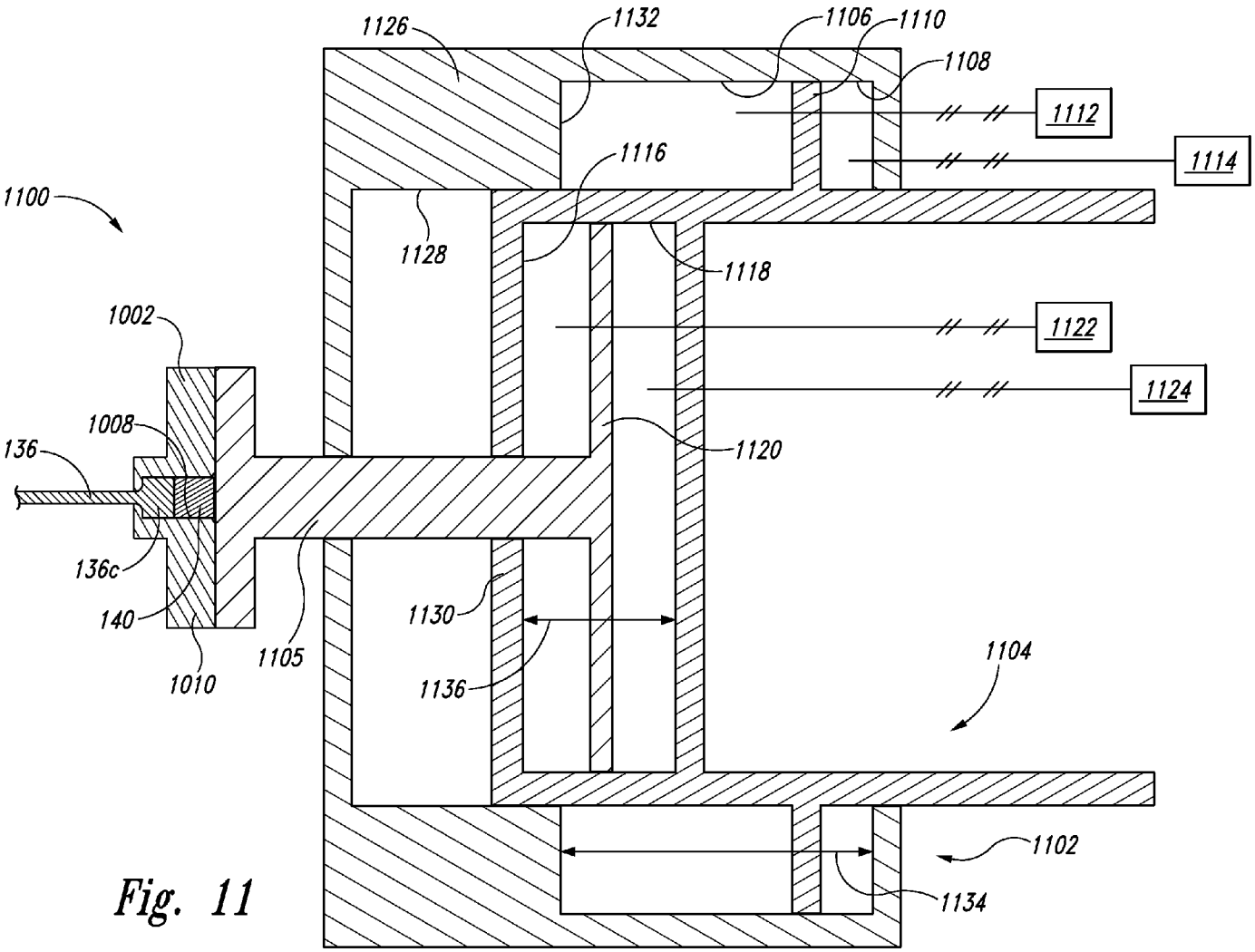

FIG. 11 is a cross-sectional side view illustrating an actuator 1100 configured in accordance with an embodiment of the present technology. The actuator 1100 can include a first pneumatic actuating mechanism 1102, a second pneumatic actuating mechanism 1104, and a plunger 1105. The first pneumatic actuating mechanism 1102 can include an annular first enclosure 1106, an annular second enclosure 1108, and a first movable member, such as a first piston 1110, operably positioned between the first enclosure 1106 and the second enclosure 1108. The first and second enclosures 1106, 1108 can be operably connected to first and second pneumatic regulators 1112, 1114, respectively, for controlling pneumatic flow into and out of the first and second enclosures 1106, 1108, respectively. The second pneumatic actuating mechanism 1104 can include a cylindrical third enclosure 1116, a cylindrical fourth enclosure 1118, and a second movable member, such as a second piston 1120, operably positioned between the third and fourth enclosures 1116, 1118. The third and fourth enclosures 1116, 1118 can be operably connected to third and fourth pneumatic regulators 1122, 1124, respectively. The plunger 1105 can be operably connected to the second piston 1120.

In at least some embodiments, the second pneumatic actuating mechanism 1104 can be at least partially inset within the first pneumatic actuating mechanism 1102. For example, the actuator 1100 can include an outer housing 1126 having a central channel 1128 (e.g., cylinder), and an inner housing 1130 at least partially defining the third and fourth enclosures 1116, 1118. The inner housing 1130 can be slidably received within the central channel 1128. The outer housing 1126 can include an annular channel 1132 around the central channel 1128. The channel 1132 can at least partially define the first and second enclosures 1106, 1108. The first piston 1110 can be annular and secured to the inner housing 1130 such that the first piston 1110 and the inner housing 1130 move together. For example, the first and second pneumatic regulators 1112, 1114 can cause a pressure difference on opposite sides of the first piston 1110 that causes the inner housing 1130 and the second piston 1120 (and hence the plunger 1105) to move relative to the outer housing 1126. The third and fourth pneumatic regulators 1122, 1124 can cause a pressure difference on opposite sides of the second piston 1120 that causes the second piston 1120 (and hence the plunger 1105) to move relative to the inner housing 1130 and the outer housing 1126.

The actuator 1100 can be configured to move the pin 136 between a shutoff position, a first throttling position, and at least a second throttling position. For example, the first pneumatic actuating mechanism 1102 can have a fully open position when the pressure in the first enclosure 1106 is greater than the pressure in the second enclosure 1108 causing the inner housing 1130 to move from left to right in FIG. 11, and a fully closed position when the pressure in the first enclosure 1106 is less than the pressure in the second enclosure 1108 causing the inner housing 1130 to move from right to left in FIG. 11. Similarly, the second pneumatic actuating mechanism 1104 can have a fully open position when the pressure in the third enclosure 1116 is greater than the pressure in the fourth enclosure 1118 causing the second piston 1120 to move from left to right in FIG. 11, and a fully closed position when the pressure in the third enclosure 1116 is less than the pressure in the fourth enclosure 1118 causing the second piston 1120 to move from right to left in FIG. 11. When the first and second pneumatic actuating mechanisms 1102, 1104 are fully closed or nearly fully closed, the pin 136 can be at or near the shutoff position. When the first pneumatic actuating mechanism 1102 is fully closed or nearly fully closed and the second pneumatic actuating mechanism 1104 is fully open or nearly fully open, the pin 136 can be at or near the first throttling position. When the first and second pneumatic actuating mechanisms 1102, 1104 are fully open or nearly fully open, the pin 136 can be at or near the second throttling position. In some embodiments, the first throttling position is selected to produce a jet (e.g., a relatively low-pressure jet) suitable for piercing a composite or brittle material (e.g., glass) and the second throttling position is selected to produce a more powerful jet suitable for rapidly cutting or otherwise processing a workpiece. In other embodiments, the actuator 1100 can include additional pneumatic or non-pneumatic actuating mechanisms (e.g., nested within the second pneumatic actuating mechanism 1104) configured to move relative to one another in suitable permutations so as to move the pin 136 between more than two throttling positions.

The first pneumatic actuating mechanism 1102 can have a first travel distance 1134 and the second pneumatic actuating mechanism 1104 can have a second travel distance 1136 less than the first travel distance 1134. For example, the first travel distance 1134 can be within a range from 0.05 inch to 0.5 inch, from 0.1 inch to 0.3 inch, or within another suitable range. In a particular embodiment, the first travel distance 1134 is 0.2 inch. The second travel distance 1136 can be, for example, within a range from 0.001 inch to 0.05 inch, from 0.005 inch to 0.015 inch, or within another suitable range. In a particular embodiment, the second travel distance 1136 is 0.01 inch. The ratio of the first travel distance 1134 to the second travel distance 1136 can be, for example, within a range from 5:1 to 50:1, from 10:1 to 30:1, or within another suitable range. In a particular embodiment, the ratio of the first travel distance 1134 to the second travel distance 1136 is 20:1. It can be useful for the first pneumatic actuating mechanism 1102 to be more powerful than the second pneumatic actuating mechanism 1104 for a given pneumatic fluid pressure. Accordingly, in some embodiments, the first piston 1110 has a greater surface area exposed to pneumatic force than the second piston 1120. In other embodiments, the second piston 1120 can have a greater surface area exposed to pneumatic force than the first piston 1110.

With reference to FIGS. 1A, 1B, and 11 together, the force necessary to move the pin 136 typically decreases as the end portion 136*b* of the pin 136 approaches the contact surface 148. Thus, the force necessary to move the pin 136 a final incremental distance before it reaches the shutoff position can be relatively small. After the pin 136 reaches the shutoff position, it can be useful to avoid pressing the end portion 136*b* of the pin 136 against the contact surface 148 with excessive force (e.g., force in excess of a force necessary to achieve a suitable level of sealing) to avoid damaging the end portion 136*b* of the pin 136 and/or the contact surface 148 and/or jamming the pin 136 (e.g., such that the pin 136 becomes stuck due to friction). In at least some embodiments, the second pneumatic actuating mechanism 1104 is configured to apply a level of force selected for achieving a suitable contact force between the end portion 136*b* of the pin 136 and the contact surface 148 when the pin 136 is in the shutoff position. Additionally, the first pneumatic actuating mechanism 1102 can be configured to apply a higher level of force selected to overcome opposing force acting on the pin 136 when the pin 136 is in the first throttling position. In a particular embodiment, for example, the second pneumatic actuating mechanism 1104 is configured to apply 400 pounds of force. When the second pneumatic actuating mechanism 1104 includes an electric motor, the motor can be configured to automatically slip or stall at a force lower than a force that would damage the end portion 136*b* of the pin 136 and/or the contact surface 148, but still greater than a force necessary to achieve a suitable level of sealing.

Figure 12A:
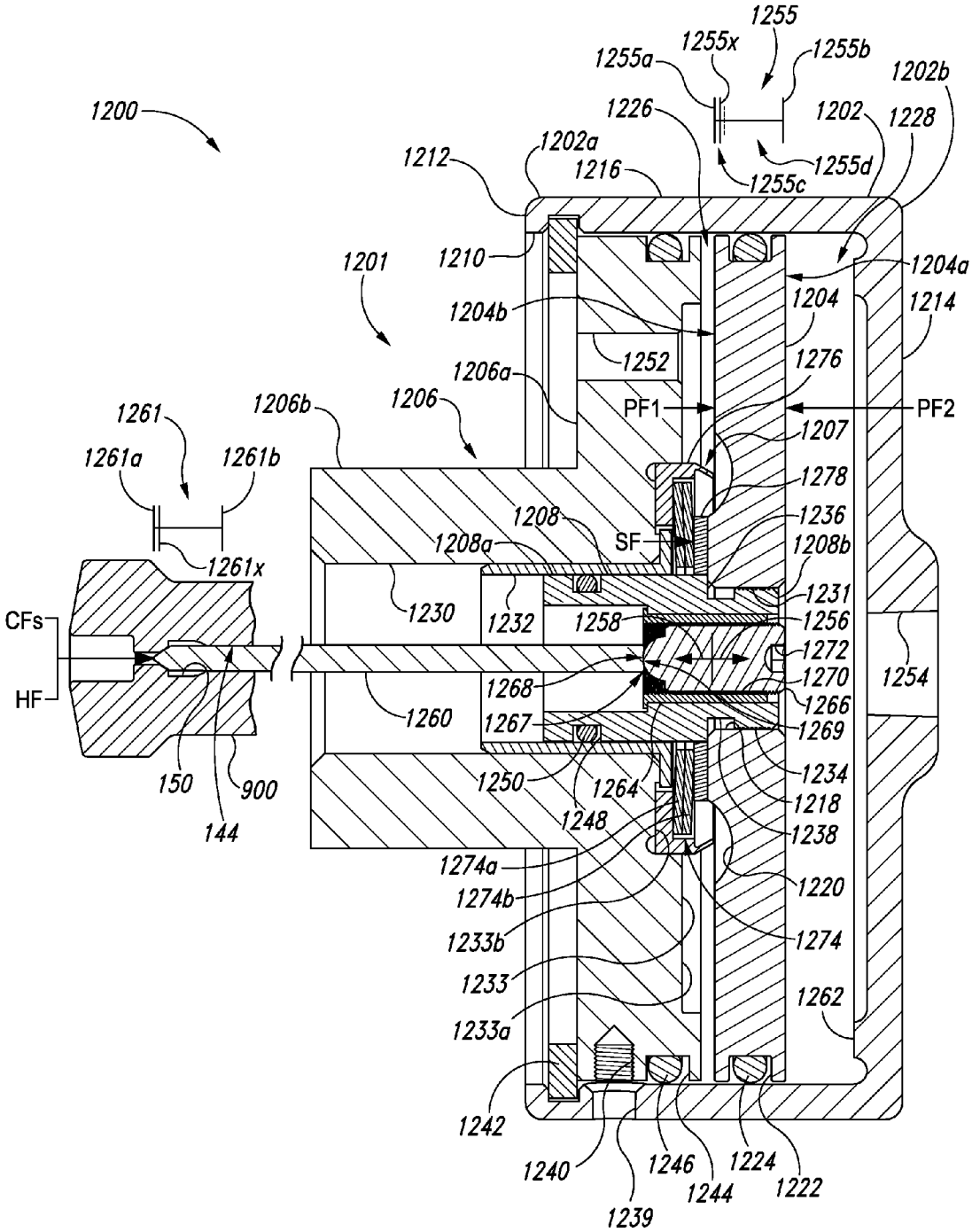
FIGS. 12A, 12B, and 12C are cross-sectional side views illustrating a portion of a control valve including an actuator having a piston at a first end position, a given intermediate position, and a second end position, respectively, configured in accordance with an embodiment of the present technology.
Figure 12B:
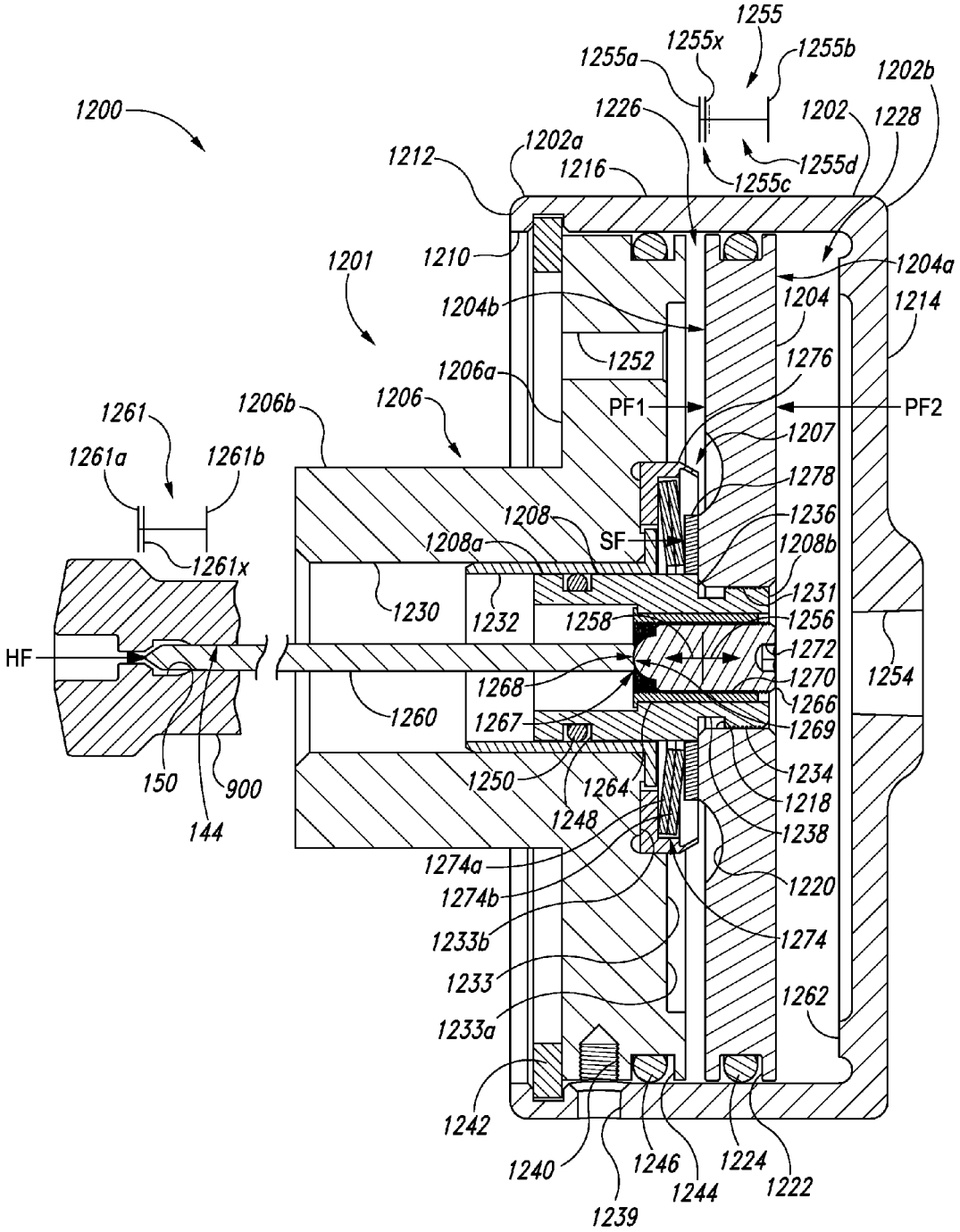
Figure 12C:
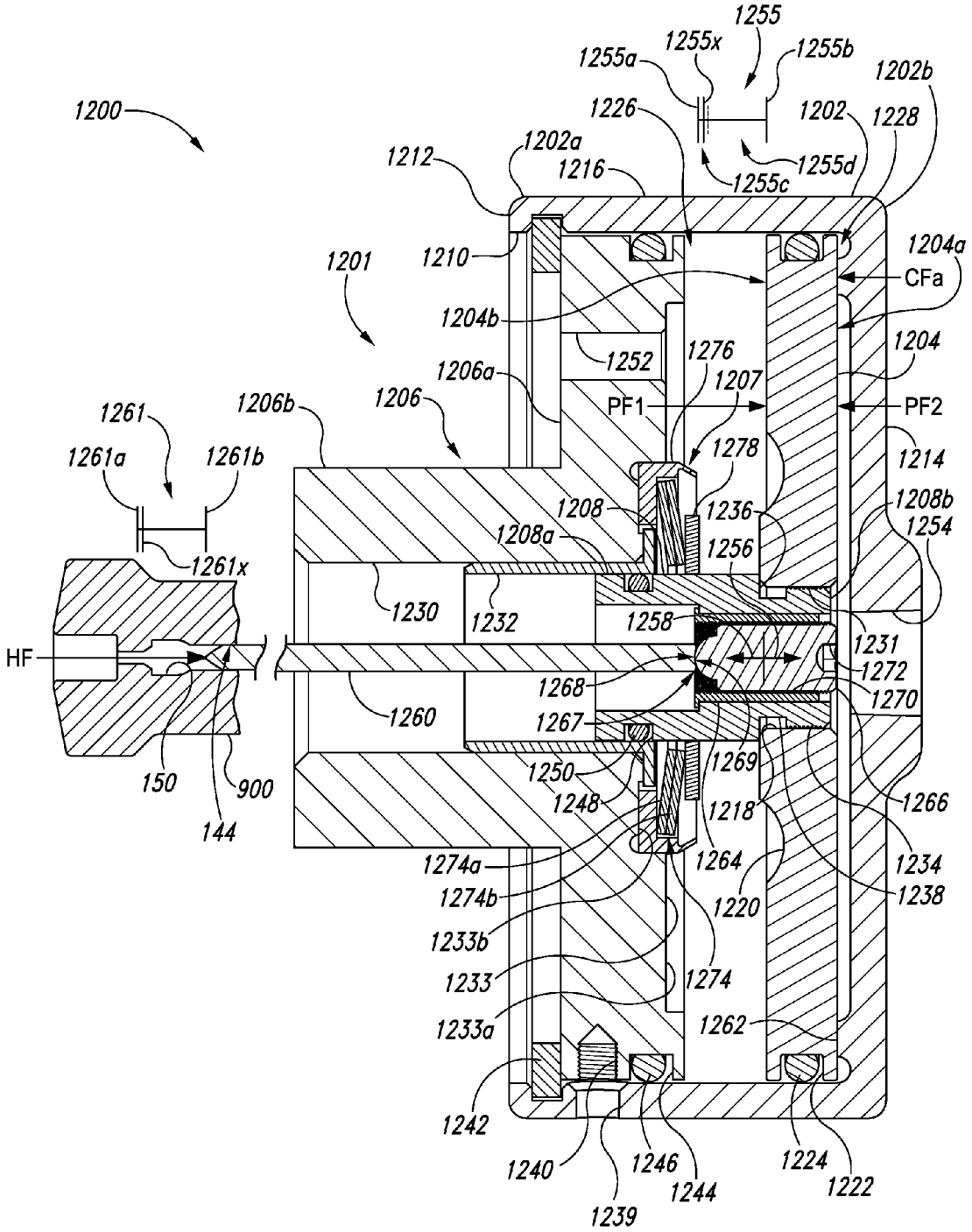

FIGS. 12A, 12B, and 12C are cross-sectional side views illustrating a portion of a control valve 1200 including an actuator 1201 configured in accordance with an embodiment of the present technology. The actuator 1201 can include an actuator housing 1202 having a first end 1202*a* and a second end 1202*b* opposite to the first end 1202*a*. The actuator 1201 can further include a movable member, such as a piston 1204, slidably positioned within the actuator housing 1202 toward the second end 1202*b*, and a plunger guide 1206 operably positioned toward the first end 1202*a*. The piston 1204 can have a first side 1204*a* facing away from the seat 900 and a second side 1204*b* facing toward the seat 900. The plunger guide 1206 can have a first portion 1206*a* secured within the actuator housing 1202 and a second portion 1206*b* extending out of the actuator housing 1202 beyond the first end 1202*a*. The actuator 1201 can further include a spring assembly 1207 secured to the plunger guide 1206, and a plunger 1208 secured to the piston 1204 and partially slidably inset within the plunger guide 1206. The actuator housing 1202 can be at least generally cylindrical and can include a major opening 1210 at the first end 1202*a*, a lip 1212 around the major opening 1210, a cap 1214 at the second end 1202*b*, and a sidewall 1216 extending between the lip 1212 and the cap 1214. The piston 1204 can be disk-shaped and can include a central bore 1218 and an annular groove 1220 facing toward the first end 1202*a*. The piston 1204 can further include a first edge recess 1222 and a first sealing member 1224 (e.g., an o-ring) inset within the first edge recess 1222. The first sealing member 1224 can be configured to slide along an inner surface of the sidewall 1216 to form a movable pneumatic seal. For example, the actuator 1201 can include a first enclosure 1226 and a second enclosure 1228 at opposite sides of the piston 1204, and the first sealing member 1224 can be configured to pneumatically separate the first and second enclosures 1226, 1228.

The plunger guide 1206 can include a central channel 1230 and can be configured to slidingly receive a first end portion 1208*a* of the plunger 1208 while a second end portion 1208*b* of the plunger 1208 is secured to the piston 1204 within the central bore 1218. For example, the plunger 1208 at the second end portion 1208*b* and the piston 1204 at the central bore 1218 can include complementary first threads 1231. In the illustrated embodiment, the first end portion 1208*a* of the plunger 1208 is slidingly received within a smooth bushing 1232 of the plunger guide 1206 inserted into the central channel 1230. The plunger guide 1206 can further include a stepped recess 1233 extending around the central channel 1230 and facing toward the second end 1202*b*. The stepped recess 1233 can have a first portion 1233*a* spaced apart from the central channel 1230 and a concentric second portion 1233*b* positioned between the first portion 1233*a* and a perimeter of the central channel 1230. The second portion 1233*b* can be more deeply inset into the plunger guide 1206 than the first portion 1233*a*, and can be configured to receive the spring assembly 1207. The second end portion 1208*b* of the plunger 1208 can be part of a stepped-down segment 1234 of the plunger 1208, and the plunger 1208 can further include a ledge 1236 adjacent to the stepped-down segment 1234 as well as a circumferential groove 1238 operably positioned between the ledge 1236 and the first threads 1231. The piston 1204 can be configured to contact the ledge 1236 around a perimeter of the central bore 1218 when the stepped-down segment 1234 is fully secured to the piston 1204.

The actuator 1201 can be assembled, for example, by inserting the piston 1204 (e.g., with the plunger 1208 secured to the piston 1204) into the actuator housing 1202 via the major opening 1210 and subsequently inserting the plunger guide 1206 into the actuator housing 1202 via the major opening 1210. Screws (not shown) (e.g., set screws) can be individually inserted through holes 1239 in the sidewall 1216 and into threaded recesses 1240 (one shown) distributed around the circumference of the first portion 1206*a* of the plunger guide 1206 to secure the plunger guide 1206 in position. The actuator 1201 can further include a retaining ring 1242 (e.g., a flexible gasket, a radially expandable clamp, or another suitable component) operably positioned between the lip 1212 and the first portion 1206*a* of the plunger guide 1206. The retaining ring 1242 can reduce vibration of the plunger guide 1206 during use or have another suitable purpose. The plunger guide 1206 can include a second edge recess 1244 and a second sealing member 1246 (e.g., an o-ring) operably positioned within the second edge recess 1244. Similarly, the plunger 1208 can include a third edge recess 1248 and a third sealing member 1250 (e.g., an o-ring) operably positioned within the third edge recess 1248. The second sealing member 1246 can be configured to engage the sidewall 1216 to form a fixed pneumatic seal, and the third sealing member 1250 can be configured to slide along an inner surface of the central channel 1230 to form a movable pneumatic seal. In conjunction with the first sealing member 1224, the second and third sealing members 1246, 1250 can be configured to pneumatically seal the first enclosure 1226.

The actuator 1201 can further include a first pneumatic port 1252 and a second pneumatic port 1254 operably connected to the first and second enclosures 1226, 1228, respectively. In some embodiments, the actuator 1201 is configured to be controlled by changing the pressure of gas (e.g., air) within the first enclosure 1226 while the pressure of gas (e.g., air) within the second enclosure 1228 remains at least generally constant. In other embodiments, the actuator 1201 can be configured to be controlled by changing the pressure of gas within the second enclosure 1228 while the pressure of gas within the first enclosure 1226 remains at least generally constant, by changing the pressures of gases within both the first and second enclosures 1226, 1228, or by another suitable procedure. Furthermore, one or both of the first and second enclosures 1226, 1228 can be replaced with non-pneumatic mechanisms. For example, the first enclosure 1226 can be replaced with a hydraulic mechanism and/or the second enclosure 1228 can be replaced with a hydraulic mechanism or a mechanical spring, as discussed in greater detail below.

The piston 1204 can be configured to move back and forth within the actuator housing 1202 from a first end position 1255*a* to a second end position 1255*b* and through a range of travel 1255 (indicated by a horizontal line in FIGS. 12A-12C) between the first and second end positions 1255*a*, 1255*b*. FIGS. 12A, 12B, and 12C illustrate the piston 1204 at the first end position 1255*a*, a given intermediate position 1255*x* within the range of travel 1255, and the second end position 1255*b*, respectively. A change in an equilibrium between a first pneumatic force (PF1) acting against the piston 1204 from gas within the first enclosure 1226 and a second pneumatic force (PF2) acting against the piston 1204 from gas within the second enclosure 1228 can cause the piston 1204 to move in a first direction 1256 or a second direction 1258 at least generally opposite to the first direction 1256. For example, the first and second pneumatic forces (PF1, PF2) can at least partially counteract one another such that increasing the first pneumatic force (PF1) relative to the second pneumatic force (PF2) tends to move the piston 1204 in the first direction 1256 toward the second end position 1255*b* (FIG. 12C), and decreasing the first pneumatic force (PF1) relative to the second pneumatic force (PF2) tends to move the piston 1204 in the second direction 1258 toward the first end position 1255*a* (FIG. 12A).

The actuator 1201 can be configured to change the spacing between the seat 900, or another suitable seat configured in accordance with an embodiment of the present technology, and an elongate pin 1260 of the control valve 1200. For example, the actuator 1201 can be configured to change the spacing between a minimum spacing 1261*a* and a maximum spacing 1261*b* and through a range of spacing 1261 (indicated by a horizontal line in FIGS. 12A-12C) between the minimum and maximum spacings 1261*a*, 1261*b*. In some embodiments, at the minimum spacing 1261*a*, the pin 1260 is at a shutoff position (e.g., at which the piston 1204 is at the first end position 1255*a* illustrated in FIG. 12A) and in contact with the seat 900. The actuator 1201 can be configured to move the pin 1260 relative to the seat 900 in the first direction 1256 from the shutoff position toward a throttling position (e.g., at which the piston 1204 is at the given intermediate position 1255*x* illustrated in FIG. 12B) and in the second direction 1258 from the throttling position toward the shutoff position. Furthermore, the actuator 1201 can be configured to move the pin 1260 relative to the seat 900 in the first direction 1256 from the throttling position toward a fully-open position (e.g., at which the piston 1204 is at the second end position 1255*b* illustrated in FIG. 12C) and in the second direction 1258 from the fully-open position toward the throttling position. In other embodiments, at the minimum spacing 1261*a*, the pin 1260 can be spaced apart from the seat 900 and the actuator 1201 can be configured to change the spacing without causing the pin 1260 to contact the seat 900.

With reference to FIGS. 12A-12C, when the pin 1260 is in contact with the seat 900 at the minimum spacing 1261*a*, the seat 900 can exert a seat contact force (CFs) (FIG. 12A) against the piston 1204 in the first direction 1256 via the pin 1260. Similarly, at the maximum spacing 1261*b*, the actuator housing 1202 can exert a housing contact force (CFh) (FIG. 12C) against the piston 1204 in the second direction 1258. For example, the actuator housing 1202 can include a stopper 1262 (e.g., a single annular spacer or two or more spaced-apart pillars) configured to contact the piston 1204 at the maximum spacing 1261*b*. Unlike force from a stepper motor or another type of positive-displacement mechanism, the second pneumatic force (PF2) from gas within the second enclosure 1228 can remain at least generally constant when the pin 1260 moves into contact with the seat 900 and/or while the piston 1204 moves within the range of travel 1255. Thus, at the minimum spacing 1261*a* between the seat 900 and the pin 1260, the actuator 1201 can be configured to repeatably exert an at least generally consistent force against the seat 900 via the pin 1260, thereby causing the corresponding seat contact force (CFs) to also be at least generally consistent. In this way, the actuator 1201 can reliably apply the seat contact force (CFs) to the seat 900 at a level sufficient to at least generally prevent flow of fluid though the control valve 1200, but still low enough to reduce or eliminate excessive wear on the seat 900 and/or the pin 1260 and/or jamming of the pin 1260.

In some embodiments, the actuator 1201 includes a non-pneumatic mechanism in place of or in addition to the second enclosure 1228. For example, the actuator 1201 can include a hydraulic mechanism configured to exert a consistent or variable hydraulic force or a mechanical spring configured to exert a consistent or variable spring force against the piston 1204 in the second direction 1258 in place of or in addition to the second pneumatic force (PF2). Like pneumatic force, hydraulic and spring forces can remain at least generally constant when corresponding displacement is abruptly obstructed (e.g., when the pin 1260 contacts the seat 900). As discussed above, however, pneumatic actuating mechanisms typically operate more rapidly than hydraulic actuating mechanisms and can have other advantages when used in waterjet systems. Relative to pneumatic force, spring force from a mechanical spring can be more difficult to adjust and can complicate design or operation of the actuator 1201 by changing relative to displacement of the piston 1204.

The plunger 1208 can include an adjustment bushing 1264 and a plug 1266 operably positioned within the adjustment bushing 1264. A position of a contact interface 1267 between the plunger 1208 and the pin 1260 can be adjustable relative to a position of the piston 1204 along an adjustment axis (not shown) parallel to the first and second directions 1256, 1258. For example, the plug 1266 can have a convex end portion 1268 that abuts a complementary concave end portion 1269 of the pin 1260 at the contact interface 1267. The position of the plug 1266 can be adjustable relative to the adjustment bushing 1264 along the adjustment axis. The adjustment bushing 1264 and the plug 1266 can include complementary second threads 1270, and the plug 1266 can be rotatable relative to the adjustment bushing 1264 to adjust the position of the contact interface 1267. The plug 1266 can include a socket 1272 (e.g., a hexagonal socket) shaped to receive a wrench or other suitable tool to facilitate this adjustment. Adjusting the position of the contact interface 1267 can be useful, for example, to at least partially compensate for manufacturing irregularities in the pin 1260 or to otherwise facilitate calibration of the control valve 1200 after initial installation or replacement of the pin 1260 and/or the seat 900. In at least some cases, controlling the position of the contact interface 1267 along the adjustment axis using the second threads 1270 can be more precise than a manufacturing tolerance of the length of the pin 1260. In a particular embodiment, the diameter of the plug 1266 is 0.25 inch. The density of the second threads 1270 along the adjustment axis can be, for example, greater than 20 threads-per-inch (e.g., from 20 threads-per-inch to 200 threads-per-inch), greater than 40 threads-per-inch (e.g., from 40 threads-per-inch to 200 threads-per-inch), greater than 60 threads-per-inch (e.g., from 60 threads-per-inch to 200 threads-per-inch), greater than another suitable threshold, or within another suitable range. For example, the density of the second threads 1270 along the adjustment axis can be 80 threads-per-inch.

The spring assembly 1207 can include a resilient member 1274 configured to exert a spring force (SF) that at least partially counteracts the second pneumatic force (PF2). For example, the resilient member 1274 can be configured to exert the spring force (SF) against the piston 1204 when the piston 1204 is within a first portion 1255*c* (to the left of a dashed vertical line intersecting the range of travel 1255 in FIGS. 12A-12C) of the range of travel 1255 and not to exert the spring force (SF) against the piston 1204 when the piston 1204 is within a second portion 1255*d* (to the right of the dashed vertical line intersecting the range of travel 1255 in FIGS. 12A-12C) of the range of travel 1255. The first portion 1255*c* can be closer to the first end position 1255*a* than the second portion 1255*d* and shorter than the second portion 1255*d*. In some at least some embodiments, the spring force (SF) can be within a range from 100 pounds to 450 pounds, from 150 pounds to 400 pounds, or within another suitable range of forces when the piston 1204 is at the first end position 1255*a*. When the control valve 1200 is deployed within a waterjet system, a hydraulic force (HF) from fluid within or otherwise at the control valve 1200 (e.g., within the spacing between the seat 900 and the pin 1260) can act against the piston 1204 in the first direction 1256. Force acting against the piston 1204 in the first direction 1256 can tend to increase the spacing between the seat 900 and the pin 1260 and thereby open the control valve 1200, while force acting against the piston 1204 in the second direction 1258 can tend to decrease the spacing and thereby close the control valve 1200. As discussed above, counteracting the hydraulic force (HF) with a pneumatic force can be useful to cause the seat contact force (CFs) to be at least generally consistent.

Although useful to cause the seat contact force (CFs) to be at least generally consistent, counteracting the hydraulic force (HF) with a pneumatic force can also be problematic with respect to maintaining a consistent spacing between the seat 900 and the pin 1260. For example, in waterjet applications, after a particular intermediate spacing (e.g., corresponding to a desired pressure of fluid downstream from the seat 900) is achieved, it is typically desirable to at least generally maintain the spacing for a period of time during a cutting operation. The spacing and/or the hydraulic force (HF), however, typically fluctuate to some degree during this time due to vibration (e.g., associated with operation of a pump upstream from the control valve 1200) and/or other factors. Depending on the relationship between the hydraulic force (HF) and the spacing, this fluctuation can tend to destabilize the spacing when the hydraulic force (HF) is counteracted with pneumatic force. The actuator 1201 can be configured to use the resilient member 1274 to partially or completely overcome this problem.

In some embodiments, the resilient member 1274 is operably positioned within the first enclosure 1226 (e.g., the resilient member 1274 can be a compression spring operably positioned within the first enclosure 1226). In other embodiments, the resilient member 1274 can have another suitable location. For example, the resilient member 1274 can be operably positioned within the second enclosure 1228 (e.g., the resilient member 1274 can be an expansion spring operably positioned within the second enclosure 1228). The resilient member 1274 can also have a variety of suitable forms. With reference to FIGS. 12A-12C, the resilient member 1274 can include one or more Belleville springs. One example of a suitable Belleville spring is part CDM-501815 available from Century Spring Corp. (Los Angeles, Calif.). In some embodiments, the spring assembly 1207 includes a first Belleville spring 1274*a* and a second Belleville spring 1274*b* stacked in series. In other embodiments, the spring assembly 1207 can include one Belleville spring, more than two Belleville springs, or two or more Belleville springs having a different arrangement (e.g., arranged at least partially in parallel). The spring assembly 1207 can further include a cup washer 1276 and a flat washer 1278, with the cup washer 1276 contacting one side of the resilient member 1274 facing toward the plunger guide 1206 and the flat washer 1278 contacting an opposite side of the resilient member 1274. A portion of the cup washer 1276 facing toward the piston 1204 can extend into the annular groove 1220 when the piston 1204 is at the first end position 1255*a*.

Belleville springs can be well suited for use in the actuator 1201 due to their relatively compact size, their desirable spring characteristics, and/or due to other factors. In some at least some embodiments, the first and second Belleville springs 1274*a*, 1274*b* individually can have a maximum deflection within a range from 0.01 inch to 0.05 inch, from 0.02 inch to 0.04 inch, or within another suitable range. In a particular embodiment, the first and second Belleville springs 1274*a*, 1274*b* individually have a maximum deflection of 0.03 inch. Instead of or in addition to Belleville springs, other embodiments can include other suitable types of mechanical springs (e.g., coil springs and machined springs, among others). For example, the first and second Belleville springs 1274*a*, 1274*b* can be replaced with one or more rings of coil springs partially inset within the plunger guide 1206. Furthermore, the first and second Belleville springs 1274*a*, 1274*b* and/or other suitable resilient members can be secured to a side of the piston 1204 facing toward the plunger guide 1206 rather than to a side of the plunger guide 1206 facing toward the piston 1204.

Figure 13A:
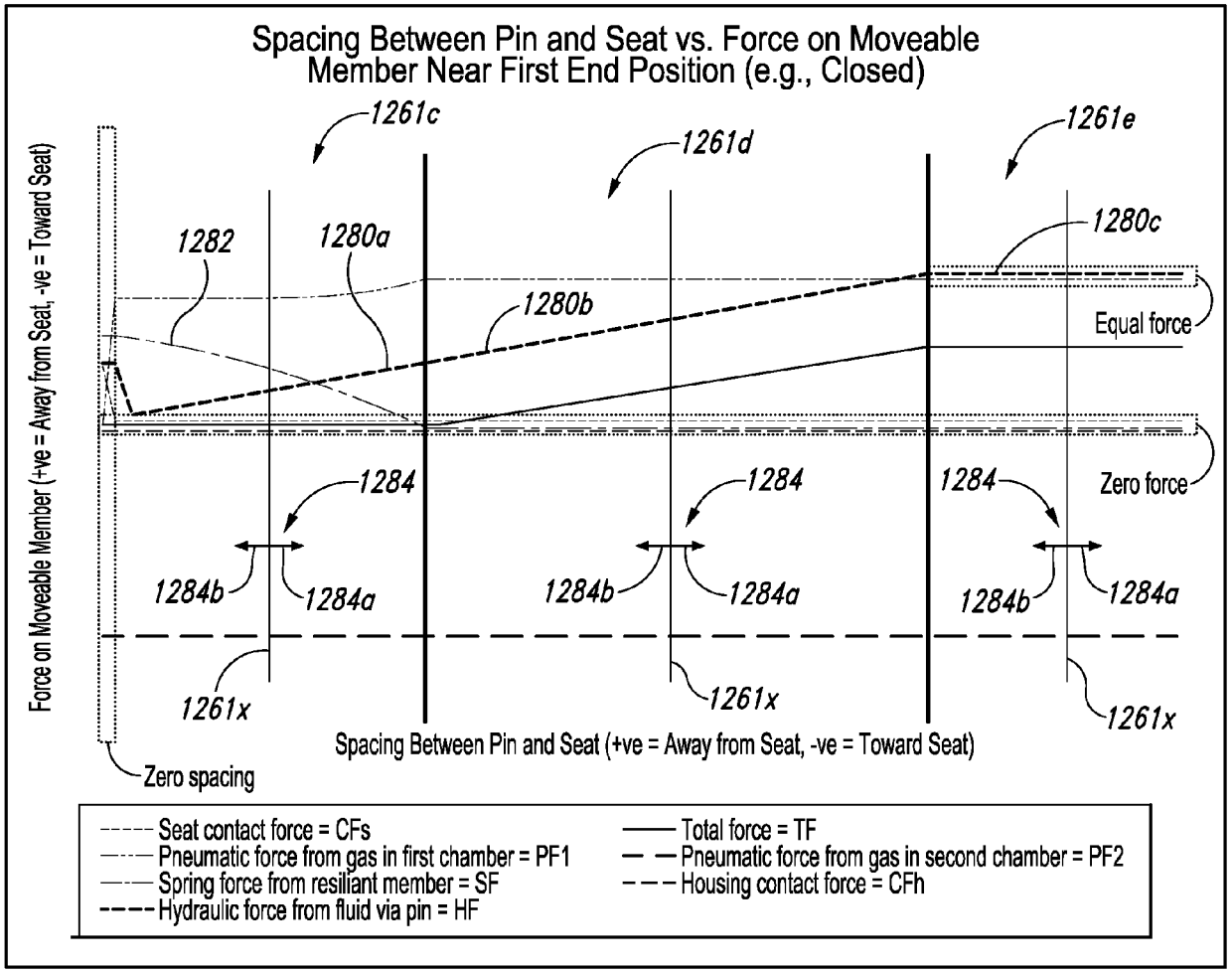
FIGS. 13A and 13B are plots of spacing between a pin and a seat of the control valve shown in FIGS. 12A-12C (x-axis) versus force on the piston (y-axis) when the piston is near the first end position and the second end position, respectively.
Figure 13B:
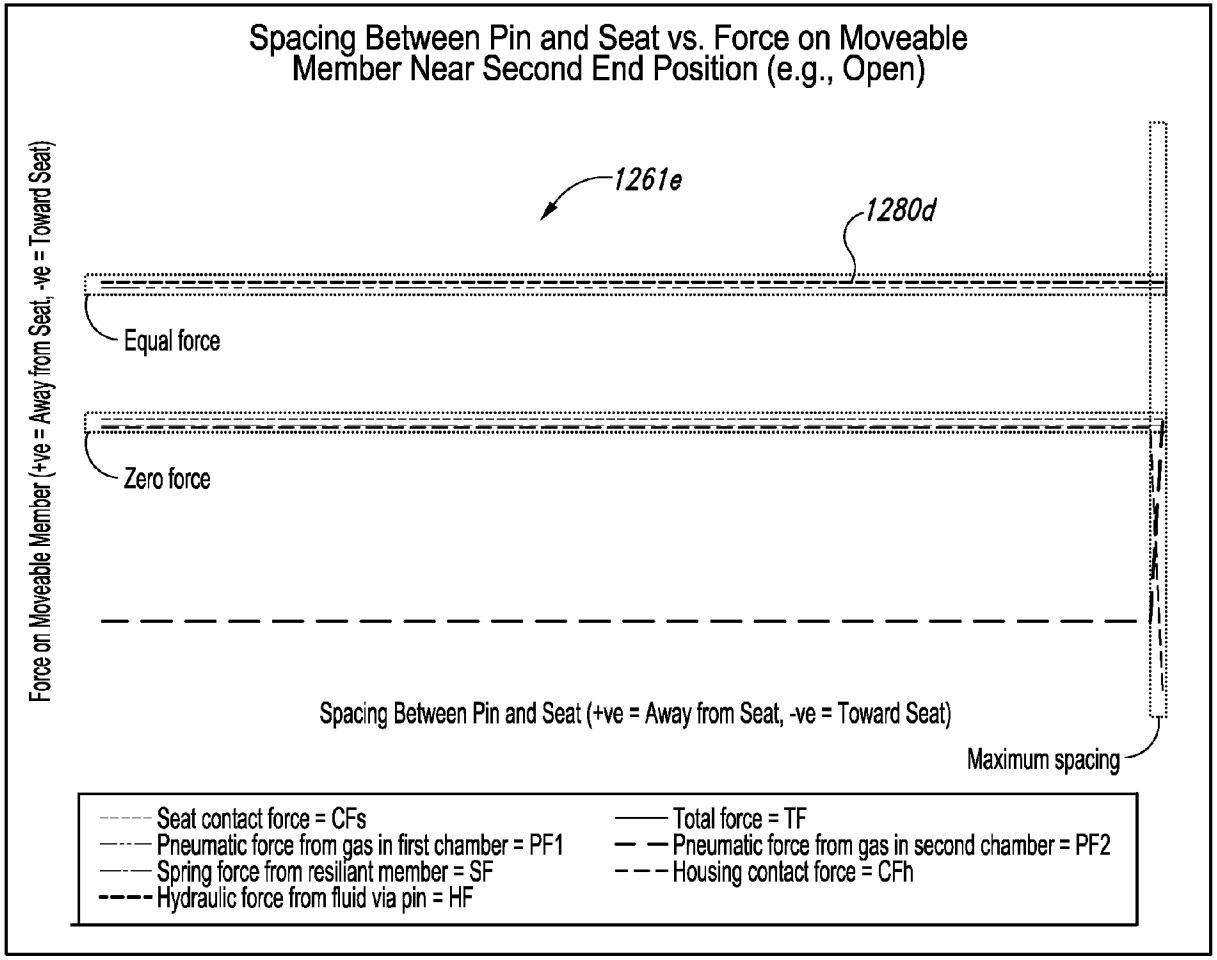

FIGS. 13A and 13B are plots of spacing between the pin 1260 and the seat 900 (x-axis) versus force on the piston 1204 (y-axis). More specifically, FIG. 13A illustrates the relationships between these variables when the piston 1204 is near the first end position 1255*a* (FIG. 12A) and FIG. 13B illustrates the relationships between these variables when the piston 1204 is near the second end position 1255*b* (FIG. 12C). In FIGS. 13A and 13B, positive force values tend to increase the spacing between the pin 1260 and the seat 900, and negative force values tend to decrease the spacing between the pin 1260 and the seat 900. The x-axis at zero force on the piston 1204 is enlarged in FIGS. 13A and 13B to facilitate illustration (e.g., to avoid depicting overlapping lines). Similarly, the y-axis at the minimum spacing 1261*a* in FIG. 13A and the y-axis at the maximum spacing 1261*b* in FIG. 13B are enlarged to facilitate illustration (e.g., to better illustrate sudden changes in the forces at these spacings). In should be understood that FIGS. 13A and 13B reflect expected relationships between various forces on the piston 1204 during one example of operation of the control valve 1200 within a waterjet system. These forces (including their relationships) can change depending on the configuration of the control valve 1200, the operation of the waterjet system, and other factors.

At a first portion 1261*c* (FIG. 13A), a second portion 1261*d* (FIG. 13A), and a third portion 1261*e* (FIGS. 13A and 13B) of the range of spacing 1261 successively positioned further from the minimum spacing 1261*a*, the hydraulic force (HF) can vary along a first hydraulic force gradient 1280*a*, a second hydraulic force gradient 1280*b*, and a third hydraulic force gradient 1280*c*, respectively. At the first portion 1261*c*, the spring force (SF) can vary along a spring force gradient 1282. In at least some cases, increasing the spacing increases the hydraulic force (HF) and decreasing the spacing decreases the hydraulic force (HF) along the first and second hydraulic force gradients 1280*a*, 1280*b*, while changing the spacing has little or no effect on the hydraulic force (HF) along the third hydraulic force gradient 1280*c*. The spring force (SF) can decrease as the piston 1204 moves in the first direction 1256 and increase as the piston 1204 moves in the second direction 1258 along the spring force gradient 1282.

At given intermediate spacings 1261*x* (indicated by vertical lines in FIG. 13A) within the first, second, and third portions 1261*c*-1261*e* individually, spontaneous fluctuations 1284 (indicated by horizontal lines in FIG. 13A) in the spacing can occur. The fluctuations 1284 can be relatively small (e.g., less than 0.001 inch) and can be positive fluctuations 1284*a* (i.e., increases in the spacing) or negative fluctuations 1284*b* (i.e., decreases in the spacing), both of which are indicated by arrows in FIG. 13A. In at least some cases, fluctuations 1284 within the first and second portions 1261*c*, 1261*d* may tend to be destabilizing. For example, a fluctuation 1284 within the first or second portions 1261*c*, 1261*d* can trigger a change in the hydraulic force (HF) that tends to reinforce the fluctuation 1284, thereby causing the piston 1204 to accelerate in the first or second direction 1256, 1258 as well as causing a corresponding uncontrolled increase or decrease in the spacing. Within the first and second portions 1261*c*, 1261*d*, positive fluctuations 1284*a* can be reinforced by corresponding increases in the hydraulic force (HF) and negative fluctuations 1284*b* can be reinforced by corresponding decreases in the hydraulic force (HF). In many waterjet and other applications, sustained operation at spacings within at least the first portion 1261*c* can be desirable (e.g., to achieve certain pressures downstream from the seat 900).

The resilient member 1274 discussed above with reference to FIGS. 12A-12C can be configured to increase the stability of the spacing between the pin 1260 and the seat 900 by at least partially counteracting changes in the hydraulic force (HF). For example, within the first portion 1261*c*, the spring force gradient 1282 can at least partially reverse the destabilizing effect of the first hydraulic force gradient 1280*a*. At the given intermediate spacing 1261*x* within the first portion 1261*c*, a positive fluctuation 1284*a* can cause a decrease in the spring force (SF) (e.g., by decreasing compression of the resilient member 1274) equal to or greater in magnitude than a corresponding increase in the hydraulic force (HF), and a negative fluctuation 1284*b* can cause an increase in the spring force (SF) (e.g., by increasing compression of the resilient member 1274) equal to or greater in magnitude than a corresponding decrease in the hydraulic force (HF). By incorporating the resilient member 1274, therefore, the control valve 1200 can be capable of stable operation at spacings within the first portion 1261*c*. Within the second portion 1261*d*, the spring force (SF) can be zero (e.g., due to the resilient member 1274 being disengaged from the piston 1204). Accordingly, stable operation of the control valve 1200 at spacings within the second portion 1261*d* may be difficult or impossible. The division between the first and second portions 1261*c*, 1261*d* can depend on the configuration of the actuator 1201. For example, the division between the first and second portions 1255*c*, 1255*d* of the range of travel 1255 can be modified (e.g., by shrinking, enlarging, and/or changing the location of the resilient member 1274) to modify the division between the first and second portions 1261*c*, 1261*d* of the range of spacing 1261.

At the leftmost portion of the plot in FIG. 13A, the pin 1260 can be in contact with the seat 900. At this state, the hydraulic force (HF) can be positive (e.g., due to fluid within the second chamber 150 reaching pressure equilibrium with fluid upstream from the seat 900 and exerting force on an exposed annular portion of the pin 1260 within the second chamber 150) and the first pneumatic force (PF1) can be zero. The negative second pneumatic force (PF2) can be equally counteracted by the sum of the positive spring force (SF), the positive hydraulic force (HF), and the positive seat contact force (CFs) such that the total force (TF) is zero and the piston 1204 is stationary. The second pneumatic force (PF2) can have a magnitude in the second direction 1258 greater than a sum of the magnitudes of the hydraulic force (HF), the spring force (SF), and the first pneumatic force (PF1) in the first direction 1256 at the minimum spacing 1261*a* by a margin sufficient to cause a seat contact force (CFs) that at least generally prevents fluid from flowing through the control valve 1200.

Achieving a second pneumatic force (PF2) of sufficient magnitude to at least generally prevent fluid from flowing through the control valve 1200 can be challenging. For example, when standard pneumatic pressures are used (e.g., 90 psi) within the second enclosure 1228, it can be difficult to achieve a second pneumatic force (PF2) of sufficient magnitude without making the actuator 1201 unduly large. The actuator 1201 can be operably connected to a cutting head (not shown) within a movable waterjet assembly. In at least some cases, decreasing the size of the actuator 1201 can enhance the maneuverability of the waterjet assembly relative to a workpiece (also not shown), a robotic arm (also not shown), and/or other objects coupled to or otherwise proximate to the waterjet assembly. For example, when the cutting head is tiltable, decreasing the size of the actuator 1201 can increase the tiltable range of the cutting head. Furthermore, using pressures greater than standard pneumatic pressures can significantly increase the cost and complexity of the actuator 1201. The resilient member 1274 can have one or more properties that reduce or eliminate this problem. For example, the resilient member 1274 can have an at least generally linear spring characteristic rather than a progressive spring characteristic (i.e., the rate of increase in the spring force (SF) can be at least generally constant within the first portion 1255*c* of the range of travel 1255 rather than increasing as the piston 1204 approaches the first end position 1255*a*). Alternatively, the resilient member 1274 can have a degressive spring characteristic (i.e., the rate of increase in the spring force (SF) can decrease within the first portion 1255*c* as the piston 1204 approaches the first end position 1255*a*). Belleville springs, for example, often have degressive spring characteristics.

With reference to FIG. 13A, beginning at the minimum spacing 1261*a*, the first pneumatic force (PF1) can be increased from a first level to a second level to cause the spacing to change from the minimum spacing 1261*a* to a suitable initial spacing greater than the minimum spacing 1261*a*. For example, a pneumatic input to the actuator 1201 can be increased via the first pneumatic port 1252 from a first pressure to a second pressure. With the second pneumatic force (PF2) remaining constant, the first pressure can be selected to cause the seat contact force (CFs) described above that at least generally prevents fluid from flowing through the control valve 1200. For example, the first pressure can be atmospheric pressure or another suitable pressure (e.g., a pressure less than 20 psi) that causes the first pneumatic force (PF1) to be zero or sufficiently low to achieve the desired seat contact force (CFs). The second pressure can be selected to cause a particular initial steady-state pressure of fluid downstream from the seat 900. For example, the first pneumatic force (PF1) can be increased to a value greater than the value of the seat contact force (CFs) such that the total force (TF) becomes positive, the piston 1204 moves in the first direction 1256, and the spacing between the pin 1260 and the seat 900 increases. Almost immediately after the spacing begins to increase, fluid within the second chamber 150 can flow downstream causing the hydraulic force (HF) to drop (e.g., to zero). Subsequently, as the spacing increases and the flow rate of fluid moving between the pin 1260 and the tapered inner surface 144 increases, the pressure of fluid within the second chamber 150 can increase, thereby causing the hydraulic force (HF) to increase.

In some embodiments, the first pneumatic force (PF1) is initially stepped-up (e.g., by rapidly increasing the pneumatic input to the actuator 1201 to the second pressure) such that the total force (TF) becomes positive and the piston 1204 accelerates in the first direction 1256 until the spacing stabilizes at a suitable level corresponding to a selected initial steady-state pressure of fluid downstream from the seat 900. In other embodiments, the pneumatic input to the actuator 1201 can be increased from the first pressure to the second pressure at a rate of change selected to cause a gradual increase in the pressure of fluid downstream from the seat 900 toward the initial steady-state pressure. The achievable initial steady-state pressure can be infinitely or nearly infinitely variable. Furthermore, the pneumatic input to the actuator 1201 can be changed at a rate selected to cause a suitable rate of ramp-up or ramp-down to or from the initial steady-state pressure. Furthermore, the pneumatic input to the actuator 1201 can be continuously ramped up and/or down in a stable manner without ever achieving a steady-state pressure of fluid downstream from the seat 900.

When the first pneumatic force (PF1) is increased to a level sufficient to cause the spacing to enter the second portion 1261*d*, the piston 1204 can be released from the spring force (SF), which can cause the total force (TF) to become positive, and the piston 1204 to accelerate in the first direction 1256 while the spacing increases through the second portion 1261*d* and approaches the third portion 1261*e*. Although stable operation within the third portion 1261*e* may be possible, in some cases, variation of the spacing within the third portion 1261*e* may have little or no meaningful effect on the pressure of fluid downstream from the seat 900. Thus, the positive total force (TF) acting against the piston 1204 in the first direction 1256 can be maintained when the spacing reaches the third portion 1261*e* so as to cause the piston 1204 to continue accelerating in the first direction 1256 while the spacing increases toward the maximum spacing 1261*b*. To cause the spacing to move toward the maximum spacing 1261*b* more rapidly, the magnitude of the second pneumatic force (PF2) in the second direction 1258 can be decreased (e.g., to zero) while the first pneumatic force (PF1) is maintained or increased. This can increase the total force (TF) in the first direction 1256 and thereby increase the acceleration of the piston 1204 in the first direction 1256. For example, rather than increasing the pressure of gas within the first enclosure 1226 to increase the first pneumatic force (PF1) in the first direction 1256, the pressure of gas within the second enclosure 1228 can be decreased (e.g., to atmospheric pressure) to decrease the magnitude of the second pneumatic force (PF2) in the second direction 1258.

In some cases, the second pneumatic force (PF2) is maintained when the piston 1204 is at the second end position 1255*b* and the magnitude of the housing contact force (CFh) in the second direction 1258 is equal the positive difference between the magnitude of the second pneumatic force (PF2) in the second direction 1258 and the sum of the first pneumatic force (PF1) and the hydraulic force (HF). In other cases, the second pneumatic force (PF2) can be zero when the piston 1204 is at the second end position 1255*b* and the magnitude of the housing contact force (CFh) in the second direction 1258 can be equal to the sum of the first pneumatic force (PF1) and the hydraulic force (HF). In still other cases, the first pneumatic force (PF1) can be decreased to zero after decreasing the magnitude of the second pneumatic force (PF2) in the second direction 1258 such that the magnitude of the housing contact force (CFh) in the second direction 1258 is equal to the hydraulic force (HF) only.

Although FIGS. 13A and 13B are described above primarily in the context of increasing the spacing from the minimum spacing 1261*a*, the concepts can also be applicable to decreasing the spacing from the maximum spacing 1261*b* as well as to other changes within the range of spacing 1261. When decreasing the spacing, the first and second hydraulic force gradients 1280*a*, 1280*b* can be less steep than when increasing the spacing (e.g., due to a delay between moving the pin 1260 toward the seat 900 and the fluid within the second chamber 150 reaching pressure equilibrium with fluid upstream from the seat 900). Thus, the counteracting effect of the spring force gradient 1282 may be greater when decreasing the spacing than when increasing the spacing. Control systems for use with the control valve 1200 (e.g., as discussed in further detail below) can be configured to account for this phenomenon.

Furthermore, although FIGS. 13A and 13B are described above primarily in the context of maintaining the second pneumatic force (PF2) (e.g., by maintaining the pressure of gas within the second enclosure 1228) and varying the first pneumatic force (PF1) (e.g., by varying the pressure of gas within the first enclosure 1226) to achieve intermediate spacings 1261*x*, other suitable manners of achieving intermediate spacings 1261*x* are also possible. For example, both the first and second pneumatic forces (PF1, PF2) can be varied to achieve intermediate spacings 1261*x*. Alternatively, the first pneumatic force (PF1) can be maintained (e.g., by maintaining the pressure of gas within the first enclosure 1226 at atmospheric pressure or another suitable level) while the second pneumatic force (PF2) is varied (e.g., by varying the pressure of gas within the second enclosure 1228) to achieve intermediate spacings 1261*x*. This can reduce or eliminate the need for the first pneumatic port 1252 and accompanying couplers, regulators, and pneumatic conduits (not shown), which can be unduly bulky. As discussed above, decreasing the size of the actuator 1201 can be advantageous (e.g., when the actuator 1201 is part of a movable waterjet assembly including a tiltable cutting head (not shown)).

When the actuator 1201 is configured to achieve intermediate spacings 1261*x* by varying the pressure of gas within the second enclosure 1228, the second pneumatic port 1254 can be connected to a high-precision and/or high-accuracy pneumatic regulator (as discussed in further detail below). To increase the spacing from the minimum spacing 1261*a* to a suitable intermediate spacing 1261*x*, the pressure of gas within the second enclosure 1228 can be decreased precisely (e.g., to a precise level and/or at a precise rate). To increase the spacing to the maximum spacing 1261*b*, the pressure of gas within the second enclosure 1228 can be rapidly decreased to atmospheric pressure (e.g., dumped). In at least some cases, when the actuator 1201 is configured to achieve intermediate spacings 1261*x* by varying the pressure of gas within the second enclosure 1228, the actuator 1201 does not achieve the maximum spacing 1261*b* as rapidly as when the actuator 1201 is configured to achieve intermediate spacings 1261*x* by varying the pressure of gas within the first enclosure 1226 (e.g., because the total force (TF) acting against the piston 1204 in the first direction 1256 is lower when the first pneumatic force (PF1) is lower). Thus, in these cases, it can be useful for the actuator 1201 to be configured to achieve intermediate spacings 1261*x* by varying the pressure of gas within the second enclosure 1228 when compactness is more important than opening speed, and for the actuator 1201 to be configured to achieve intermediate spacings 1261*x* by varying the pressure of gas within the first enclosure 1226 when opening speed is more important than compactness.

Figure 14A:
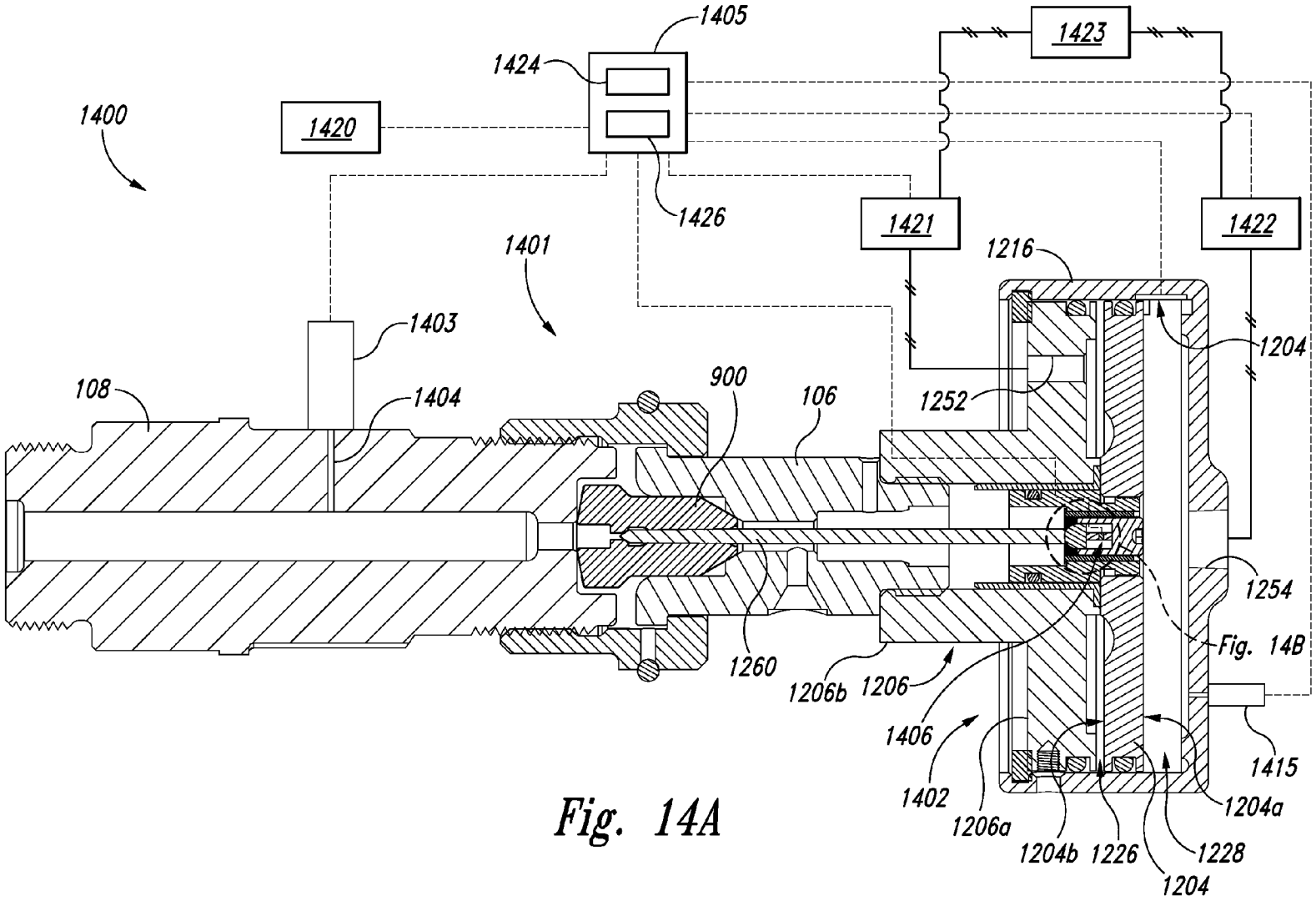
FIG. 14A is a partially schematic cross-sectional side view illustrating a portion of a waterjet system including a control valve as well as a controller configured to operate the control valve, and associated components configured in accordance with an embodiment of the present technology.
Figure 14B:
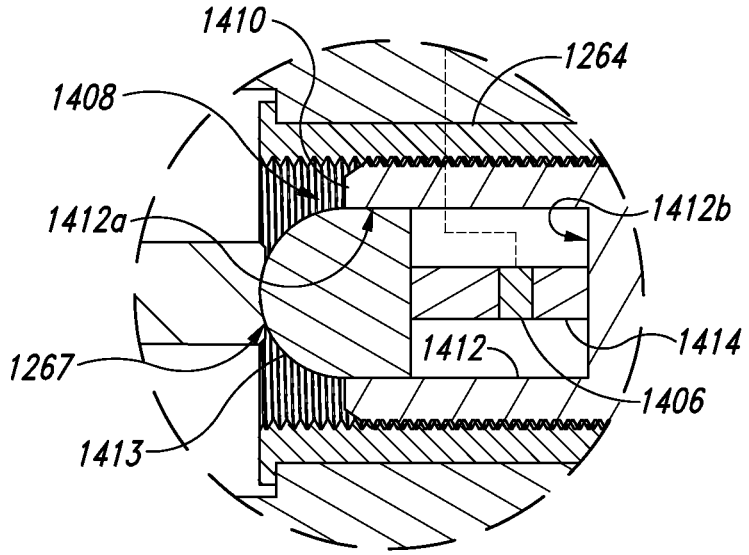
FIGS. 14B and 14C are enlarged views of portions of FIG. 14A.

In addition to or instead of incorporating resilient members to enhance stability of operation, actuators configured in accordance with at least some embodiments of the present technology can be stabilized electronically using suitable control algorithms. FIG. 14A is a partially schematic cross-sectional side view illustrating a portion of a waterjet system 1400 including a control valve 1401 having an actuator 1402 configured in accordance with an embodiment of the present technology. FIG. 14B is an enlarged view of a portion of FIG. 14A. The waterjet system 1400 can include the upstream and downstream housings 106, 108 discussed above with reference to FIGS. 1A-1E. The second portion 1206*b* of the plunger guide 1206 can be coupled to the upstream housing 106, and the waterjet system 1400 can further include a pressure sensor 1403 configured to detect a pressure of fluid downstream from the seat 900. In some embodiments, the pressure sensor 1403 includes a pressure transducer directly hydraulically connected to fluid downstream from the seat 900 via a lateral bore 1404 in the downstream housing 108. In other embodiments, the pressure sensor 1403 can include a pressure transducer mounted elsewhere and a conduit extending between the pressure transducer and the lateral bore 1404. This configuration can facilitate continuous or frequent measurement of the pressure of fluid downstream from the seat 900 during operation of the waterjet system 1400 with less potential for obstructing movement of the control valve 1401 relative to a workpiece (not shown) during use than the configuration shown in FIG. 14A. In still other embodiments, a coupling (not shown) (e.g., a tee-coupling) can be included in the waterjet system 1400 downstream from the seat 900 to facilitate connection of the pressure sensor 1403. This type of configuration is described, for example, below with reference to FIG. 28.

After stabilizing at an initial spacing between the seat 900 and the pin 1260 corresponding to an initial steady-state pressure of fluid downstream from the seat 900, the initial spacing can be maintained for a period (e.g., while a first portion of a waterjet cutting operation is performed). The spacing can then be changed to achieve another suitable steady-state pressure of fluid downstream from the seat 900, which can then be maintained for another period (e.g., while a second portion of a waterjet cutting operation is performed). Such variation can also be continuous rather than incremental. For example, the waterjet system 1400 can be configured to vary the spacing and the corresponding pressure of fluid downstream from the seat 900 continuously according to a suitable control algorithm. The waterjet system 1400 can include a controller 1405 (e.g., a proportional-integral-derivative controller) operably associated with the actuator 1402 and with the pressure sensor 1403. The controller 1405 can be configured to execute a feedback control loop that increases the positional stability of the pin 1260 while the spacing between the seat 900 and the pin 1260 is maintained or while the spacing is varied in a controlled manner. For example, the pressure sensor 1403 can be configured to detect a pressure of the fluid downstream from the seat 900 and to communicate the detected pressure to the controller 1405 as an input to the feedback control loop. The feedback control loop can cause the actuator 1402 to change a force exerted against the pin 1260 in response to the input. In this way, the force from the actuator 1402 can be automatically adjusted to compensate for destabilizing forces, such as the fluctuations 1284 described above with reference to FIG. 13A.

In addition to or instead of the pressure sensor 1403, the waterjet system 1400 can include one or more other types and/or placements of sensors configured to provide input to the feedback control loop. For example, with reference to FIGS. 14A and 14B together, the waterjet system 1400 can include a force sensor 1406 (e.g. a load cell) operably associated with the controller 1405. The force sensor 1406 can be configured to detect the hydraulic force (HF) and/or the seat contact force (CFs) described above with reference to FIG. 13A and to communicate one or both of these detected forces to the controller 1405 as the input to the feedback control loop. The force sensor 1406, for example, can include a button-style load cell within a plug 1408 operably positioned within the adjustment bushing 1264. The plug 1408 can include a body 1410 having a blind bore 1412 with a first end 1412*a* opening toward the contact interface 1267 and a second end 1412*b* at a solid surface within the plug 1408. The plug 1408 can further include a rounded head 1413 and a shaft 1414 extending between the rounded head 1413 and the solid surface at the second end 1412*b*. The force sensor 1406 can be operably positioned at an intermediate point along the length of the shaft 1414 such that force at the contact interface 1267 travels to the force sensor 1406 via the rounded head 1413 and a portion of the shaft 1414 positioned between the force sensor 1406 and a side of the rounded head 1413 opposite to a side at the contact interface 1267. Alternatively, the force sensor 1406 can be of another suitable type (e.g., hydraulic) and/or have another suitable position within the waterjet system 1400.

The waterjet system 1400 can further include a pressure sensor 1415. In the illustrated embodiment, the pressure sensor 1415 is operably connected to the actuator 1402 at the first side 1204*a* of the piston 1204. In other embodiments, the pressure sensor 1415 can be operably connected to the actuator 1402 at the second side 1204*b* of the piston 1204 or have another suitable position. The pressure sensor 1415 can be operably associated with the controller 1205. For example, the pressure sensor 1415 can be configured to detect a pneumatic pressure at the first side 1204*a* of the piston 1204 and to communicate the detected pneumatic pressure to the controller 1405 as the input to the feedback control loop.

Figure 14C:
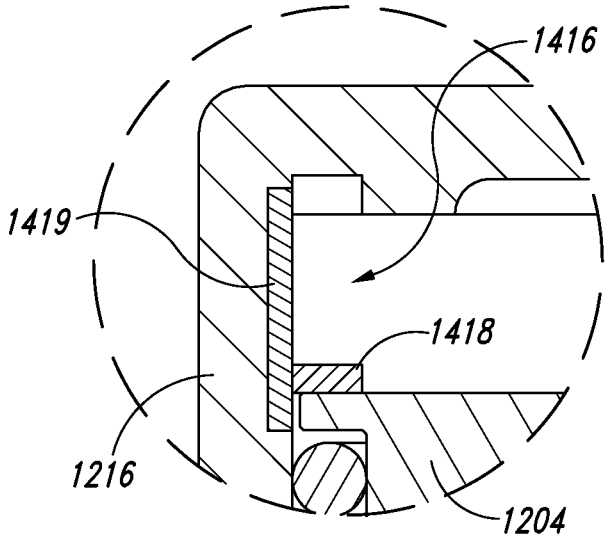

With reference to FIGS. 14A and 14C, the waterjet system 1400 can further include a position sensor 1416 operably associated with the controller 1205 and configured to detect a position of the pin 1260 or of a structure that moves in concert with the pin 1260 (e.g., the piston 1204) and to and to communicate the detected position to the controller 1405 as the input to the feedback control loop. The position sensor 1416 can include a first sensor element 1418 and a second sensor element 1419, with the first sensor element 1418 being movable relative to the second sensor element 1419. For example, the first sensor element 1418 can be fixedly connected to the edge of the piston 1204 and the second sensor element 1419 can be fixedly connected to the inner surface of the sidewall 1216. The position sensor 1416 can be configured to detect a position of the piston 1204 based on a position of the first sensor element 1418 relative to the second sensor element 1419. In some embodiments, one or both of the first and second sensor elements 1418, 1419 is magnetic and the position sensor 1416 is configured to detect the position of the first sensor element 1418 relative to the second sensor element 1419 by detecting a change in a magnetic field. In other embodiments, the position sensor 1416 can operate according to another suitable modality.

Although the pressure sensors 1403, 1415, the force sensor 1406, and the position sensor 1416 are all included in the embodiment shown in FIG. 14A, in other embodiments only one or some of these sensors may be present. Furthermore, the pressure sensors 1403, 1415, the force sensor 1406, and the position sensor 1416 individually can be alone or in combination with other sensors, such as sensors configured to detect parameters other than fluid pressure, pneumatic pressure, position, and force. In addition or alternatively, the controller 1405 can be configured to receive input for the feedback control loop from a user interface 1420 of the waterjet system 1400 and/or from a component of the waterjet system 1400 other than the control valve 1401. As discussed below, for example, the controller 1405 can be configured to receive an indication of an operational state of a component of the waterjet system 1400 other than the control valve 1401, such as an operational state of a fluid-pressurizing device (not shown) of the waterjet system 1400 as the input. Furthermore, in addition or instead of being used as input for the feedback control loop, information from any of the sensors and other sources described above can be used to convey information (e.g., in real time or near real time) to a user, such as via the user interface 1420, via one or more gauges (not shown), or in another suitable manner.

With reference again to FIG. 14A, the controller 1405 can be configured to change one or more pneumatic inputs to the actuator 1402 in response to the input to the feedback control loop. For example, the waterjet system 1400 can include a first pneumatic regulator 1421 and a second pneumatic regulator 1422 operably connected to the first and second pneumatic ports 1252, 1254, respectively. The waterjet system 1400 can further include a pneumatic source 1423 operably connected to the first and second pneumatic regulators 1421, 1422. The first pneumatic regulator 1421 and/or the second pneumatic regulator 1422 can be high-precision and/or high-accuracy pneumatic regulators. For example, the first pneumatic regulator 1421 and/or the second pneumatic regulator 1422 can be configured to precisely and accurately produce pressures of gas within the first enclosure 1226 and/or the second enclosure 1228, respectively, with variation or deviation less than 0.5 psi (e.g., within a range from 0.001 psi to 0.5 psi), less than 0.01 psi (e.g., within a range from 0.001 psi to 0.01 psi), less than another suitable threshold, or within another suitable range. In a particular embodiment, the first pneumatic regulator 1421 and/or the second pneumatic regulator 1422 includes a direct-acting poppet-style regulator, such as a Series ED02 Electro-Pneumatic Pressure Control Valve (e.g., Part Number R414002413) available from Bosch Rexroth AG (Charlotte, N.C.).

Controlling the actuator 1402 by controlling a pneumatic input at a side of the piston 1204 at which an exerted force tends to open the control valve 1401 can advantageously enhance the stability of the control valve during operation in at least some cases. For example, in some embodiments, the actuator 1402 is controlled primarily or entirely via the first pneumatic regulator 1421 and the second pneumatic regulator 1422 closes off the second enclosure 1228 such that gas is trapped at the first side 1204*a* of the piston 1204. The second pneumatic regulator 1422, for example, can be a relief valve configured to be either fully open or fully closed. Force at the first side 1204*a* of the piston 1204 may tend to close the control valve 1401 and force at the second side 1204*b* of the piston 1204 may tend to open the control valve 1401. The trapped gas at the first side 1204*a* of the piston 1204 can act as an air spring that delays or otherwise diminishes the effect of destabilizing forces, such as the fluctuations 1284 described above with reference to FIG. 13, on the position of the pin 1260. This can reduce the sampling frequency of the feedback control loop necessary to sufficiently stabilize operation of the control valve 1401. Furthermore, changes in the pressure of the trapped gas may directly correspond to changes in the force exerted against the pin 1260 by fluid within the control valve 1401. Thus, detecting this pressure (e.g., using the pressure sensor 1415) can be a useful way to provide input to the feedback control loop. In other embodiments, the actuator 1402 can be controlled primarily or entirely via the second pneumatic regulator 1422 and the first pneumatic regulator 1422 can close off the first enclosure 1226 such that gas is trapped at the second side 1204*b* of the piston 1204. In these embodiments, for example, the position of the pressure sensor 1415 can be operably connected to the actuator 1402 at the second side 1204*b* of the piston 1204.

As discussed above, the controller 1405 can be configured to control and/or monitor operation of the control valve 1401, such as to cause the control valve 1401 to execute instructions entered manually by a user at the user interface 1420 and/or to automatically stabilize operation of the control valve 1401. The controller 1405 can include a processor 1424 and memory 1426 and can be programmed with instructions (e.g., non-transitory instructions) that, when executed using the processor 1424, cause a desired change in operation of the system 1400. For example, the instructions can cause a change in a pneumatic input to the actuator 1402 based at least in part on input from the pressure sensor 1403, the force sensor 1406, the pressure sensor 1415, the position sensor 1416, and/or another suitable sensor of the system 1400. In addition to or instead of receiving input from one or more sensors associated with the control valve 1401, the controller 1405 can be configured to receive input from other components of the waterjet system 1400. For example, the controller 1405 can be operably associated with a fluid-pressurizing device (e.g., a pump) (not shown) that is configured to pressurize fluid upstream from the control valve 1401. One or more operating parameters of the fluid-pressurizing device (e.g., rpm, electrical load, and output flow rate, among others) can be communicated to the controller 1405 as input to the feedback control loop. In at least some cases, this input and the other types of input described above can be at least partially redundant. Thus, the waterjet system 1400 can be configured to utilize fewer (e.g., one, two or three) of the described types of input.

The control valve 1401 can be configured to default to a closed position so as not to open unexpectedly in the event of a pneumatic failure, sensor failure, or other disruption. For example, the first pneumatic regulator 1421 can default to a closed position and the second pneumatic regulator 1422 can default to an open position. When the controller 1405 uses measurement of an indirect variable (e.g., the pressure within the first or second enclosure 1226, 1228 of the actuator 1402) as input to the feedback control loop, the correlation between the indirect variable and the corresponding variable (e.g., the pressure of fluid within the control valve 1401) can be recalibrated regularly. Other precautions can also be taken to improve the reliability of the input. For example, when the pressure within the first or second enclosure 1226, 1228 of the actuator 1402 is used as the input, the first or second enclosure 1226, 1228, respectively, can be leak tested between calibrations.

The waterjet system 1400 can be configured to be calibrated before use instead of or in addition to utilizing feedback. For example, calibration can be used to ascertain a pressure of gas within the first enclosure 1226 that causes a desired pressure (e.g., 10,000 psi) of fluid downstream from the seat 900 when the pressure upstream from the control valve 1401 is at desired system pressure (e.g., 60,000 psi). After calibration, the first pneumatic regulator 1421 can be used to maintain the ascertained pressure of gas within the first enclosure 1226 so as to cause the desired pressure of fluid downstream from the seat 900 as needed. One example of a suitable calibration method includes first adjusting the output flow rate of the fluid-pressurizing device (e.g., according to a correlation by which the output flow rate is linearly proportional to the rpm of the fluid-pressurizing device) while the control valve 1401 is fully opened until the desired pressure of fluid downstream from the seat 900 is achieved. With the control valve 1401 fully opened, the pressure of fluid upstream from the control valve 1401 can be the same as the pressure of fluid downstream from the seat 900. Next, without changing the output flow rate of the fluid-pressurizing device, the pressure of gas within the first enclosure 1226 can be increased gradually using the first pneumatic regulator 1421 to close the control valve 1401 while the pressure of fluid upstream from the control valve 1401 is monitored. In at least some cases, when the pressure of fluid upstream from the control valve 1401 reaches the desired system pressure, the corresponding pressure of gas within the first enclosure 1226 may be the pressure that causes the desired pressure of fluid downstream from the seat 900 when the pressure of fluid upstream from the control valve 1401 is at the desired system pressure so long as the pressure of gas within the second enclosure 1228 is consistent during calibration and subsequent use. The pressure of gas within the second enclosure 1228 can be maintained at 85 psi, 90 psi, or at another suitable level. Calibrating the waterjet system 1400 in this manner can be useful, for example, to correct for variability in the erosion of the pin 1260 and the seat 900 and/or dimensional variability in replaced components, among other factors.

Figure 15A:
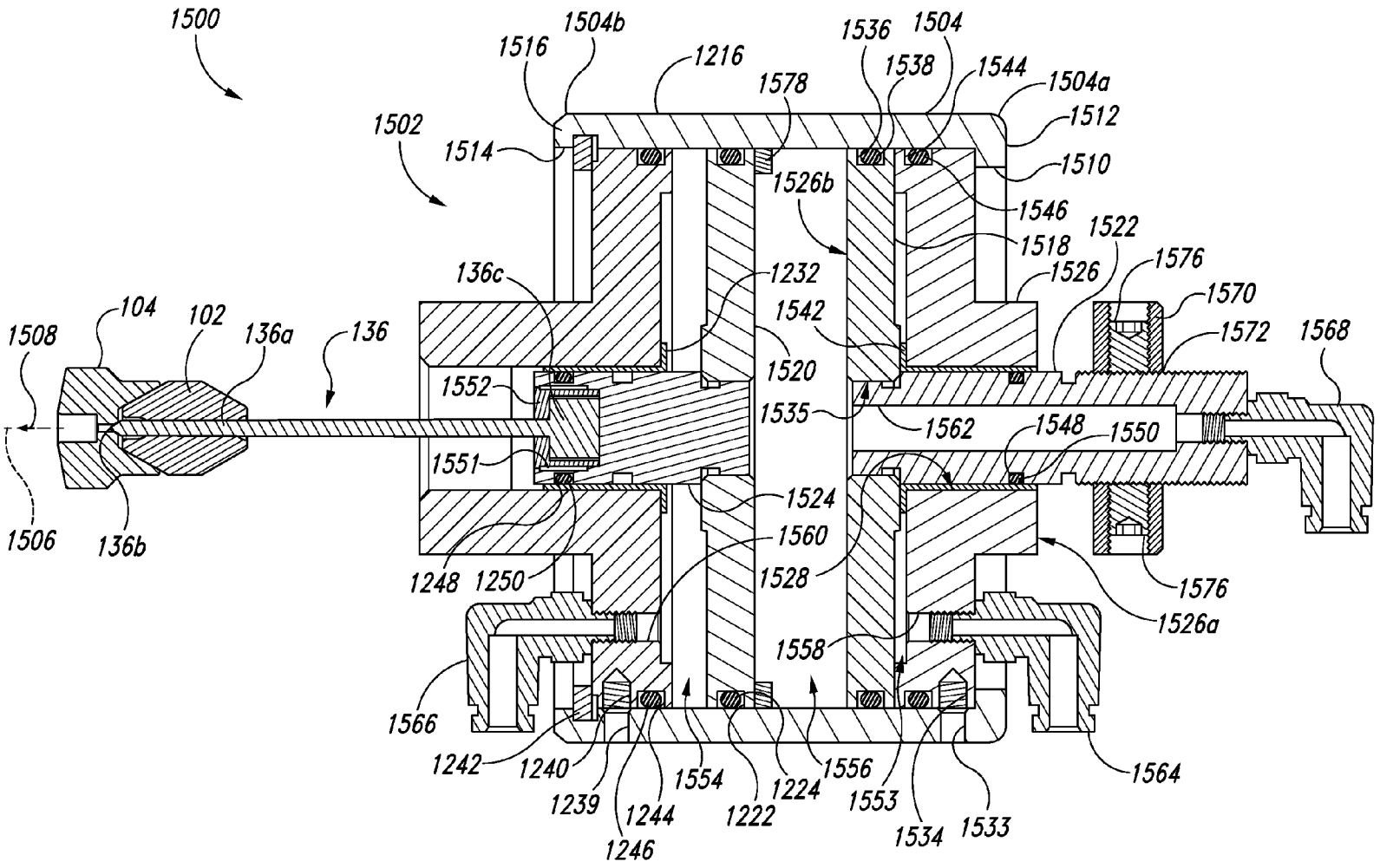
FIGS. 15A, 15B, and 15C are cross-sectional side views illustrating a portion of a control valve including an actuator and a pin, with the pin in a closed position, a throttling position, and an open position, respectively, configured in accordance with an embodiment of the present technology.
Figure 15B:
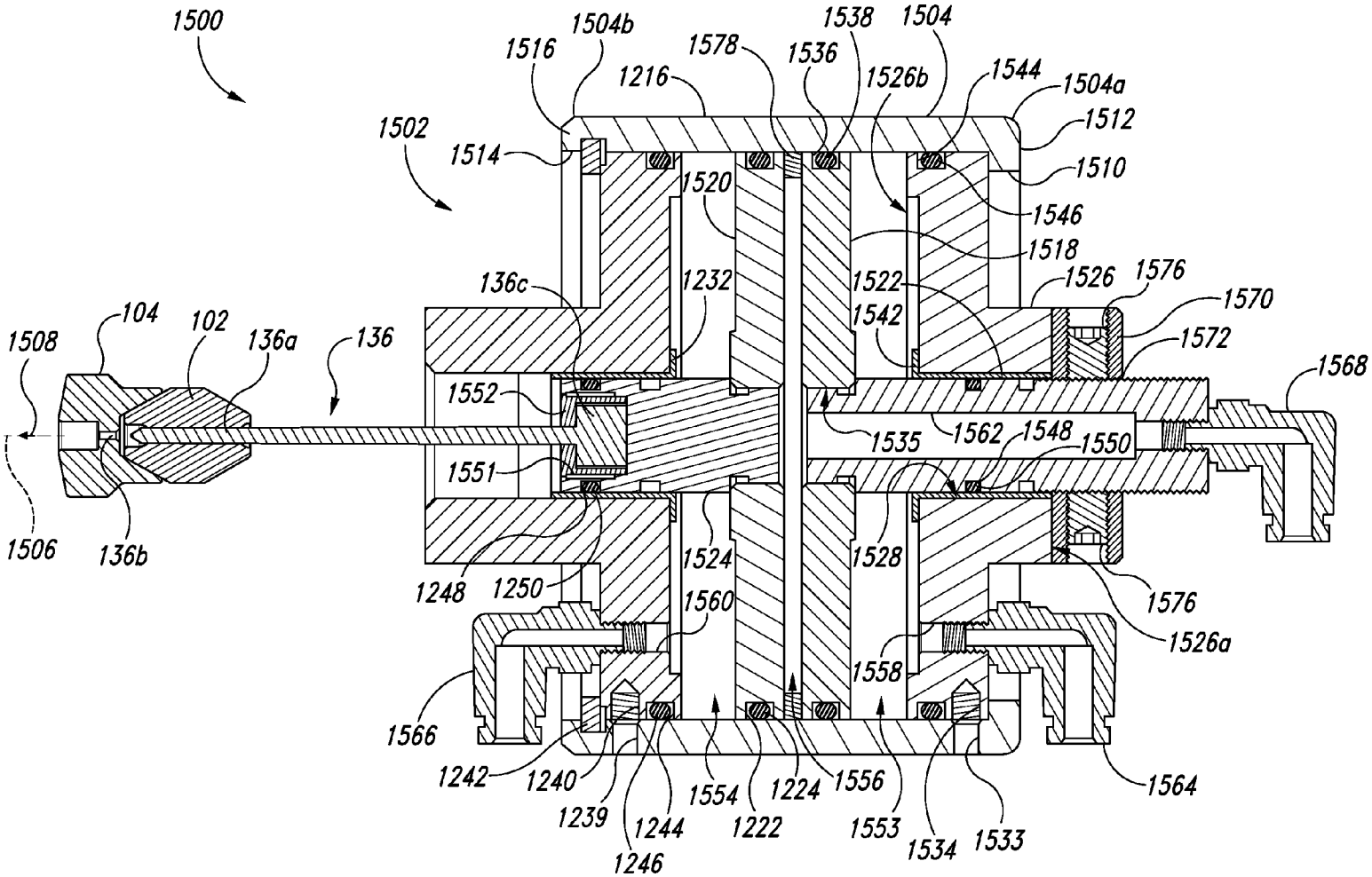
Figure 15C:
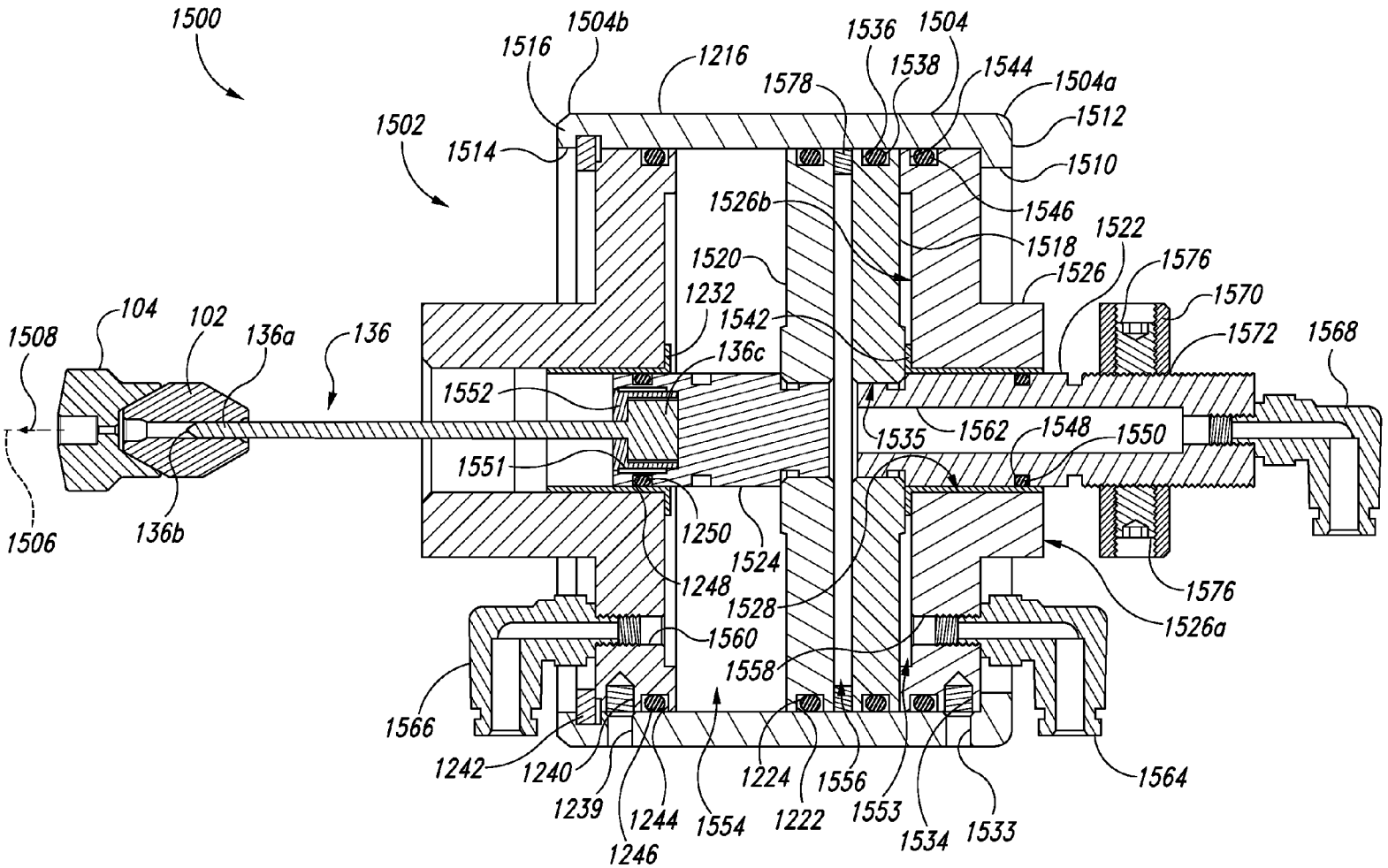

FIGS. 15A-15C are cross-sectional side views illustrating a portion of a control valve 1500 including an actuator 1502 configured in accordance with an embodiment of the present technology. The actuator 1502 can be configured to move the pin 136 relative to the first seat 102 and the second seat 104, with the pin 136 shown in a closed position, a throttling position, and an open position in FIGS. 15A, 15B and 15C, respectively. The actuator 1502 can include an actuator housing 1504 having a first end 1504*a* and a second end 1504*b* opposite to the first end 1504*a*. The actuator 1502 can be configured to exert force along an actuating axis 1506 (shown as a broken line in FIGS. 15A-15C) in an actuating direction 1508 (shown as an arrow in FIGS. 15A-15C). The first and second ends 1504*a*, 1504*b* can have different positions along the actuating axis 1506 such that the actuating direction 1508 extends from the first end 1504*a* toward the second end 1504*b*. The actuator housing 1504 can be at least generally cylindrical and can include a first major opening 1510 at the first end 1504*a*, a first lip 1512 around the first major opening 1510, a second major opening 1514 at the second end 1504*b*, and a second lip 1516 around the second major opening 1514.

The actuator 1502 can further include a first movable member, such as a first piston 1518, and a second movable member, such as a second piston 1520, both movably positioned within the actuator housing 1504. Furthermore, the actuator 1502 can include a first plunger 1522 coupled to the first piston 1518 and configured to move with the first piston 1518 in parallel with the actuating axis 1506, and a second plunger 1524 coupled to the second piston 1520 and configured to move with the second piston 1520 in parallel with the actuating axis 1506. For example, the actuator 1502 can include a first plunger guide 1526 having a first central channel 1528 configured to slidingly receive the first plunger 1522, and a second plunger guide 1530 having a second central channel 1532 configured to slidingly receive the second plunger 1524. The actuator 1502 can be assembled, for example, by inserting the first plunger guide 1526 into the actuator housing 1504 via the second major opening 1514, then inserting the first piston 1518 (e.g., with the first plunger 1522 secured to the first piston 1518) into the actuator housing 1504 via the second major opening 1514, then inserting the second piston 1520 (e.g., with the second plunger 1524 secured to the second piston 1520) into the actuator housing 1504 via the second major opening 1514, and then inserting the second plunger guide 1530 into the actuator housing 1504 via the second major opening 1514. Screws (not shown) (e.g., set screws) can be individually inserted through holes 1533 in the sidewall 1216 and into threaded recesses 1534 (one shown) distributed around the circumference of the first plunger guide 1526 to secure the first plunger guide 1526 in position within the actuator housing 1504.

The first piston 1518 can be cylindrical (e.g., disk-shaped) and can include a central bore 1535 and a fourth sealing member 1538 (e.g., an o-ring) inset within a fourth edge recess 1536. The fourth sealing member 1538 can be configured to slide along an inner surface of the sidewall 1216 to form a movable seal. The first plunger guide 1526 can be configured to slidingly receive a portion of the first plunger 1522 while another portion of the first plunger 1522 is secured to the first piston 1518 within the central bore 1535. In a particular embodiment, the first plunger 1522 is slidingly received within the bushing 1232 inserted into the first central channel 1528. The first plunger guide 1526 can include a fifth edge recess 1544 and a fifth sealing member 1546 (e.g., an o-ring) operably positioned within the fifth edge recess 1544. Similarly, the first plunger 1522 can include a sixth sealing member 1550 (e.g., an o-ring) operably positioned within a sixth edge recess 1548. The fifth sealing member 1546 can be configured to engage the inner surface of the sidewall 1216 to form a fixed seal, and the sixth sealing member 1550 can be configured to slide along the inner surface of the bushing 1232 to form a movable seal.

The second piston 1520 and the second plunger guide 1530, respectively, can be similar to the piston 1204 and the plunger guide 1206 discussed above with reference to FIGS. 12A-12C. The second plunger 1524 can include a recess 1551 configured to receive the base portion 136*c* of the pin 136 and a retaining member 1552 removably inserted (e.g., by complementary threads (not shown)) into the recess 1551 to hold the pin 136 in firm contact with the second plunger 1524 during movement of the second plunger 1524 in parallel with the actuating axis 1506 in the actuating direction 1508 and in a direction opposite to the actuating direction 1508.

The first piston 1518 and the second piston 1520 can be configured to move in parallel with the actuating axis 1506 in the actuating direction 1508 or in the direction opposite to the actuating direction 1508 in response to changes in one or more pressure equilibriums (e.g., pneumatic and/or hydraulic pressure differentials) between different enclosures within the actuator housing 1504. In one embodiment, the actuator 1502 includes a first space 1553 within the actuator housing 1504 between the first plunger guide 1526 and the first piston 1518, a second space 1554 within the actuator housing 1504 between the second plunger guide 1530 and the second piston 1520, and a third space 1556 within the actuator housing 1504 between the first and second pistons 1518, 1520. Furthermore, the actuator 1502 can include a first pneumatic port 1558, a second pneumatic port 1560, and a third pneumatic port 1562 opening into the first space 1553, the second space 1554, and the third space 1556, respectively. The first and second pneumatic ports 1558, 1560 can extend through the first and second plunger guides 1526, 1530, respectively, and can be stationary during operation of the actuator 1502. In some embodiments, the third pneumatic port 1562 is movable in parallel with the actuating axis 1506 during operation of the actuator 1502. For example, the third pneumatic port 1562 can extend through the first plunger 1522. In other embodiments, the third pneumatic port 1562 can extend through the second plunger 1524 or have another suitable position. As shown in FIGS. 15A-15C, first, second, and third elbow fittings 1564, 1566, 1568 can be connected, respectively, to the first, second, and third pneumatic ports 1558, 1560, 1562. Other suitable fittings can be used in other embodiments.

The first piston 1518 can be movable from a fully retracted first position (FIGS. 15A and 15C) to a fully extended second position (FIG. 15B) and through a range of travel between the first and second positions. The second position can be adjustable. For example, the actuator 1502 can include a stop 1570 (e.g., a nut) adjustably connected to the first plunger 1522. The first plunger guide 1526 can have a first side 1526*a* facing toward the stop 1570 and an opposite second side 1526*b* facing toward the first piston 1518. When the first piston 1518 is in the second position, the stop 1570 can be in contact with the first side 1526*a*. When the first piston 1518 is in the second position, the first piston 1518 can be in contact with the second side 1526*b*. Adjusting a position of the stop 1570 relative to the first plunger 1522 in parallel with the actuating axis 1506 can move the second position (e.g., by changing the distance between the stop 1570 and the first piston 1518 in parallel with the actuating axis 1506 when the stop 1570 contacts the first plunger guide 1526). The first plunger 1522 and the stop 1570 can include complementary threads 1572 and rotating the stop 1570 relative to the first plunger 1522 can adjust the position of the stop 1570 relative to the first plunger 1522 in parallel with the actuating axis 1506. The density of the complementary threads 1572 in parallel with the actuating axis 1506 can be, for example, greater than 20 threads-per-inch (e.g., from 20 threads-per-inch to 200 threads-per-inch), greater than 40 threads-per-inch (e.g., from 40 threads-per-inch to 200 threads-per-inch), greater than 60 threads-per-inch (e.g., from 60 threads-per-inch to 200 threads-per-inch), greater than another suitable threshold, or within another suitable range. As shown in FIGS. 15A-15C, the stop 1570 can include threaded channels 1574 and set screws 1576 individually positioned within the threaded channels 1574. The set screws 1576 can be used, for example, to lock the position of the stop 1570 relative to the first plunger 1522 in parallel with the actuating axis 1506 after adjustment.

The actuator 1502 can be controlled by, for example, changing pneumatic inputs to the first, second, and/or third pneumatic ports 1558, 1560, 1562. In an example of operation, when the pin 136 is in the closed position (FIG. 15A), the first and second pneumatic ports 1558, 1560 can be dumped (e.g., open to the atmosphere) and the pneumatic input to the third pneumatic port 1562 can be set to a pneumatic input at a pressure that causes a level of contact force between the pin 136 and the second seat 104 suitable for shutting off flow through the control valve 1500. Alternatively, when the pin 136 is in the closed position (FIG. 15A), the pneumatic input to the first pneumatic port 1558 can be set to a pneumatic input sufficient to move the first piston 1518 to the fully extended position, the second pneumatic port 1560 can be open to the atmosphere, and the pneumatic input to the third pneumatic port 1562 can be set to a pneumatic input that causes a level of contact force between the pin 136 and the second seat 104 suitable for shutting off flow through the control valve 1500. The pneumatic input to the first pneumatic port 1558 can be sufficient to at least generally prevent the first piston 1518 from moving out of the fully extended position in response to force exerted against the first piston 1518 due to the pneumatic input to the third pneumatic port 1562.

To move the pin 136 to the throttling position (FIG. 15B), the pneumatic input to the first pneumatic port 1558 can be set to a pneumatic input sufficient to move the first piston 1518 to the fully extended position, and the second and third pneumatic ports 1560, 1562 can be dumped (e.g., open to the atmosphere). The pneumatic input to the first pneumatic port 1558 can be sufficient to counteract a hydraulic force from fluid within the first and second seats 102, 104 exerted against the first piston 1518 via the pin 136, the second plunger 1524, and the second piston 1520. When the second and third pneumatic ports 1560, 1562 are dumped, the second piston 1520 can move into contact with the first piston 1518 in response to the hydraulic force. The second piston 1520 can include a spacer 1578 (e.g., an annular projection operably positioned toward the first piston 1518) configured to engage the first piston 1518 and to prevent the third space 1556 from becoming unduly restricted when the first and second pistons 1518, 1520 are in contact with one another. The spacer 1578 can be resilient (e.g., made of hard rubber) so as to reduce wear on the first and second pistons 1518, 1520 during operation of the actuator 1502. Dumping the pneumatic input to the third pneumatic port 1562 and changing the pneumatic input to the first pneumatic port 1558 can be synchronized (e.g., electronically synchronized using a controller (not shown)) so that first piston 1518 moves to the fully extended position at the same time or before the second piston 1520 moves into contact with the first piston 1518. This can reduce or prevent flow through the control valve 1500 from briefly dipping or spiking when the pin 136 moves from closed position to the throttle position. Maintaining the first piston 1518 in the fully extended position when the pin 136 is in the closed position, as discussed above, also can be useful to reduce or prevent flow through the control valve 1500 from briefly dipping or spiking when the pin 136 moves from closed position to the throttle position.

To move the pin 136 to the open position (FIG. 15C), the first, second, and third pneumatic ports 1558, 1560, 1562 can be dumped (e.g., open to the atmosphere). Other suitable permutations of the pneumatic inputs to the first, second, and/or third pneumatic ports 1558, 1560, 1562 for achieving and transitioning between the closed position, the throttling position, and the open position of the pin 136 are also possible. In at least some embodiments, the actuator 1502 facilitates rapid transitioning between two or more (e.g., three) precise actuating positions and repeatedly achieving at least generally consistent contact forces between the pin 136 and the second seat 104. Accordingly, the actuator 1502 can be well suited for use in operations that call for repeated cycling of a fluid jet through cycles that include shut off, piercing, and cutting or combinations thereof. To calibrate the actuator 1502 for use in a particular operation, the piercing parameters can be empirically tested at different settings of the stop 1570. When suitable piercing parameters are achieved, the set screws 1576 can be tightened and the actuator 1502 can precisely achieve the piercing parameters over a large number of cycles (e.g., greater than 100 cycles, greater than 1,000 cycles, greater than 10,000 cycles, or another suitable number of cycles). Adjustment of the stop 1570 and calibration of the actuator 1502 can be manual or automatic. For example, to facilitate automatic adjustment of the stop 1570 and calibration of the actuator 1502, the actuator 1502 can include a servomechanism (not shown) configured to adjust the actuator 1502 based on an input, such as one or more of the inputs discussed above with reference to FIGS. 14A-14C. In some cases, similar to first and second pneumatic regulators 1421, 1422 described above with reference to FIG. 14A, such a servomechanism can facilitate dynamic control over throttling functionality.

Figure 16A:
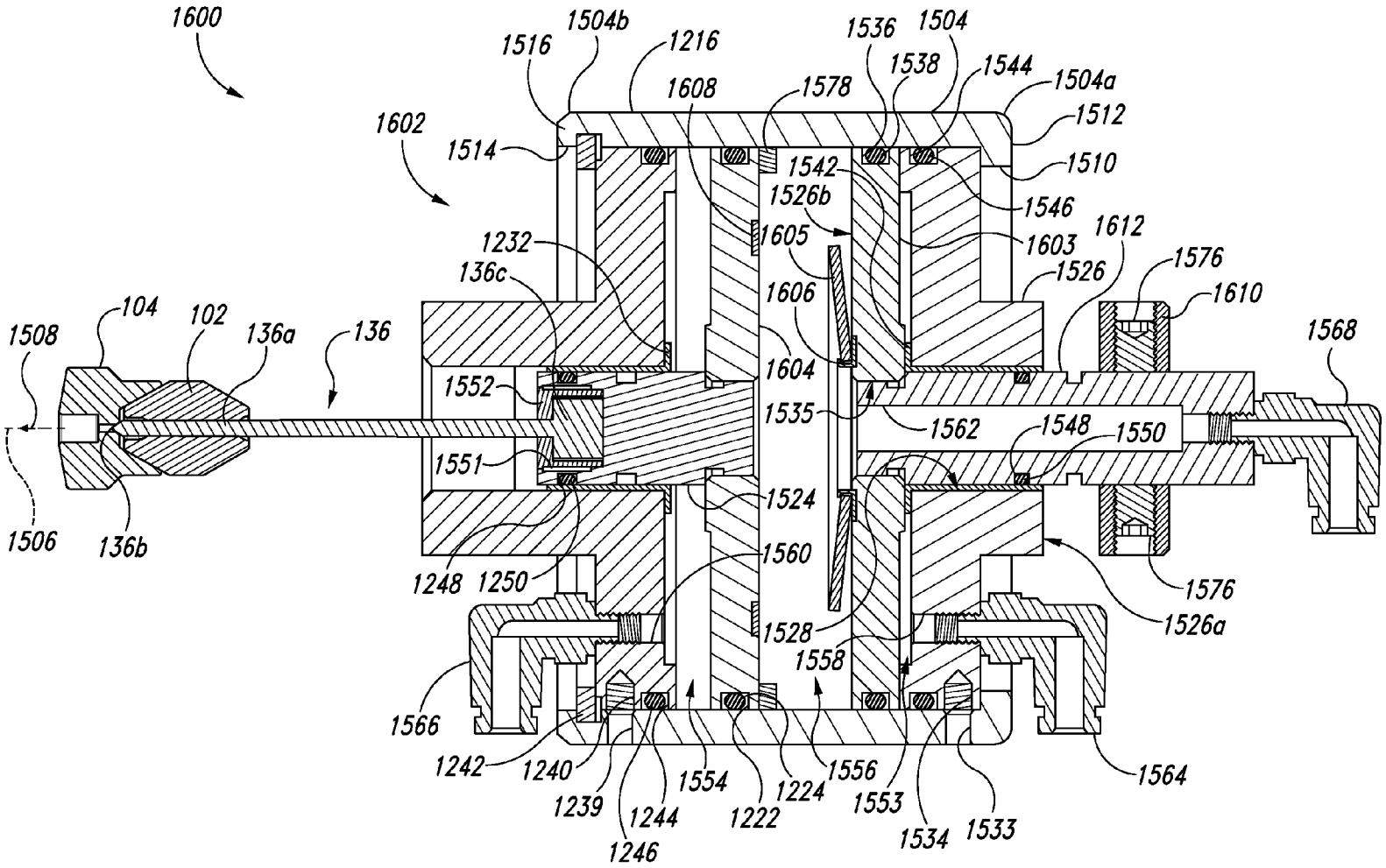
FIGS. 16A, 16B, and 16C are cross-sectional side views illustrating a portion of a control valve including an actuator and a pin, with the pin in a closed position, a throttling position, and an open position, respectively, configured in accordance with an embodiment of the present technology.
Figure 16B:
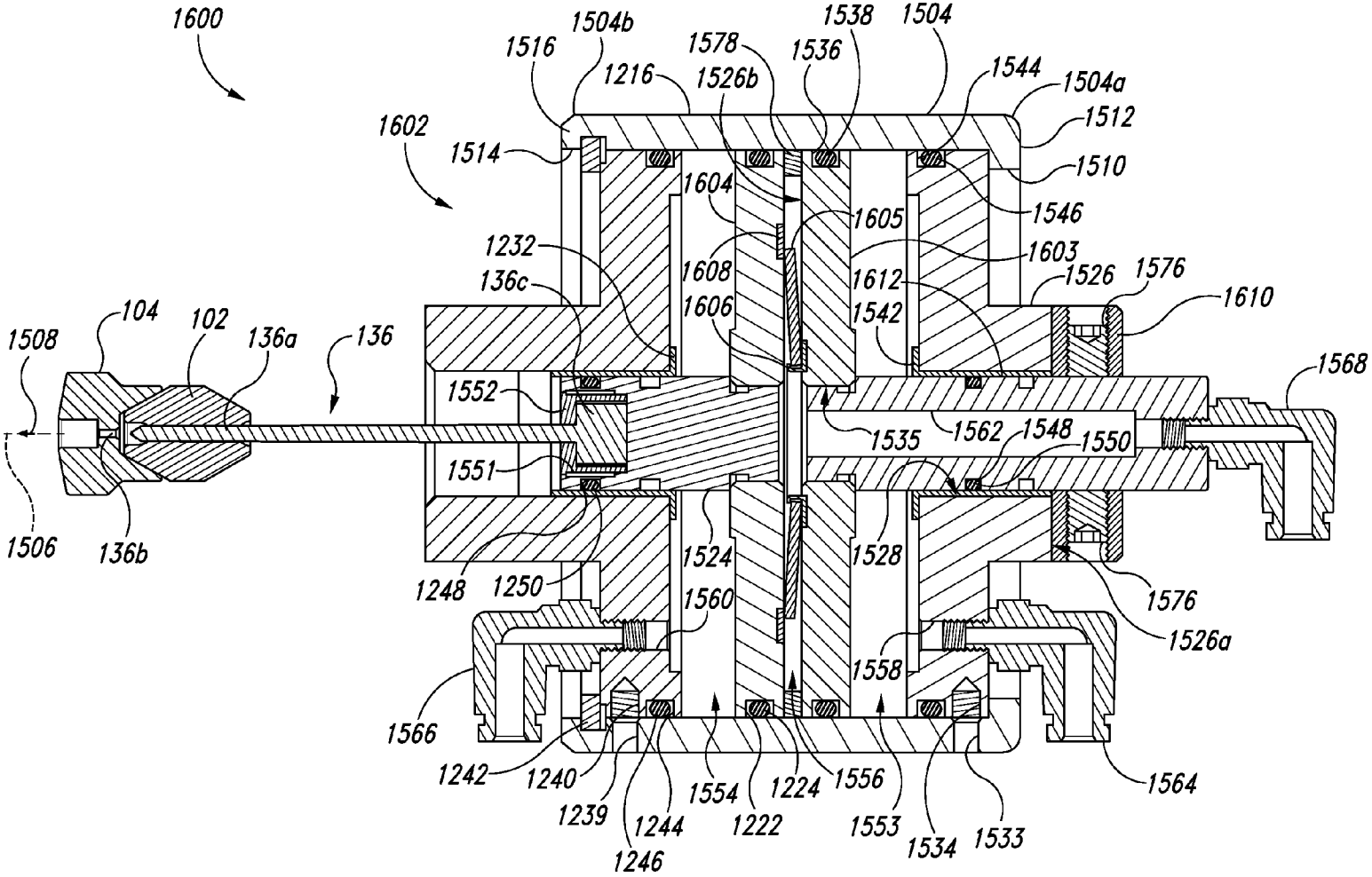
Figure 16C:
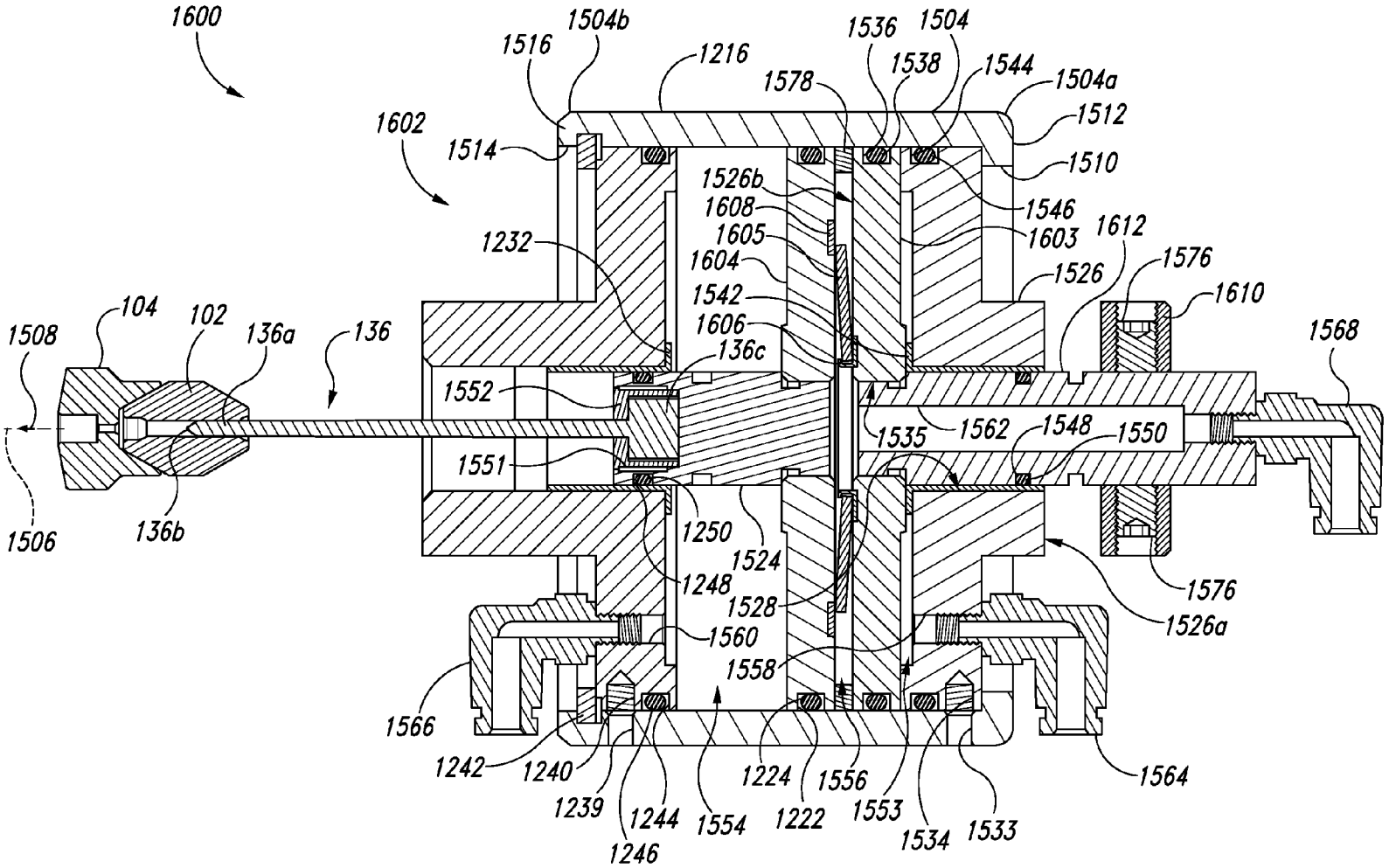

FIGS. 16A, 16B, and 16C are cross-sectional side views illustrating a portion of a control valve 1600 including an actuator 1602 and the pin 136, with the pin 136 in a closed position, a throttling position, and an open position, respectively, configured in accordance with an embodiment of the present technology. The actuator 1602 can include a first movable member, such as a first piston 1603, and a second movable member, such as a second piston 1604, slidably disposed within the actuator housing 1504. In general, the actuator 1602 can be similar to the actuator 1502 shown in FIGS. 15A-15C, but further including a resilient member 1605 operably connected to a side of the first piston 1603 facing toward the second piston 1604. The resilient member 1605, for example, can be a Bellville spring attached to the first piston 1603 with an annular retaining element 1606. An annular strike 1608 complementary to the resilient member 1605 can be attached to a side of the second piston 1604 facing toward the first piston 1603. As another difference relative to the actuator 1502 shown in FIGS. 15A-15C, the actuator 1602 can include a stop 1610 and a first plunger 1612 that are not rotatably connected, but rather fixedly connected to one another. In other embodiments, the stop 1570 and/or the first plunger 1522 of the actuator 1502 shown in FIGS. 15A-15C can be used in the actuator 1602.

As shown in FIG. 16A, when the pin 136 is in the closed position, the resilient member 1605 can be spaced apart from the second piston 1520. As shown in FIGS. 16B and 16C, when the pin 136 is in the throttling and open positions, respectively, the resilient member 1605 can be compressed between the first and second pistons 1518, 1520. The actuator 1602 can function in a manner similar to the manner in which the actuator 1502 shown in FIGS. 15A-15C functions. The resilient member 1605, however, can further facilitate dynamic control over throttling functionality. For example, the resilient member 1605 can have a stabilizing effect similar to the effect of the resilient member 1274 discussed above with reference to FIGS. 12A-12C. Primary control of the actuator 1602 during throttling, for example, can be via the second pneumatic port 1560. Although the resilient member 1605 in the embodiment shown in FIGS. 16A-16C is configured to move with the first piston 1603, in other embodiments, the resilient member 1605 can be configured to move with the second piston 1604. For example, the positions of the resilient member 1605 and the strike 1608 can be reversed. In still other embodiments, the actuator 1602 can include the resilient member 1605 and another resilient member (not shown) operably connected to the second piston 1604 at the side of the second piston 1604 facing toward the first piston 1603. Other configurations are also possible.

Figure 17A:
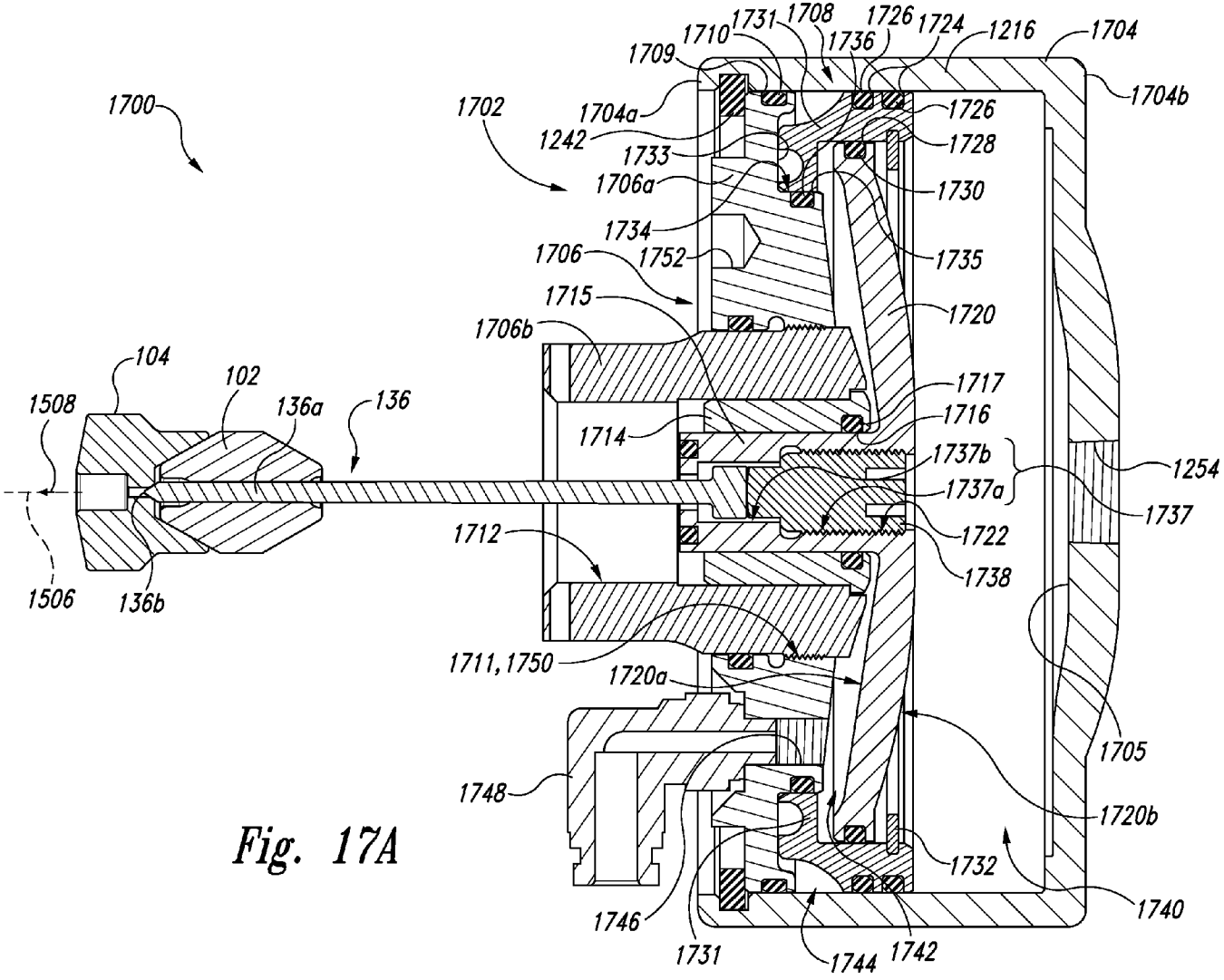
FIGS. 17A, 17B, and 17C are cross-sectional side views illustrating a portion of a control valve including an actuator and a pin, with the pin in a closed position, a throttling position, and an open position, respectively, configured in accordance with an embodiment of the present technology.
Figure 17B:
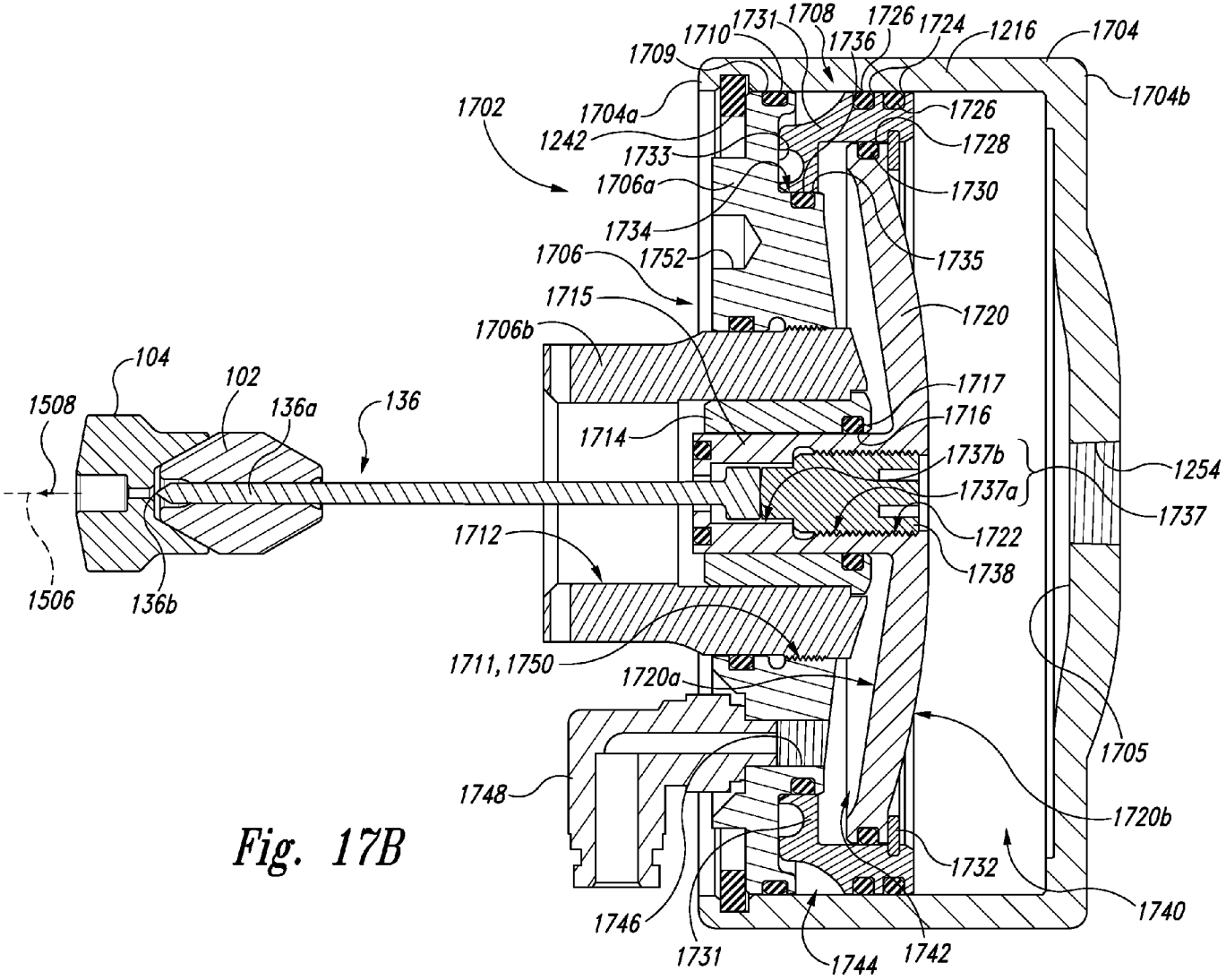
Figure 17C:
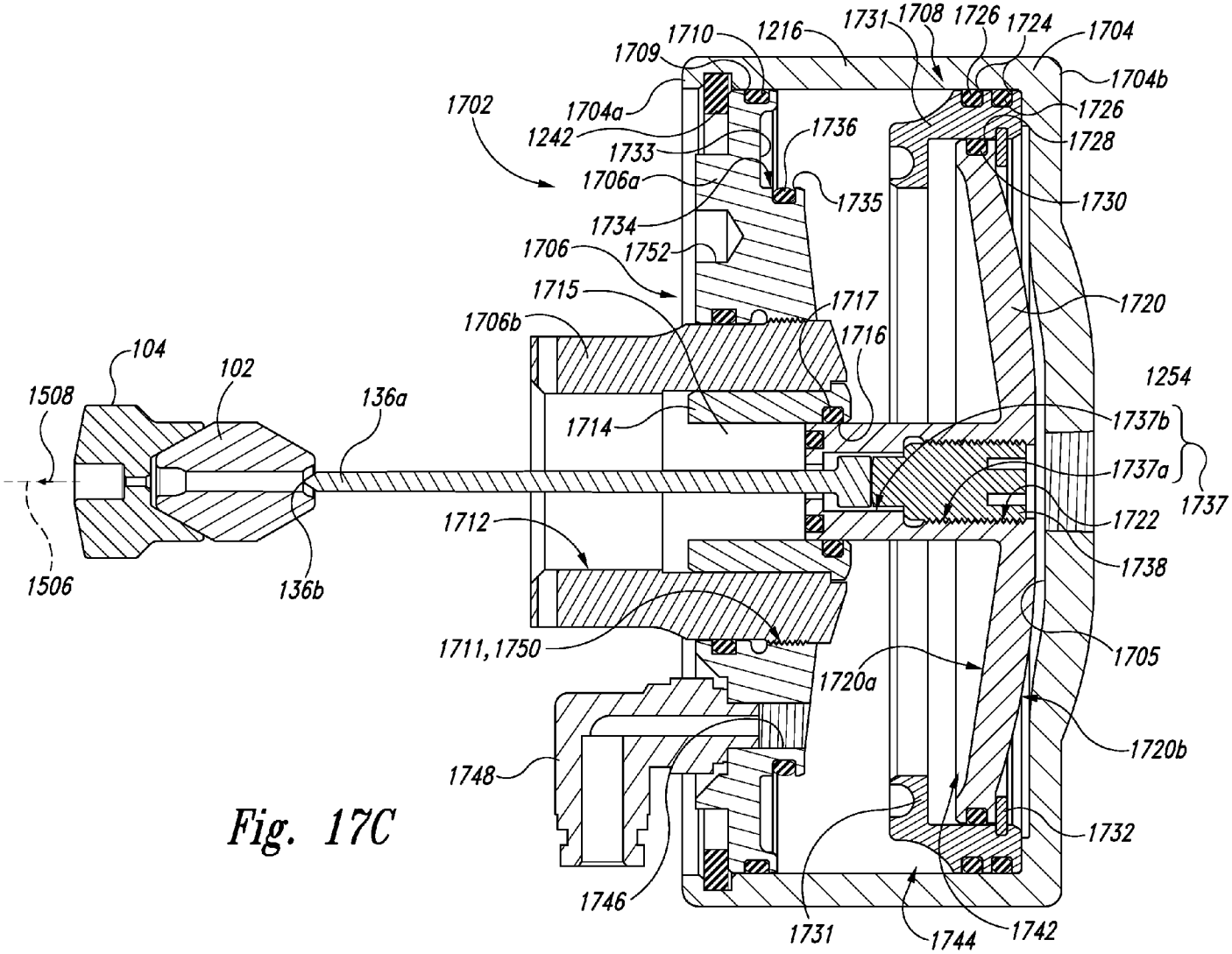

FIGS. 17A-17C illustrate a control valve 1700 configured in accordance with another embodiment of the present technology. In particular, FIGS. 17A, 17B, and 17C are cross-sectional side views illustrating a portion of the control valve 1700 including an actuator 1702 and the pin 136, with the pin 136 in a closed position, a throttling position, and an open position, respectively. The actuator 1702 can include certain features similar to features of the actuators 1100, 1201 discussed above with reference to FIGS. 11 and 12. These features may allow the actuator 1702, in at least some cases, to be more compact than the actuators 1502, 1602 shown in FIGS. 15A-16C. The relatively compact size of the actuator 1702 may be beneficial, for example, to reduce or eliminate interference with movement of an associated cutting head (not shown) (e.g., a tiltable cutting head) when the control valve 1700 is mounted in close proximity to the cutting head.

As shown in FIGS. 17A-17C, the actuator 1702 can include an actuator housing 1704 having a first end 1704*a* and a second end 1704*b* opposite to the first end 1704*a*. The actuator housing 1704 can be generally cylindrical with a shallow internal concavity 1705 at the second end 1704*b*. The actuator 1702 can include a plunger guide 1706 disposed within the actuator housing 1704 near the first end 1704*a* and a piston assembly 1708 slidably disposed within the actuator housing 1704 between the plunger guide 1706 and the second end 1704*b*. The plunger guide 1706 can include an annular first portion 1706*a* and a generally cylindrical second portion 1706*b*. The first portion 1706*a* of the plunger guide 1706 can include an outwardly facing first recess 1709 with a first sealing member 1710 (e.g., an o-ring) inset therein. The first sealing member 1710 can form a stationary pneumatic seal in conjunction with an inner surface of the sidewall 1216. Inwardly, the first portion 1706*a* of the plunger guide 1706 can define a first central bore 1711 with part of the second portion 1706*b* of the plunger guide 1706 received (e.g., rotatably received) therein. Another part of the second portion 1706*b* of the plunger guide 1706 can extend beyond the first end 1704*a*. The first portion 1706*a* of the plunger guide 1706 can define a second central bore 1712 and can include a smooth bushing 1714 disposed therein. The actuator 1702 can further include a plunger 1715 operably connected to the piston assembly 1708, with a portion of the plunger 1715 slidably inset within the bushing 1714. The bushing 1714 can include an inwardly opening second recess 1716 and a second sealing member 1717 (e.g., an o-ring) inset therein. The second sealing member 1717 can form a stationary pneumatic seal in conjunction with an outer surface of the plunger 1715.

The piston assembly 1708 can include an annular piston member 1718 and a central piston member 1720 slidably disposed within a central region of the annular piston member 1718. In some embodiments, the annular piston member 1718 and the central piston member 1720 can be functional substitutes for the first and second pistons 1518, 1520 described above with reference to FIGS. 15A-15C. In other embodiments, the annular piston member 1718 and the central piston member 1720 can be functional distinct from the first and second pistons 1518, 1520. As shown in FIGS. 17A-17C, the central piston member 1720 can be dome-shaped and can include a third central bore 1722, a concave first side 1720*a* facing toward the first end 1704*a* and a convex second side 1720*b* facing toward the second end 1704*b*. At its outer edge, the annular piston member 1718 can include a pair of third recesses 1724 and third sealing members 1726 (e.g., o-rings) individually inset therein. The third sealing members 1726 can form movable pneumatic seals in conjunction with an inner surface of the sidewall 1216. Similarly, at its outer edge, the central piston member 1720 can include a fourth recess 1728 and a fourth sealing member 1730 (e.g., an o-ring) inset therein. The fourth sealing member 1730 can form a movable pneumatic seal in conjunction with an inner surface of the annular piston member 1718. The annular piston member 1718 can include a flange 1731 at one end of its inner surface and a retaining ring 1732 near an opposite end of its inner surface. The first portion 1706*a* of the plunger guide 1706 can include a ledge 1733 and an adjacent step 1734 configured to receive the flange 1731 when the pin 136 is in the closed and throttling positions shown in FIGS. 17A and 17B, respectively. At the step 1734, the first portion 1706*a* of the plunger guide 1706 can include an outwardly facing fifth recess 1735 and a fifth sealing member 1736 (e.g., an o-ring) inset therein. The fifth sealing member 1736 can form a stationary pneumatic seal in conjunction with an inwardly facing surface of the ledge 1733.

In the illustrated embodiment, the plunger 1715 and the central piston member 1720 are integrally connected. In other embodiments, the plunger 1715 and the central piston member 1720 can be separate structures coupled to one another. The third central bore 1722 can be aligned with a longitudinal channel 1737 within the plunger 1715. The longitudinal channel 1737 can have a wide portion 1737*a* closest to the central piston member 1720 and a narrow portion 1737*b* further from the central piston member 1720. The plunger 1715 can include a plug 1738 operably positioned within the second central bore 1712 and the wide portion 1737*a* of the longitudinal channel 1737. The outer surface of the plug 1738 can be threaded and the plug 1738 can be rotatably disposed within the second central bore 1712 and the wide portion 1737*a* of the longitudinal channel 1737 such that the threads engage complementary threads along an inner surface of the second central bore 1712 and the wide portion 1737*a* of the longitudinal channel 1737. In this way, the plug 1738 can be adjusted in a manner similar to the manner in which the plug 1266 shown in FIGS. 12A-12C is adjusted. The functionality and other features of the plug 1738 also can be similar to those of the plug 1266 shown in FIGS. 12A-12C.

As shown in FIG. 17A, when the pin 136 is in a closed position, the actuator housing 1704 can contain three pneumatically separated spaces. The third and fourth sealing members 1726, 1730 can pneumatically seal a first space 1740 between the second side 1720*b* of the central piston member 1720 and the second end 1704*b*; the second, fourth, and fifth sealing members 1717, 1730, 1736 can pneumatically seal a second space 1742 between the second side of the central piston member 1720 and the plunger guide 1706; and the first, fourth, and fifth sealing members 1710, 1726, 1736 can pneumatically seal a third space 1744 between the annular piston member 1718 and the sidewall 1216. At the first end 1704*a* of the actuator housing 1704, the actuator 1702 can include a first pneumatic port 1746 extending through the first portion 1706*a* of the plunger guide 1706 and into the second space 1742. An elbow fitting 1748 can be operably connected to the first pneumatic port 1746. The second pneumatic port 1254 can open into the first space 1740. To move the pin 136 from the closed position (FIG. 17A) to the throttling position (FIG. 17B), the pneumatic pressure within the second space 1742 can be increased to a pressure greater than a pressure sufficient to move the central piston member 1720 relative to the annular piston member 1718 and less than a pressure sufficient to move the entire piston assembly 1708 relative to the sidewall 1216. The difference between these pressures can correspond to the difference in the surface area of the second side of the central piston member 1720 and the combined surface area of the second side of the central piston member 1720 and the portion of the surface of the annular piston member 1718 facing toward the first space 1740. The first space 1740 can be maintained at an elevated (e.g., a constant elevated) pneumatic pressure that exerts a greater force against the piston assembly 1708 as a whole than against the central piston member 1720 alone due to this difference in surface area. In a particular embodiment, when the pin 136 is in the closed position (FIG. 17A), the second space 1742 is vented to the atmosphere and the first space 1740 is at 85 psi. To move the pin 136 to the throttling position (FIG. 17B), the second space 1742 is pressurized to 90 psi. In other embodiments, other suitable pressures can be used.

The position of the pin 136 in the throttle state can be adjusted, for example, by rotating one of the first and second portions 1706*a*, 1706*b* of the plunger guide 1706 relative to the other at a rotational interface 1750. The first portion 1706*a* of the plunger guide 1706 can include one or more sockets 1752 (one shown in FIGS. 17A-17C) configured to receive portions of a tool (not shown) to facilitate this rotation. This rotation can shift the positions of the first and second portions 1706*a*, 1706*b* of the plunger guide 1706 relative to one another, which can cause a corresponding shift in the position of the central piston member 1720 relative to the annular piston member 1718 when the pin 136 is in the closed position shown in FIG. 17A. This shift, in turn, can change the distance that the central piston member 1720 moves before it contacts the retaining ring 1732 as well as the separation between the pin 136 and the first and second seats 102, 104 when the pin 136 is in the throttle position shown in FIG. 17B. In some embodiments, the rotational interface 1750 is restricted (e.g., with stops) to allow for a suitable range of travel to prevent the central piston member 1720 from bottoming out before the pin 136 reaches the closed position. In other embodiments, the rotational interface 1750 is unrestricted.

To move the pin 136 from the closed position to the open position or from the throttling position to the open position, the pneumatic pressure in the first space 1740 can be released while the pneumatic pressure provided via the first pneumatic port 1746 is maintained. As the piston assembly 1708 moves toward the second end 1704*b*, the flange 1731 can separate from the fifth sealing member 1736 and the second and third spaces 1742, 1744 can combine. When the pin is in the open position, the central piston member 1720 can be at least partially nested within the concavity 1705 to enhance compactness. In some embodiments, the actuator 1702 is configured to change the position of the pin 136 between the closed position, the open position, and a manually adjusted throttle position. In other embodiments, the actuator 1702 can be configured to change the position of the pin 136 between the closed position, the open position, and an automatically adjusted throttle position. Automatic adjustment of the throttle position can be accomplished, for example, using a servomechanism (not shown) configured to cause rotation at the threaded interface 1750 (e.g., in a manner similar to the manner discussed above with reference to FIGS. 15A-15C). Alternatively or in addition, automatic adjustment of the throttle position can be accomplished by precisely controlling one or both of the pneumatic inputs to the actuator 1702 (e.g., in a manner similar to the manner discussed above with reference to FIG. 14). In conjunction with precise control one or both of the pneumatic inputs to the actuator 1702, a resilient member (e.g., a Belleville spring) (not shown) can be positioned between the edge of the central piston member 1720 and the retaining ring 1732 to enhance stability in a manner similar to the manner in which the resilient member 1605 functions in the embodiment shown in FIGS. 16A-16C.

Selected Examples of Relief Valves

When a jet is slowed or stopped using a control valve configured in accordance with an embodiment of the present technology, it can be useful to at least generally prevent fluid pressure upstream from the control valve from increasing in response, even for a very short period of time. In some embodiments, a waterjet system including a control valve includes a pressure-compensated pump, such as a hydraulic intensifier that responds (e.g., goes off stroke) automatically when fluid pressure upstream from the control valve changes due to operation of the control valve. In other embodiments, a waterjet system including a control valve includes a pump that is not pressure-compensated, such as a positive-displacement pump (e.g., a direct-drive pump) that may not be capable of automatically responding to changes in fluid pressure upstream from the control valve due to operation of the control valve. For example, positive-displacement pumps may have relatively high inertia during operation that cannot be rapidly redirected. A waterjet system that includes a pump that is not pressure-compensated and a control valve configured in accordance with an embodiment of the present technology can include a relief valve configured to release fluid when a jet generated by the system is slowed or stopped using the control valve. As an example, the relief valve can be configured to open and/or close in response to input associated with operation of the control valve (e.g., one or more signals corresponding to at least partially opening and/or closing the control valve). As another example, the relief valve can be configured to automatically open and/or close in response to a change in a balance of opposing forces acting on a portion of the relief valve, with the change being associated with operation of the control valve.

Figure 18A:
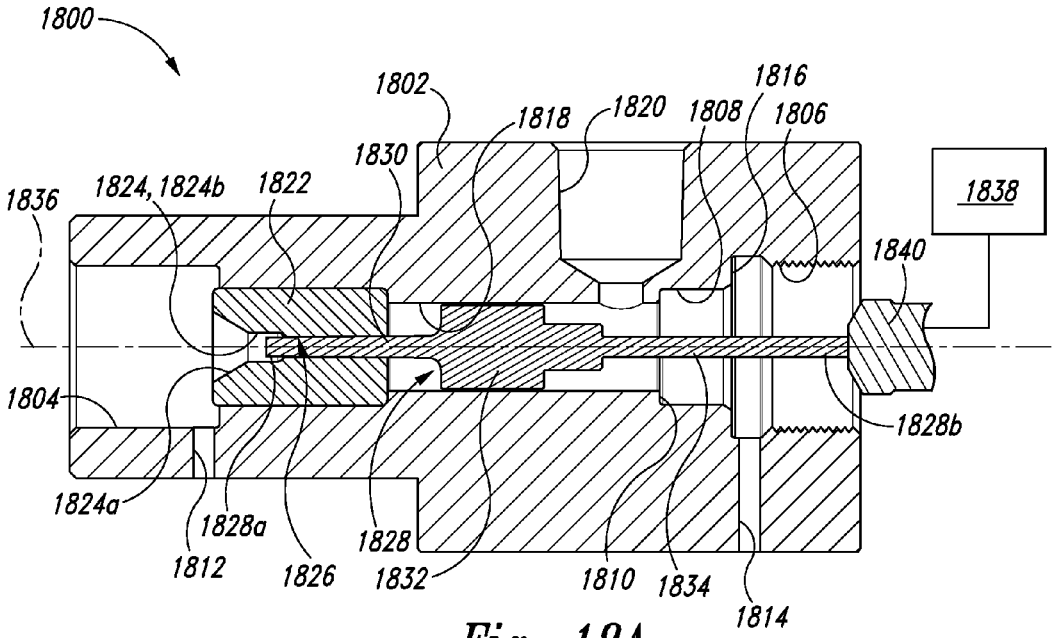
FIGS. 18A and 18B are cross-sectional side views illustrating a relief valve in a first operational state and a second operational state, respectively, configured in accordance with an embodiment of the present technology.
Figure 18B:
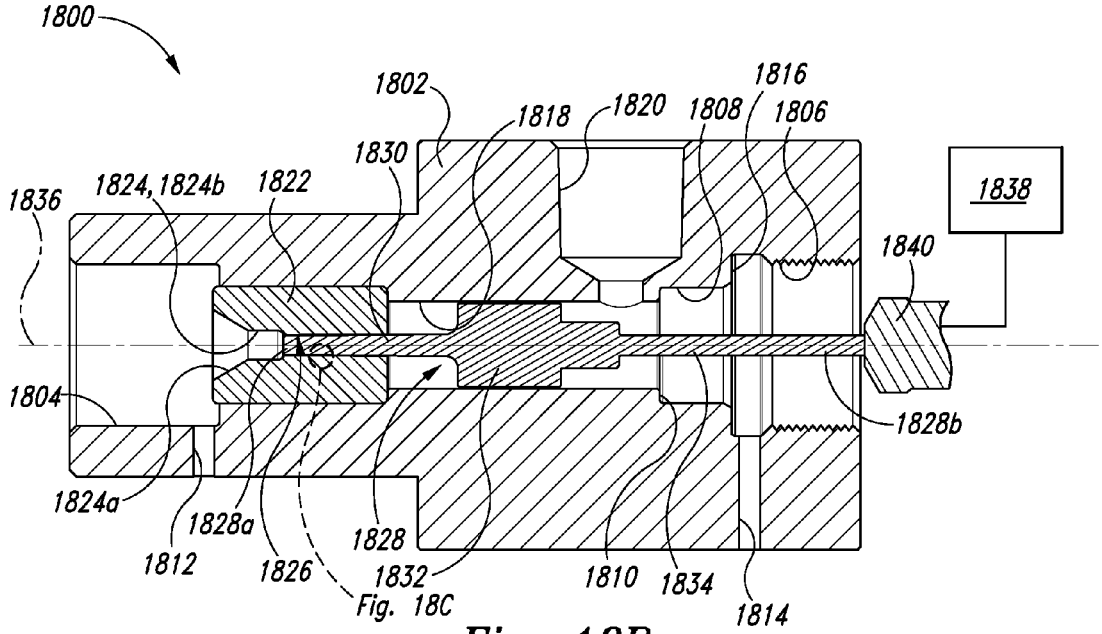
Figure 18C:
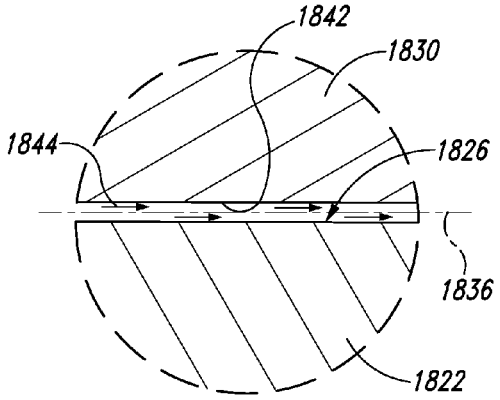
FIG. 18C is an enlarged view of a portion of FIG. 18B.
Figure 18D:
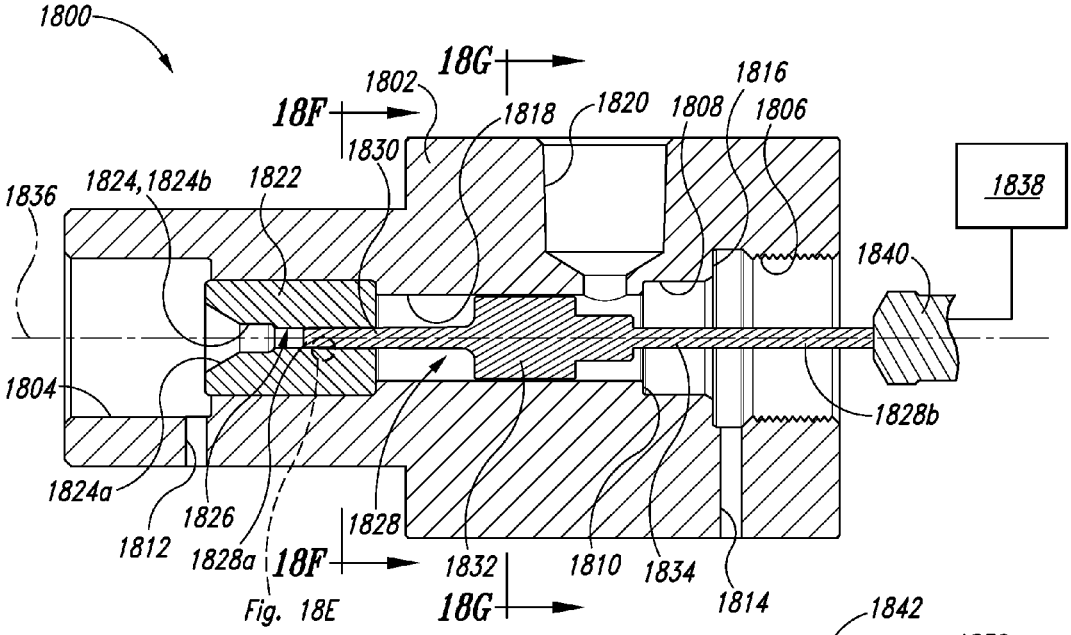
FIG. 18D is a cross-sectional side view illustrating the relief valve shown in FIG. 18A in a third operational state.

FIGS. 18A, 18B and 18D are cross-sectional side views illustrating a relief valve 1800 configured in accordance with an embodiment of the present technology in a first operational state, a second operational state, and a third operational state, respectively. The relief valve 1800 can be configured for use at high pressure. For example, in at least some embodiments, the relief valve 1800 has a pressure rating or is otherwise configured for use at pressures greater than 20,000 psi (e.g., within a range from 20,000 psi to 120,000 psi), greater than 40,000 psi (e.g., within a range from 40,000 psi to 120,000 psi), greater than 50,000 psi (e.g., within a range from 50,000 psi to 120,000 psi), greater than another suitable threshold, or within another suitable range. In the illustrated embodiment, the relief valve 1800 includes a valve body 1802 (e.g., an at least generally cylindrical housing) having a fluid inlet 1804 at one end and a threaded opening 1806 at the opposite end. The fluid inlet 1804 and the threaded opening 1806 can be at least generally cylindrical and configured to receive an end portion of a tube (not shown) and a retainer screw (also not shown), respectively. The tube can be a relief conduit fluidly connected to other conduits, tanks, and/or other suitable components configured to hold high-pressure liquid within a waterjet system.

The valve body 1802 can include a cylindrical seal housing 1808 extending from an annular internal ledge 1810 toward the threaded opening 1806. The seal housing 1808 can be configured to hold a seal assembly (not shown) (e.g., a suitable high-pressure seal assembly including static and/or dynamic sealing components) with the retainer screw holding the seal assembly against the internal ledge 1810. The valve body 1802 can further include a first weep hole 1812 opening to the fluid inlet 1804, and a second weep hole 1814 opening to an annular groove 1816 operably positioned between the threaded opening 1806 and the seal housing 1808. The first weep hole 1812 and the second weep hole 1814 can be configured to allow any fluid leakage proximate the fluid inlet 1804 and the seal housing 1808, respectively, to exit the relief valve 1800.

In the illustrated embodiment, the relief valve 1800 includes a cylindrical chamber 1818 adjacent to the seal housing 1808, and a fluid outlet 1820 extending laterally (e.g., radially) outward from the chamber 1818. The relief valve 1800 can further include a seat 1822 operably positioned within the valve body 1802 between the fluid inlet 1804 and the chamber 1818. In some embodiments, the seat 1822 is fixedly attached (e.g., pressed, welded, or bolted) within the valve body 1802. In other embodiments, the seat 1822 can be releasably held in place within the valve body 1802 by a conduit or other component (e.g., as discussed above) connected to the valve body 1802 at the fluid inlet 1804. The seat 1822 can include a central channel 1824 (e.g., a bore) and a tapered inner surface 1826 along at least a portion of the channel 1824. For example, the channel 1824 can have a cross-sectional area that decreases along the tapered inner surface 1826 from the chamber 1818 toward the fluid inlet 1804. The channel 1824 can include a flared portion 1824*a* (e.g., a conical portion) proximate to the fluid inlet 1804, and an intermediate portion 1824*b* positioned between the flared portion 1824*a* and an end of the tapered inner surface 1826 closest to the fluid inlet 1804.

The relief valve 1800 can further include an elongate stem 1828 moveably positioned within the valve body 1802. The stem 1828 can include a pin portion 1830 operably positioned toward a first end portion 1828*a* of the stem 1828, a connector shaft 1834 operably positioned toward a second end portion 1828*b* of the stem 1828, and a flow restrictor 1832 positioned therebetween. The pin portion 1830 can have an outer surface tapered inwardly toward the first end portion 1828*a* relative to a longitudinal axis 1836 of the stem 1828. The taper of the outer surface of the pin portion 1830 can be at least generally complementary (e.g., parallel) to the taper of the seat 1822. In at least some embodiments, for example, the taper of the pin portion 1830 and the taper of the seat 1822 can be angled within a range from 0.01 degree to 2 degrees, from 0.1 degree to 0.59 degree, from 0.1 degree to 0.5 degree, or within another suitable range of angles relative to the longitudinal axis 1836 of the stem 1828. For example, the outer surface of the pin portion 1830 and the tapered inner surface 1826 of the seat 1822 can both be angled at 0.5 degree relative to the longitudinal axis 1836 of the stem 1828.

In the illustrated embodiment, the relief valve 1800 includes a plunger 1840 operably coupling an actuator 1838 (shown schematically) to the connector shaft 1834. In operation, the actuator 1838 can exert a closing force against the stem 1828 via the plunger 1840 to drive (e.g., press) the stem 1828 toward the seat 1822 and/or move the stem 1828 away from the seat 1822. In some embodiments, the plunger 1840 is aligned with the connector shaft 1834, but not secured to the connector shaft 1834. In other embodiments, the connector shaft 1834 can be secured to the plunger 1840 (e.g., screwed into the end of the plunger 1840), which can allow the actuator 1838 to pull the stem 1828 away from the seat 1822 in addition to pushing the stem 1828 toward the seat 1822.

In use, pressurized fluid upstream from the pin portion 1830 can exert an opening force against the pin portion 1830. If the actuator 1838 exerts a constant closing force against the stem 1828, an increase in upstream fluid pressure acting against the pin portion 1830 (e.g., due to at least partially closing a control valve) can cause the relief valve 1800 to automatically open. Similarly, when the pressure of the upstream fluid decreases (e.g., due to at least partially opening a control valve), the opening force acting against the pin portion 1830 can decrease and the relief valve 1800 can automatically close. The actuator 1838 can be configured such that a maximum extension of the plunger 1840 and/or the maximum closing force acting on the stem 1828 is less than an extension and/or force, respectively, that would cause the pin portion 1830 to become jammed in the channel 1824 (e.g., that would cause static friction between the outer surface of the pin portion 1830 and the tapered inner surface 1826 of the seat 1822 to exceed the maximum opening force acting against the pin portion 1830 during normal operation). Furthermore, the actuator 1838 can be configured to release the closing force automatically when a fluid-pressurizing device (e.g., a pump) (not shown) that pressurizes the upstream fluid is shut off. This feature can enable the upstream fluid to automatically depressurize via the relief valve 1800 upon shutdown of the fluid-pressurizing device. The actuator 1838, for example, can include an electrically actuated air valve configured to release pneumatic pressure when the associated fluid-pressurizing device is shutdown.

Conventional relief valves used in high-pressure systems typically open when an upstream fluid reaches a first (e.g., opening) pressure, and then equilibrate when the upstream fluid reaches a second (e.g., equilibrium) pressure greater than the opening pressure. For example, the equilibrium pressure can be from 2% to 8% greater than the opening pressure. Without wishing to be bound by theory, it is expected that the phenomenon that causes this observed difference between the opening pressure and the equilibrium pressure may be associated with fluid flowing through a conventional relief valve transitioning from laminar flow to turbulent flow as the flow rate of the fluid increases. This transition may decrease the drag exerted by the fluid against the stem of a conventional relief valve and thereby decrease the total opening force acting against the stem. Since an actuator of a conventional relief valve typically exerts a constant closing force against a stem, the upstream fluid pressure may increase after the laminar-to-turbulent flow transition until it reaches a pressure high enough to compensate for the decreased drag force acting on the stem. The position of the stem then equilibrates at this higher pressure. Decreasing drag force acting against a stem of a conventional relief valve is only one example of a possible mechanism to explain observed differences between opening pressures and equilibrium pressures. Other mechanisms instead of or in addition to this mechanism may account for the phenomenon and various mechanisms may apply to some sets of operational parameters (e.g., pressures and fluid flow rates) and not others. Other possible mechanisms include, for example, localized decreases in pressure proximate upstream portions of stems and static friction between stems and corresponding seats.

Operating a high-pressure system (e.g., to produce a jet) while a conventional relief valve is open typically is not desirable. The fluid in such a system, therefore, is effectively only useable at pressures lower than the opening pressure so that the conventional relief valve remains closed. Components (e.g., valves, seals, conduits, etc.) of the system, however, still typically must be rated for the higher equilibrium pressure since they are exposed to the equilibrium pressure when the conventional relief valve is open. Exposing these system components to pressure cycling and higher equilibrium pressures caused by operation of conventional relief valves can necessitate the use of more expensive components (e.g., having higher pressure ratings) without providing any operational advantage (e.g., greater jet velocity). Furthermore, even when higher equilibrium pressures do not necessitate using more expensive components, over time, exposure to these pressures and the accompanying pressure cycling can cause structural damage (e.g., fatigue-related structural damage) in the components, which can be detrimental to the operation of the components and/or cause the components to fail prematurely.

In contrast to conventional relief valves, relief valves configured in accordance with at least some embodiments of the present technology can reduce or eliminate the phenomenon of higher equilibrium pressure than opening pressure. With reference again to FIGS. 18A, 18B and 18D, when the closing force from the actuator 1838 acting against the stem 1828 exceeds the opening force from the upstream fluid acting against the stem 1828, the relief valve 1800 can be in the first (e.g., at least generally closed) operational state (FIG. 18A) and the stem 1828 can be in a first (e.g., at least generally closed) position. When the opening force exceeds the closing force, the relief valve 1800 can move from the first operational state through the second (e.g., intermediate) operational state (FIG. 18B) to the third (e.g., equilibrium open) operational state (FIG. 18D) and the stem 1828 can move downstream through a second (e.g., intermediate) position (FIG. 18B) to a third (e.g., equilibrium open) position (FIG. 18D). In some embodiments, the relief valve 1800 does not completely seal flow of the upstream fluid, even when the relief valve 1800 is in the first operational state. For example, a relatively small amount of the fluid can flow between the pin portion 1830 and the tapered inner surface 1826 of the seat 1822 when the relief valve 1800 is in the first operational state. In other embodiments, no or almost no fluid flows between the pin portion 1830 and the tapered inner surface 1826 of the seat 1822 when the relief valve 1800 is in the first operational state. From the first operational state to the third operational state, the flow rate of the fluid can increase until it reaches an equilibrium flow rate (e.g., a steady-state flow rate) when the relief valve 1800 is in the third operational state. Accordingly, the relief valve 1800 can be configured to convey the fluid at the equilibrium flow rate when the relief valve 1800 is in the third operational state. The equilibrium flow rate can be a predetermined flow rate (e.g., a flow rate produced by an associated positive-displacement pump).

Figure 18E:
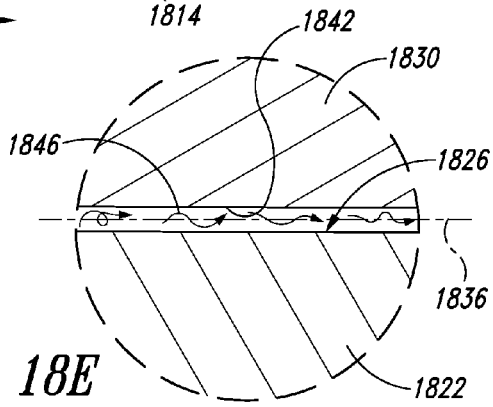
FIG. 18E is an enlarged view of a portion of FIG. 18D.
Figure 18F:
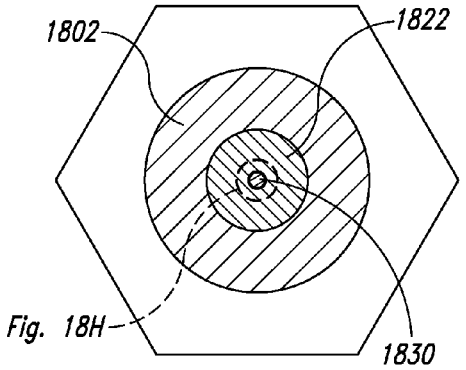
FIG. 18F is a cross-sectional end view taken along line 18F-18F in FIG. 18D.
Figure 18G:
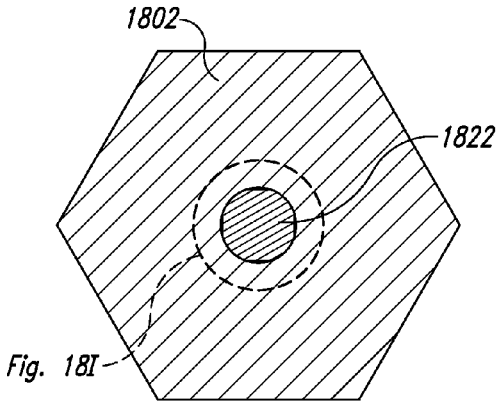
FIG. 18G is a cross-sectional end view taken along line 18E-18E in FIG. 18D.
Figure 18H:
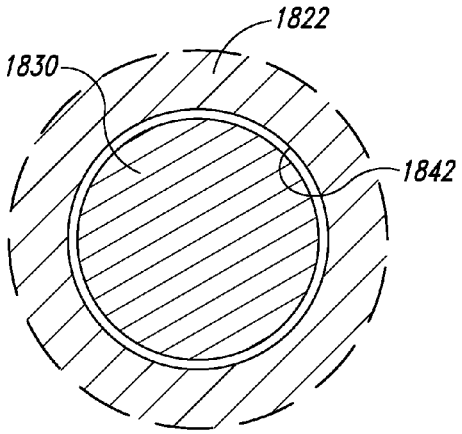
FIG. 18H is an enlarged view of a portion of FIG. 18F.
Figure 18I:
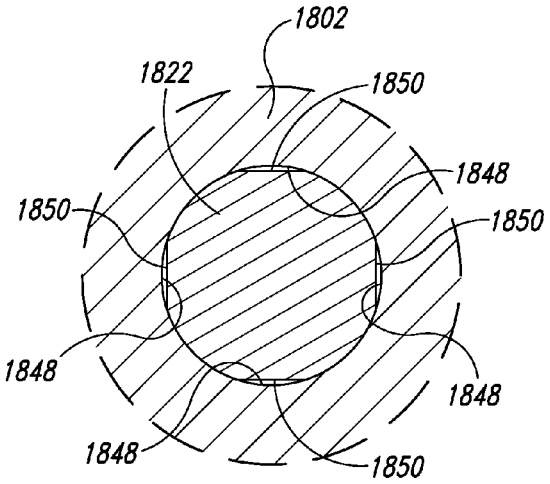
FIG. 18I is an enlarged view of a portion of FIG. 18G.

FIGS. 18C and 18E are enlarged views of portions of FIGS. 18B and 18D, respectively. FIGS. 18F and 18G are cross-sectional end views taken along the lines 18F-18F and 18G-18G, respectively, in FIG. 18D. FIGS. 18H and 18I are enlarged views of portions of FIGS. 18F and 18G, respectively. With reference to FIGS. 18C, 18E and 18H together, the tapered inner surface 1826 of the seat 1822 and the tapered outer surface of the pin portion 1830 can at least partially define a first passage 1842 (e.g., an annular gap) having a cross-sectional area perpendicular to the longitudinal axis 1836 of the stem 1828 that increases as the stem 1828 moves downstream from the first position toward the third position and the relief valve 1800 moves from the first operational state toward the third operational state. In some embodiments, fluid flow though the first passage 1842 can be laminar or relatively laminar (as indicated by arrows 1844 in FIG. 18C) when the relief valve 1800 is in the second operational state, and turbulent (as indicated by arrows 1846 in FIG. 18E) when the relief valve 1800 is in the third operational state. In other embodiments, fluid flow though the first passage 1842 can be consistently laminar, consistently turbulent, turbulent when the relief valve 1800 is in the second operational state and laminar when the relief valve 1800 is in the third operational state, or have other flow characteristics. The fluid flowing through the first passage 1842 may transition from laminar flow to turbulent flow abruptly. For example, when the upstream fluid reaches the opening pressure, the pin portion 1830 may begin to move away from the seat 1822, and the opening force may initially include the force from the fluid acting against the first end portion 1828*a* of the stem 1828 alone or together with the laminar drag force from the fluid acting against the tapered outer surface of the pin portion 1830. As the flow rate through the first passage 1842 increases, the flow of the fluid may become turbulent causing the drag force from the fluid acting against the tapered outer surface of the pin portion 1830 and, thus, the overall opening force against the stem 1828, to decrease.

With reference to FIGS. 18D, 18G and 18I, the flow restrictor 1832 can have a larger cross-sectional area than the pin portion 1830 perpendicular to the longitudinal axis 1836 of the stem 1828. In the illustrated embodiment, the flow restrictor 1832 is at least generally cylindrical with two or more flat portions 1850 circumferentially spaced apart around the perimeter of the flow restrictor 1832 perpendicular to the longitudinal axis 1836 of the stem 1828. The flow restrictor 1832 can be configured to restrict fluid flow within the chamber 1818 downstream from the seat 1822. For example, the flow restrictor 1832 alone or together with the valve body 1802 can define a second passage 1848 when the relief valve 1800 is in the second operational state and/or the third operational state. In the illustrated embodiment, the second passage 1848 is between the flat portions 1850 collectively and an inner surface of the valve body 1802 around the chamber 1818. The second passage 1848 can have a cross-sectional area perpendicular to the longitudinal axis 1836 of the stem 1828 that is at least generally consistent when the relief valve 1800 moves from the first operational state toward the third operational state.

In operation, flow restriction through the second passage 1848 can cause a pressure differential on opposite sides of the flow restrictor 1832. For example, a fluid pressure within a portion of the chamber 1818 upstream from the flow restrictor 1832 can be higher than a fluid pressure within a portion of the chamber 1818 downstream from the flow restrictor 1832. This pressure difference alone or in combination with other opening force acting against the flow restrictor 1832 (e.g., drag from the fluid) can at least partially compensate for a decrease in the opening force acting against the pin portion 1830 when the relief valve 1800 moves from the first operational state toward the third operational state and/or when the relief valve 1800 moves from the second operational state toward the third operational state. The cross-sectional area of the second passage 1848 perpendicular to the longitudinal axis 1836 of the stem 1828, alone or together with other suitable parameters, can be selected to partially compensate, fully compensate, or overcompensate for the a decrease in the opening force acting against the pin portion 1830 when the relief valve 1800 moves from the first operational state toward the third operational state and/or when the relief valve 1800 moves from the second operational state toward the third operational state. In at least some embodiments, the cross-sectional area of the second passage 1848 perpendicular to the longitudinal axis 1836 of the stem 1828 is within a range from 3 times to 50 times, from 5 times to 30 times, from 160 times to 25 times, or within another suitable range of multiples greater than the cross-sectional area of the first passage 1842 perpendicular to the longitudinal axis 1836 of the stem 1828 when the stem 1828 is in the third position and the relief valve 1800 is in the third operational state.

The opening force can include a first opening force acting against the pin portion 1830 and a second opening force acting against the flow restrictor 1832. The cross-sectional area of the second passage 1848 perpendicular to the longitudinal axis 1836 of the stem 1828, alone or together with other suitable parameters, can be selected such that a difference between the second opening force when the stem 1828 is in the second position and the second opening force when the stem 1828 is in the third position is equal to or greater than a difference between the first opening force when the stem 1828 is in the second position and the first opening force when the stem 1828 is in the third position. Similarly, the cross-sectional area of the second passage 1848 perpendicular to the longitudinal axis 1836 of the stem 1828, alone or together with other suitable parameters, can be selected such that a difference between the second opening force when the stem 1828 is in the first position and the second opening force when the stem 1828 is in the third position is equal to or greater than a difference between the first opening force when the stem 1828 is in the first position and the first opening force when the stem 1828 is in the third position.

Figure 19A:
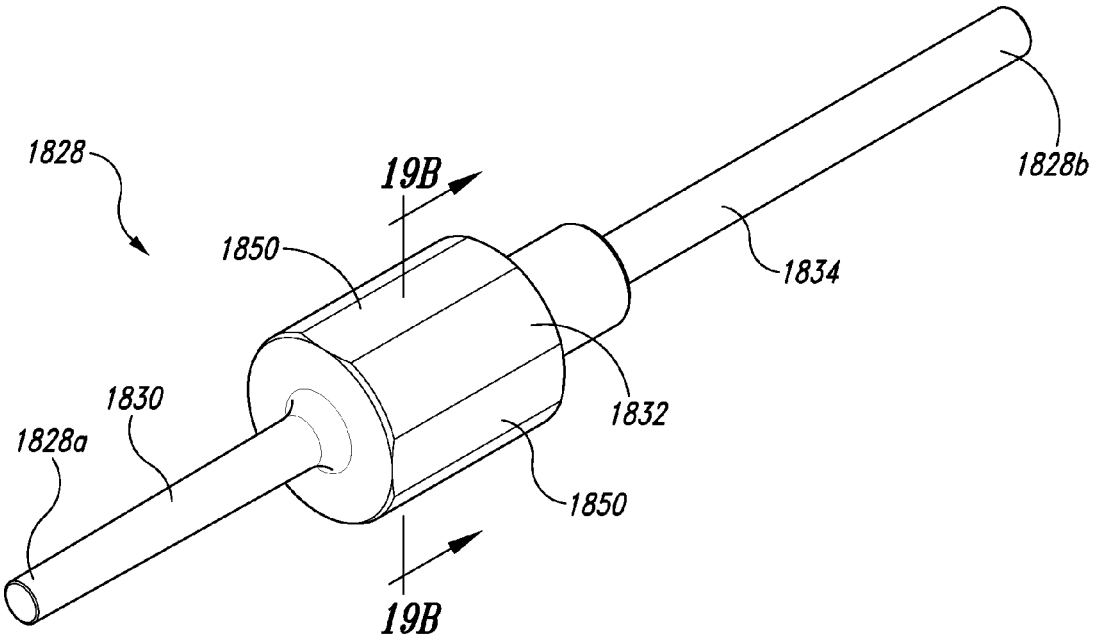
FIG. 19A is an enlarged isometric perspective view illustrating a relief valve stem of the relief valve shown in FIG. 18A.
Figure 19B:
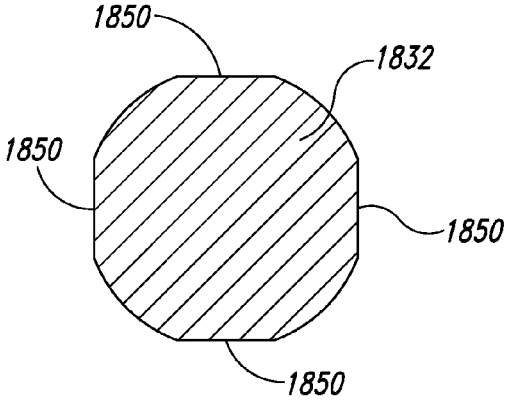
FIG. 19B is a cross-sectional end view taken along line 19B-19B in FIG. 19A.
Figure 20A:
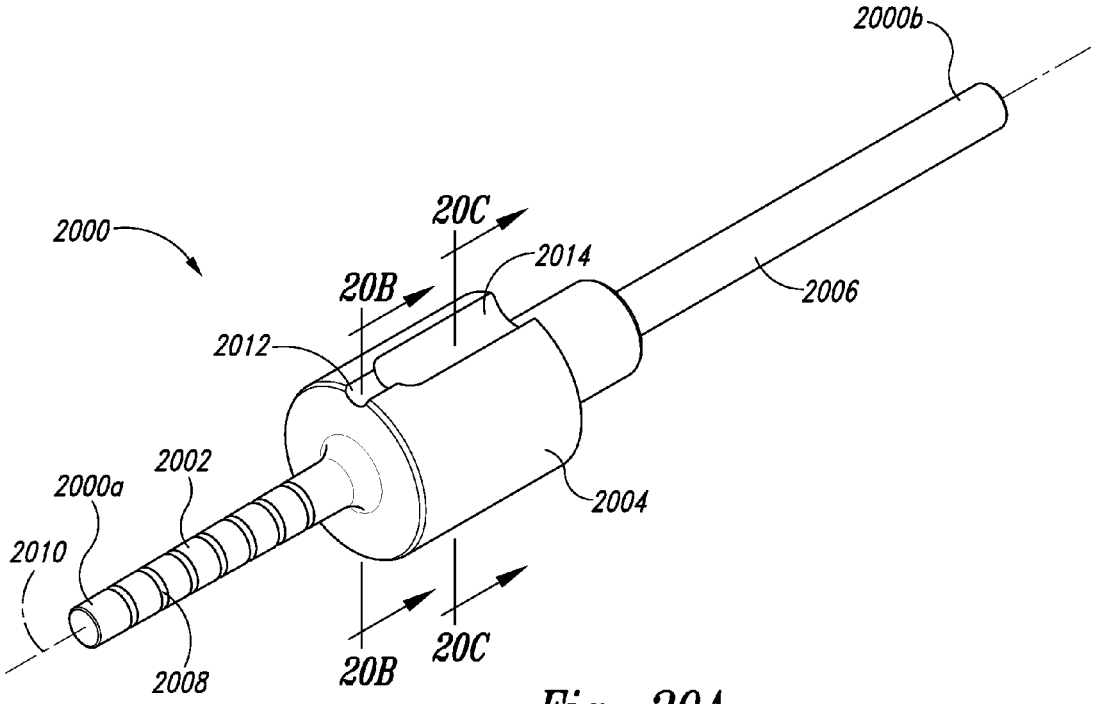
FIG. 20A is an enlarged isometric perspective view illustrating a relief valve stem configured in accordance with an embodiment of the present technology.
Figure 20B:
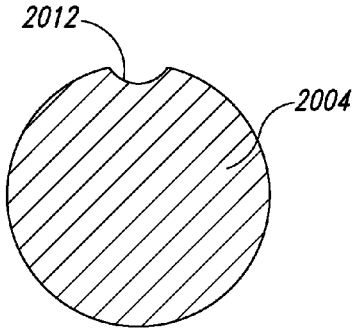
FIG. 20B is a cross-sectional end view taken along line 20B-20B in FIG. 20A.
Figure 20C:
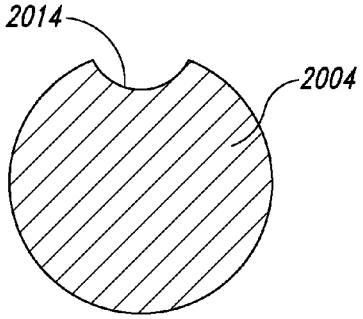
FIG. 20C is a cross-sectional end view taken along line 20C-20C in FIG. 20A.

FIGS. 19A-19B are enlarged isometric perspective views and corresponding cross-sectional end views illustrating relief valve stems configured in accordance with embodiments of the present technology. FIGS. 19A and 19B illustrate the stem 1828 of the relief valve 1800. With reference to FIGS. 20A-20C, a stem 2000 can include a pin portion 2002 operably positioned toward a first end portion 2000*a*, a connector shaft 2006 operably positioned toward a second end portion 2000*b*, and a flow restrictor 2004 positioned therebetween. The pin portion 2002 can have two or more annular grooves 2008 (one identified in FIG. 20A) extending around the circumference of the pin portion 2002 at spaced apart planes perpendicular to a longitudinal axis 2010 of the stem 2000. The annular grooves 2008 can facilitate turbulent flow adjacent to the pin portion 2002. The flow restrictor 2004 can include a first notch 2012 or other suitable channel beginning at a first end of the flow restrictor 2004 proximate the pin portion 2002, and a second notch 2014 or other suitable channel larger than the first notch 2012 in length and cross-sectional area, extending from the first notch 2012 toward a second end of the flow restrictor 2004 proximate the connector shaft 2006. The first notch 2012 can at least partially define a second passage downstream from a first passage at least partially defined by the pin portion 2002 when the stem 2000 is operably positioned within a valve body (not shown).

Figure 21A:
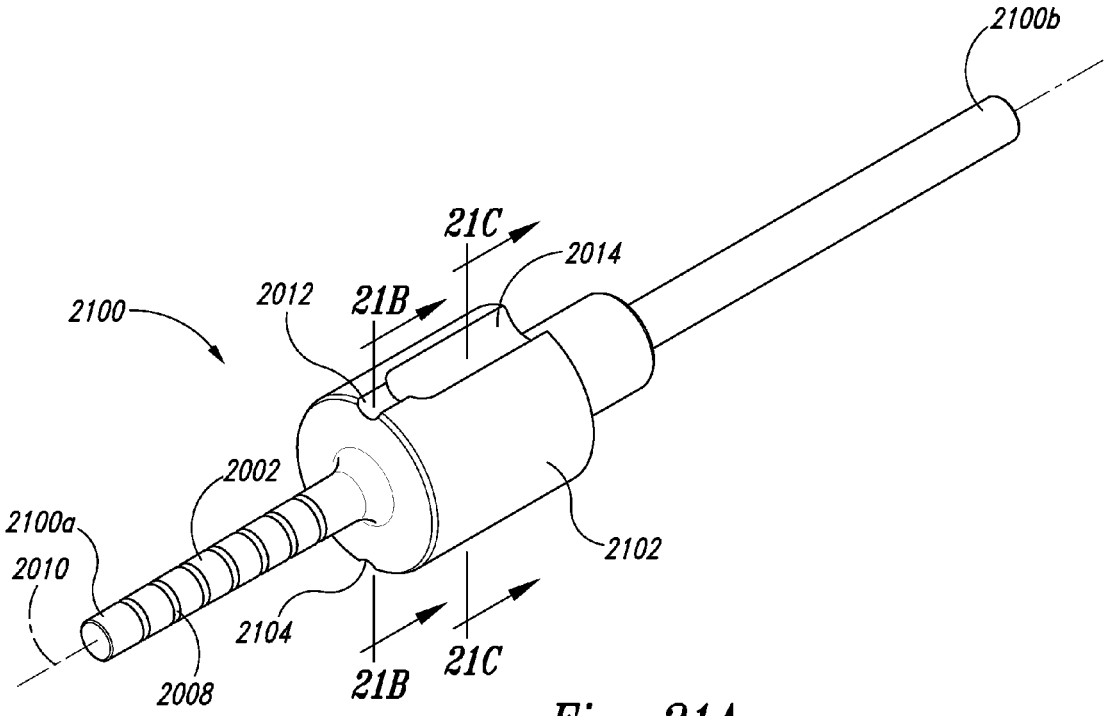
FIG. 21A is an enlarged isometric perspective view illustrating a relief valve stem configured in accordance with an embodiment of the present technology.
Figure 21B:
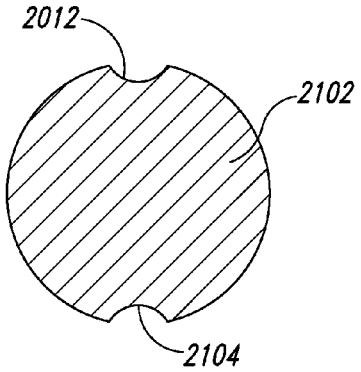
FIG. 21B is a cross-sectional end view taken along line 21B-21B in FIG. 21A.
Figure 21C:
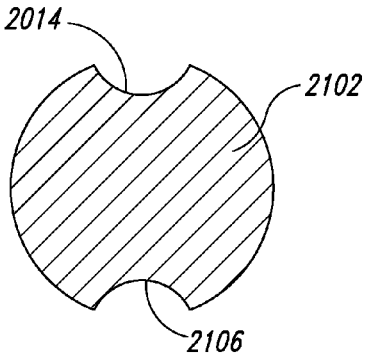
FIG. 21C is a cross-sectional end view taken along line 21C-21C in FIG. 21A.

With reference to FIGS. 21A-21C, a stem 2100 can include the pin portion 2002 operably positioned toward a first end portion 2100*a*, the connector shaft 2006 operably positioned toward a second end portion 2100*b*, and a flow restrictor 2102 positioned therebetween. The flow restrictor 2102 can include the first notch 2012 and the second notch 2014 as well as a third notch 2104 or other suitable channel and a fourth notch 2106 or other suitable channel circumferentially opposite to the first notch 2012 and the second notch 2014, respectively. The first and third notches 2012, 2104 collectively can at least partially define a second passage downstream from a first passage at least partially defined by the pin portion 2002 when the stem 2100 is operably positioned within a valve body (not shown).

With reference to FIGS. 22A and 22B, a stem 2200 can include the pin portion 2002 operably positioned toward a first end portion 2200*a*, a connector shaft 2204 operably positioned toward a second end portion 2200*b*, and a flow restrictor 2202 positioned therebetween. The flow restrictor 2202 can be cylindrical and configured to at least partially define an annular second passage downstream from a first passage at least partially defined by the pin portion 2002 when the stem 2200 is operably positioned within a valve body (not shown).

With reference to FIGS. 23A and 23B, a stem 2300 can include a pin portion 2301 operably positioned toward a first end portion 2300*a*, a connector shaft 2304 operably positioned toward a second end portion 2300*b*, and a flow restrictor 2302 positioned therebetween. The flow restrictor 2302 can include a hole 2306 offset relative to the longitudinal axis 2010 of the stem 2300 and extending from a first end of the flow restrictor 2302 proximate the pin portion 2301 toward a second end of the flow restrictor 2302 proximate the connector shaft 2304. The hole 2306 can define a second passage downstream from a first passage at least partially defined by the pin portion 2301 when the stem 2300 is operably positioned within a valve body (not shown). In some embodiments, the pin portion 2301 and the connector shaft 2304 are portions of a rod 2308 that can be inserted through a central bore 2310 in the flow restrictor 2302, which can then be fixedly attached (e.g., pressed, glued, or welded) to the rod 2308. The hole 2306 can be formed (e.g., drilled) in the flow restrictor 2302 prior to attaching the flow restrictor 2302 to the rod 2308 to facilitate manufacturing. In other embodiments, the pin portion 2301, the flow restrictor 2302, and the connector shaft 2304 can be integrally formed.

Table 2 (below) shows several examples of values for parameters of the stem 2300 (e.g., the minimum diameter of the pin portion 2301, the minimum cross-sectional area of the pin portion 2301, the diameter of the hole 2306, the diameter of the flow restrictor 2302, and the cross-sectional area of the flow restrictor 2302), examples of values for parameters of a system including a relief valve including the stem 2300 (e.g., the system pressure), examples of experimentally obtained values (e.g., the observed pressure increase without the flow restrictor 2302, the flow rate through the relief valve when relief valve is open), examples of values derived from parameters of the stem 2300, parameters of the system, and/or experimentally obtained values (e.g., the force due to the observed pressure increase, the pressure difference across the flow restrictor 2302, and the force due to the flow restrictor 2302). These examples of values are shown for a system including a 50 horsepower pump and for a system including a 100 horsepower pump. In other embodiments, the values shown in Table 2 can be different.

TABLE 2

| Variable | Unit | 50 HP Pump | Multiplier | 100 HP Pump |
|---|---|---|---|---|
| System Pressure | psi | 55000 | | 55000 |
| Observed Pressure Increase without Flow Restrictor | psi | 3000 | | 3000 |
| Pin Portion Minimum Diameter | in | 0.077 | ×1.414 | 0.108878 |
| Pin Portion Minimum Cross-Sectional Area | in^2 | 0.004656626 | ×2 | 0.009310439 |
| Force due to Observed Pressure Increase | lbs | 13.96987713 | ×2 | 27.93131646 |
| Flow Restrictor Hole Diameter | in | 0.077 | ×1.414 | 0.108878 |
| Flow Rate When Relief Valve is Open | gpm | 1.4 | ×2 | 2.8 |
| Pressure Difference Across Flow Restrictor | psi | 126.4312935 | | 126.5076926 |
| Flow Restrictor Diameter | in | 0.375 | ×1.414 | 0.53025 |
| Flow Restrictor Cross-Sectional Area | in^2 | 0.110446617 | ×2 | 0.220826524 |
| Force due to Flow Restrictor | lbs | 13.96390862 | ×2 | 27.93625398 |

Table 2 demonstrates that various parameters of the stem 2300 can be selected to cause the flow restrictor 2302 to equally compensate for a particular increase in system pressure (e.g., an increase empirically determined by opening a relief valve without a flow restrictor). Variations of the values shown in Table 2 can be used to select suitable cross sectional areas of the second passages (or other suitable parameters) of the relief valves discussed above with reference to FIGS. 1A-23 to partially compensate, fully compensate, or overcompensate for various increases in system pressure in particular systems having particular sets of dimensions and features.

As discussed above with reference to FIGS. 18A, 18B, and 18D, in some embodiments, the relief valve 1800 is configured to balance a variable upstream fluid force against a consistent opposing force from the actuator 1838. In this way, the relief valve 1800 can automatically maintain upstream fluid pressure. In other embodiments, the relief valve 1800 can be configured to balance a variable upstream fluid force against a variable opposing force from the actuator 1838. For example, rather than setting the actuator 1838 to exert a consistent opposing force against the stem 1828, the actuator 1838 can be dynamically controlled within a feedback loop and/or in response to input from a user.

Figure 24:
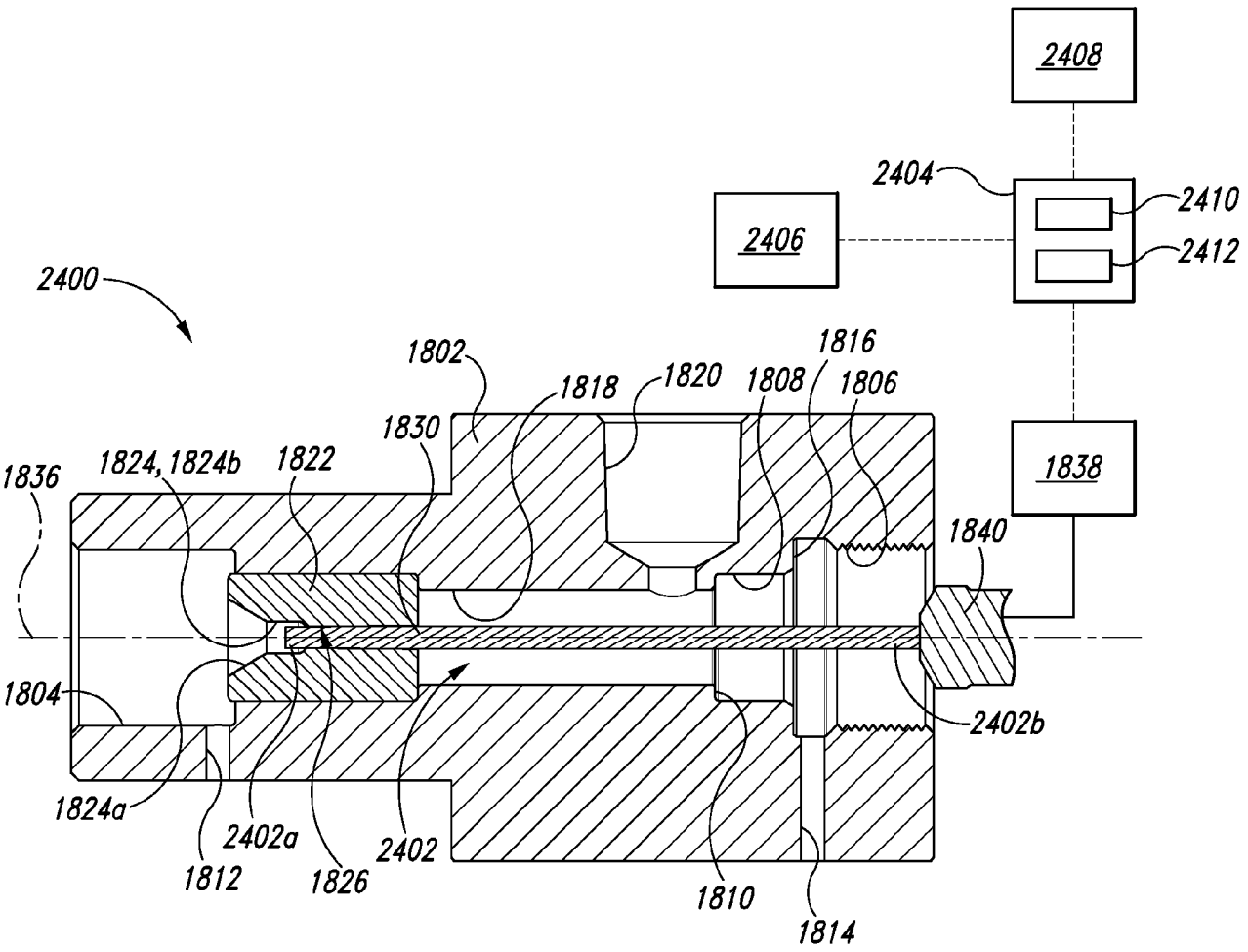
FIG. 24 is a cross-sectional side view illustrating a relief valve configured in accordance with an embodiment of the present technology.

FIG. 24 is a cross-sectional side view illustrating a relief valve 2400 configured in accordance with an embodiment of the present technology. The relief valve 2400 can be generally similar to the relief valve 1800 shown in FIGS. 18A-18C with the flow restrictor 1832 omitted. With reference to FIG. 24, the relief valve 2400 can include an elongate stem 2402 that extends from a first end portion 2402*a* disposed within the seat 1822 to a second end portion 2402*b* abutting the plunger 1840. In some embodiments, only the portion of the stem 2402 that fits within the seat 1822 is tapered. In other embodiments, all or part of the portion of the stem 2402 extending from the seat 1822 to the plunger 1840 can also be tapered. The actuator 1838 can be operably associated with a controller 2404 configured to receive input from a sensor 2406, a user interface 2408, or both. The input from the sensor 2406, for example, can be a detected pressure upstream from the stem 1828. Alternatively or in addition, the controller 2404 can receive, as the input, an indication of an operational state of an associated control valve, an operational state of an associated fluid-pressurizing device, or an operational state of another suitable component of a waterjet system that includes the relief valve 2400. The controller 2404 can include a processor 2410 and memory 2412 and can be programmed with instructions (e.g., non-transitory instructions) that, when executed using the processor 2410, cause a change in operation of the actuator 1838 based at least in part on the received input. For example, the actuator 1838 can be pneumatic, hydraulic, or electric and the controller 2404 can be configured to change, respectively, a pneumatic, hydraulic, or electric feed to the actuator 1838 based on the input.

In at least some cases, generating the input, receiving the input at the controller 2404, and controlling the actuator 1838 in response to the input can occur rapidly enough to allow electronic control to substitute partially or entirely for the functionality of the flow restrictor 1832 shown in FIGS. 18A-18C. For example, electronic control may be used to compensate for the differences in opening and equilibrium pressures described above, such as to maintain the pressure upstream from the stem 2402 at least generally constant as the relief valve 2400 opens. In addition or alternatively, electronic control may be used to automatically compensate for wear on the stem 2402 and/or the seat 1822 and thereby prolong the life of the relief valve 2400. For example, the controller 2404 can be configured to adjust operation of the actuator 1838 based on input from the sensor 2406 that is independent of such wear. Furthermore, the controller 2404 can be occasionally recalibrated (manually or automatically) to account for changes in the operation of the relief valve 2400 due to wear on the stem 2402 and/or the seat 1822.

In at least some embodiments, the controller 2404 is configured to instruct the actuator 1838 to decrease a force applied to the stem 2402 via the plunger 1840 as the relief valve 2400 opens so as to decrease the difference between the pressure of fluid upstream from the relief valve 2400 sufficient to initially open the relief valve 2400 and the pressure of fluid upstream from the relief valve 2400 sufficient to maintain the relief valve 2400 in an open state at equilibrium. The amount by which the controller 2404 instructs the actuator 1838 to decrease the force can be pre-specified and fixed. For example, a pneumatic input to the actuator 1838 can be controlled using a resistance-based pneumatic regulator (not shown) having an inline switching resistor that decreases the force by a set increment (e.g., 5,000 psi) in response to an instruction from the controller 2404 (e.g., corresponding to a "jet-on" condition). Alternatively, this amount can be variable and controllable to allow a user to make adjustments in the field. For example, the amount of the decrease can be controlled using a potentiometer that a user can adjust as needed. In another embodiment, the controller 2404 is configured to instruct the actuator 1838 to decrease the first force by a user-adjustable increment communicated to the controller 2404 via the user interface 2408.

Accordingly, while the flow restrictor 1832 shown in FIGS. 18A-18C is used to hydraulically compensate for a difference between an opening pressure of the relief valve 1800 and an equilibrium pressure of the relief valve 1800, in other embodiments, the flow restrictor 1832 can be absent and electronic control of the relief valve 1800 can compensate for this difference. In still other embodiments, the flow restrictor 1832 can be used as a backup to electronic control of the relief valve 1800. For example, with reference to FIGS. 18A-18C, the cross-sectional area of the second passage 1848 perpendicular to the longitudinal axis 1836 of the stem 1828 can be increased such that the flow restrictor 1832 partially compensates for a difference between an opening pressure of the relief valve 1800 and an equilibrium pressure of the relief valve 1800 when electronic control of the relief valve 1800 is not available.

Selected Examples of Waterjet Systems

Figure 25:
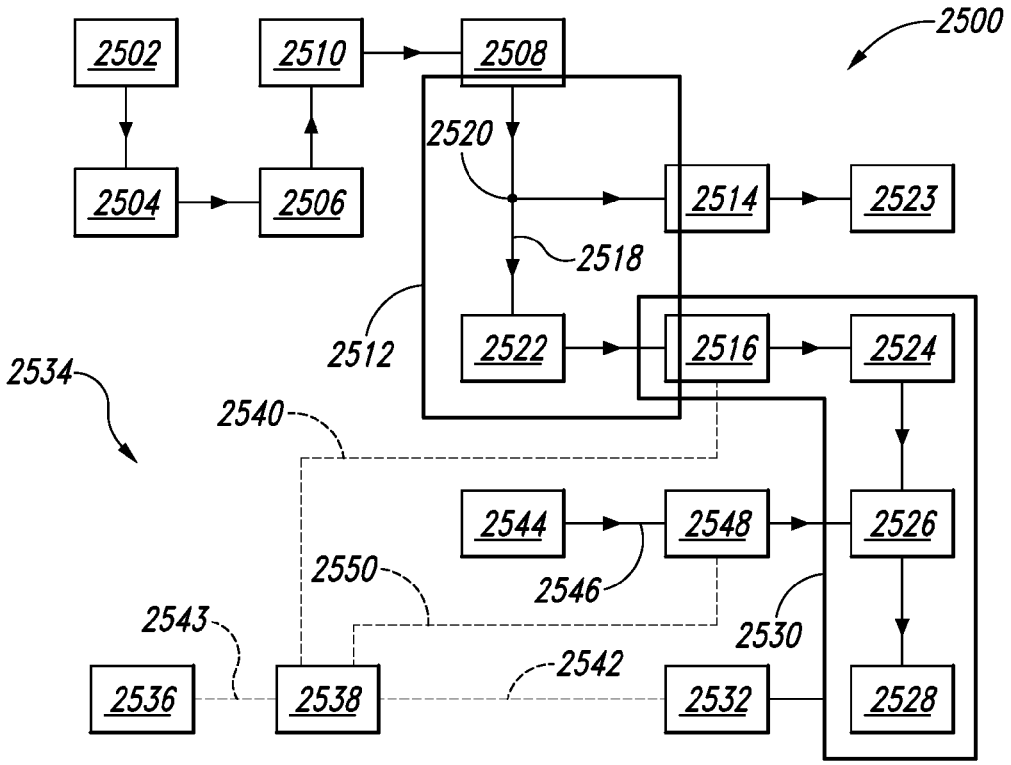
FIGS. 25 and 26 are schematic block diagrams illustrating waterjet systems including control valves configured in accordance with embodiments of the present technology.

FIG. 25 is a schematic block diagram illustrating a waterjet system 2500 configured in accordance with an embodiment of the present technology. The system 2500 can include a fluid inlet 2502, a conditioning unit 2504 downstream from the fluid inlet 2502, and a reservoir 2506 downstream from the conditioning unit 2504. The system 2500 can further include a main fluid-pressurizing device 2508 (e.g., a positive-displacement pump) and a charge fluid-pressurizing device 2510 configured to move fluid from the reservoir 2506 to the main fluid-pressurizing device 2508. The main fluid-pressurizing device 2508 can be configured to pressurize the fluid to a pressure suitable for waterjet processing. The pressure, for example, can be greater than 20,000 psi (e.g., within a range from 20,000 psi to 120,000 psi), greater than 40,000 psi (e.g., within a range from 40,000 psi to 120,000 psi), greater than 50,000 psi (e.g., within a range from 50,000 psi to 120,000 psi), greater than another suitable threshold, or within another suitable range. In the illustrated embodiment, the system 2500 includes a fluid conveyance 2512 operably connected to the main fluid-pressurizing device 2508 as well as to a relief valve 2514 and a control valve 2516 of the system 2500. The fluid conveyance 2512 can include one or more conduits, fittings, housings, vessels, or other suitable components defining an internal volume and configured to hold the fluid at the pressure generated by the main fluid-pressurizing device 2508. For example, the fluid conveyance 2512 can include a fluid conduit 2518 operably positioned between the main fluid-pressurizing device 2508 and the control valve 2516, as well as a junction 2520 and a movable joint 2522 (e.g., a swivel joint) along the fluid conduit 2518. A first portion of a fluid volume within the fluid conveyance 2512 can flow through the junction 2520 to the control valve 2516, and a second portion of the fluid volume can flow through the junction 2520 to a relief outlet 2523 of the system 2500 via the relief valve 2514.

The fluid conveyance 2512 can extend between components of the system 2500 that are typically stationary during operation (e.g., the main fluid-pressurizing device 2508) and components of the system 2500 that typically move during operation (e.g., relative to a workpiece to execute a cut). In at least some embodiments, the fluid conveyance 2512 can span a distance greater than 20 feet (e.g., within a range from 20 feet to 200 feet), greater than 40 feet (e.g., within a range from 40 feet to 200 feet), greater than another suitable threshold, or within another suitable range. To withstand high pressures, components of the fluid conveyance 2512 can be relatively rigid. For example, the fluid conduit 2518 can be a metal pipe with an outer diameter of ⅜ inch and an inner diameter of ⅛ inch. The movable joint 2522 can facilitate a transition from stationary components to movable components in addition to or instead of any flexibility (e.g., play) in the fluid conveyance 2512. Accordingly, the movable joint 2522 can include a high-pressure seal (not shown) that is prone to fatigue-related structural damage due to pressure cycling.

The control valve 2516 can be at least generally similar in structure and/or function to the control valves described above with reference to FIGS. 1A-14B. Similarly, the relief valve 2514 can be at least generally similar in structure and/or function to the relief valves described above with reference to FIGS. 18A-23B. In some embodiments, the control valve 2516 is configured for shutting off flow of the fluid and throttling flow of the fluid. In other embodiments, the control valve 2516 can be configured for throttling flow of the fluid without completely shutting of flow of the fluid. In these embodiments, for example, the control valve 2516 can be used with a separate shutoff valve upstream or downstream from the control valve 2516. A downstream shutoff valve, for example, is described below with reference to FIGS. 28-30.

The relief valve 2514 can be at least generally similar in structure and function to one or more of the relief valves described above with reference to FIGS. 18A-23B. The relief valve 2514 can be configured to automatically vary a flow rate of the second portion of the fluid volume in response to the control valve 2516 varying the flow rate of the first portion of the fluid volume. For example, when the control valve 2516 reduces the flow rate of the first portion of the fluid volume, the relief valve 2514 can be configured to proportionally increase the flow rate of the second portion of the fluid volume such that the pressure of the fluid volume within the fluid conveyance 2512 remains generally constant or decreases. Alternatively, the relief valve 2514 can be eliminated (e.g., when the main fluid-pressurizing device 2508 is a pressure-compensated pump). Together, the control valve 2516 and the relief valve 2514 or the main fluid-pressurizing device 2508 (e.g., when the main fluid-pressurizing device 2508 is a pressure-compensated pump) can cause the pressure within the fluid conveyance 2512 to remain at least generally constant during operation of the system 2500, which can improve the operation and/or prolong the lifespan of the movable joint 2522. In many cases, the system 2500 can include multiple movable joints 2522 or other components adversely affected by pressure cycling. Accordingly, reducing pressure cycling within the fluid conveyance 2512 can significantly reduce the cost-of-ownership the system 2500 by reducing maintenance and/or replacement of these components, among other potential advantages.

The system 2500 can further include an orifice element 2524, a mixing chamber 2526, and a jet outlet 2528, which can be included with the control valve 2516 in a waterjet assembly 2530. The orifice element 2524 and the mixing chamber 2526 can be parts of a cutting head that includes the jet outlet 2528. The system 2500 can include a second actuator 2532 operably connected to the waterjet assembly 2530 and configured to move the waterjet assembly 2530 relative to a workpiece (not shown) during operation of the system 2500. The control valve 2516 can have various suitable positions within the system 2500. In the illustrated embodiment, the control valve 2516 is downstream from the movable joint 2522 and within the waterjet assembly 2530. The second actuator 2532 can be configured to move the waterjet assembly 2530 over an area greater than 10 square feet (e.g., from 10 square feet to 5000 square feet), greater than 22 square feet (e.g., from 20 square feet to 5000 square feet), greater than 50 square feet (e.g., from 50 square feet to 5000 square feet), greater than 100 square feet (e.g., from 100 square feet to 5000 square feet), greater than another suitable threshold area, or within another suitable range of areas. Furthermore, the control valve 2516 can be less than 50 inches (e.g., within a range from 0.5 inch to 50 inches), less than 25 inches (e.g., within a range from 0.5 inch to 25 inches), less than 20 inches (e.g., within a range from 0.5 inch to 20 inches), less than 15 inches (e.g., within a range from 0.5 inch to 15 inches), less than 10 inches (e.g., within a range from 0.5 inch to 10 inches), less than 5 inches (e.g., within a range from 0.5 inch to 5 inches), less than 2 inches (e.g., within a range from 0.5 inch to 2 inches), less than 1 inch (e.g., within a range from 0.5 inch to 1 inch), less than another suitable threshold distance, or within another suitable range of distances from the jet outlet 2528 and/or the workpiece.

The second actuator 2532 can be configured to move the waterjet assembly 2530 along a processing path (e.g., cutting path) in two or three dimensions and, in at least some cases, to tilt the waterjet assembly 2530 relative to the workpiece. The processing path can be predetermined, and operation of the second actuator 2532 can be automated. For example, the system 2500 can include a controller 2534 having a user interface 2536 (e.g., a touch screen) and a controller 2538 with a processor (not shown) and memory (also not shown). The controller 2534 can be operably associated with the control valve 2516 and the second actuator 2532 (e.g., via the controller 2538). The control valve 2516 can be configured to receive one or more first signals 2540 (e.g., electronically communicated data) from the controller 2534 and to vary the flow rate of the fluid passing through the control valve 2516 in response to the first signals 2540 to change the pressure of the fluid upstream from the orifice element 724 and thereby change the velocity of the fluid exiting the jet outlet 2528. Similarly, the second actuator 2532 can be configured to receive one or more second signals 2542 (e.g., electronically communicated data) from the controller 2534 and to move the waterjet assembly 2530 along the processing path in response to the second signals 2542. Furthermore, the controller 2534 can include one or more of the control features described above with reference to FIGS. 14A and 14B.

The user interface 2536 can be configured to receive input from a user and to send data 2543 based on the input to the controller 2538. The input can include, for example, one or more specifications (e.g., coordinates or dimensions) of the processing path and/or one or more specifications (e.g., material type or thickness) of the workpiece. The controller 2534 can be configured to generate the first and second signals 2540, 2542 at least partially based on the data 2543. For example, the controller 2534 can be configured to generate the first signals 2540 at least partially based on a remaining portion of the workpiece after processing is complete (e.g., an inverse of the processing path). In some cases, the remaining portion includes one or more narrow portions (e.g., bridging portions between closely spaced cuts). The controller 2534 can be configured to identify the narrow portions and to instruct the control valve 2516 via the first signals 2540 to reduce the flow rate of the fluid passing through the control valve 2516 and thereby reduce the pressure of the fluid upstream from the orifice element 724 and the velocity of the fluid exiting the jet outlet 2528 at portions of the processing path adjacent to the narrow portions. This can be useful, for example, to reduce the likelihood of the narrow portions breaking due to the impact force of the fluid during the cuts.

The controller 2534 can also be configured to instruct the second actuator 2532 via the second signals 2542 to reduce the rate of movement of the waterjet assembly 2530 along the portions of the processing path adjacent to the narrow portions to compensate for a slower cutting velocity of the jet when the flow rate of the fluid flowing through the control valve 2516 is lowered. Accordingly, the rate of movement of the waterjet assembly 2530 and the flow rate of the fluid flowing through the control valve 2516 can be suitably coordinated to cause an at least generally consistent eroding power along at least a portion of the processing path. Furthermore, the controller 2534 can be configured to instruct the second actuator 2532 via the second signals 2542 to tilt the waterjet assembly 2530 along the portions of the processing path adjacent to the narrow portions (e.g., to reduce taper). Further information concerning using tilt to reduce taper can be found in U.S. Pat. No. 7,035,708, which is incorporated herein by reference in its entirety.

In addition to portions of the processing path adjacent to the narrow portions, other portions of processing paths also may benefit from reduced-velocity jets. For example, some three-dimensional etching applications can include rasterizing a three-dimensional image and cutting a workpiece to different depths as the waterjet assembly 2530 traverses back and forth relative to the workpiece. One approach to controlling the depth is to change the speed of the waterjet assembly 2530 and thereby changing the jet exposure time at different portions of the workpiece. In addition or alternatively, the controller 2534 can be configured to instruct the control valve 2516 via the first signals 2540 to change the flow rate of the fluid passing through the control valve 2516 and thereby change the pressure of the fluid upstream from the orifice element 724 and the velocity of the fluid exiting the jet outlet 2528 to achieve suitable changes in cutting depth for shaping the work piece. Further information concerning three-dimensional etching can be found in U.S. Patent Application Publication No. 2009/0311944, which is incorporated herein by reference in its entirety.

In some cases, the processing path includes two or more spaced-apart cuts individually having a starting point and an ending point. The controller 2534 can be configured to instruct the control valve 2516 via the first signals 2540 to increase the flow rate of the fluid passing through the control valve 2516 and thereby increase the pressure of the fluid upstream from the orifice element 724 and the velocity of the fluid exiting the jet outlet 2528 at the starting points (e.g., in a throttled-piercing operation). Similarly, the controller 2534 can be configured to instruct the control valve 2516 via the first signals 2540 to reduce the flow rate of the fluid passing through the control valve 2516 and thereby reduce the pressure of the fluid upstream from the orifice element 724 and the velocity of the fluid exiting the jet outlet 2528 at the ending points (e.g., in a shut-off operation). Gradually increasing the flow rate of the fluid passing through the control valve 2516 at the starting points can be useful, for example, to reduce the possibility of damaging (e.g., cracking or spalling) the workpiece (e.g., when the workpiece is brittle). In some cases, the starting and ending points for one or more of the spaced-apart cuts individually are at least generally the same (e.g., have at least generally the same coordinates). This can be the case, for example, when the spaced-apart cuts are perimeters of cut-away regions of the workpiece. When many spaced-apart cuts are included in a processing path, and in other cases, it can be useful to shut off a jet rapidly at the end of each cut to improve efficiency. In contrast, as discussed above, it can also be useful to initiate the jet gradually at the beginning of the cut to reduce the possibility of damaging to the workpiece. Accordingly, the controller 2534 can be configured to instruct the control valve 2516 via the first signals 2540 to increase the flow rate of the fluid passing through the control valve 2516 at the starting point at a first rate of change and to decrease the flow rate of the fluid passing through the control valve 2516 at the ending point at a second rate of change greater than the first rate of change. The controller 2534 can be configured to instruct the control valve 2516 via the first signals 2540 to rapidly pulse the flow rate of the fluid passing through the control valve 2516 during piercing, which can also be useful to reduce damage to a workpiece (e.g., workpieces made of brittle and/or composite materials).

The system 2500 can further include an abrasive supply 2544 (e.g., a hopper), an abrasive conduit 2546 operably connecting the abrasive supply 2544 to the mixing chamber 2526, and an abrasive metering valve 2548 along the abrasive conduit 2546. The abrasive conduit 2546 can be flexible or otherwise configured to maintain the connection between the abrasive supply 2544 and the mixing chamber 2526 when the abrasive supply 2544 is stationary and the mixing chamber 2526 is movable with the waterjet assembly 2530. Alternatively, the abrasive supply 2544 can be part of the waterjet assembly 2530. The abrasive metering valve 2548 can be configured to vary the flow rate of abrasive material (e.g., particulate abrasive material) entering the mixing chamber 2526 by a suitable modality (e.g., a supplied vacuum that draws the abrasive material in the mixing chamber 2526, a pressurized feed that pushes the abrasive material into the mixing chamber 2526, or an adjustable abrasive flow passage) alone or in combination with the Venturi effect. Further information concerning abrasive metering valves can be found in U.S. Patent Application Publication No. 2012/0252325 and U.S. Patent Application Publication No. 2012/0252326, which are incorporated herein by reference in their entireties. Alternatively, the abrasive metering valve 2548 can be eliminated. For example, the abrasive material can be drawn into the mixing chamber 2526 by the Venturi effect alone.

The abrasive metering valve 2548 can be operably associated with the controller 2534 (e.g., via the controller 2538). The abrasive supply 2544 can be configured to receive one or more third signals 2550 (e.g., electronically communicated data) from the controller 2534 and to vary the flow rate of abrasive material entering the mixing chamber 2526 in response to the third signals 2550. When the workpiece is brittle, and in other cases, it can be useful to avoid impacting the workpiece with a jet not having entrained abrasive material. A lack of abrasive material at the beginning of a cut, for example, can increase the possibility of damaging the workpiece during piercing. Similarly, a lack of abrasive material at the end of a cut, for example, can increase the possibility of producing an incomplete cut. Accordingly, the controller 2534 can be configured to begin a flow of the abrasive material from the abrasive supply 2544 toward the mixing chamber 2526 a suitable period of time (e.g., 1 second, a period of time within a range from 0.05 to 5 seconds, or a period of time within another suitable range) before the control valve 2516 initiates a throttled-piercing operation and/or to end the flow of the abrasive material from the abrasive supply 2544 toward the mixing chamber 2526 a suitable period of time (e.g., 1 second, a period of time within a range from 0.05 to 5 seconds, or a period of time within another suitable range) after the control valve 2516 completes a shut-off operation. Furthermore, the controller 2534 can be configured to instruct the abrasive metering valve 2548 via the third signals 2550 to change the flow rate of abrasive material entering the mixing chamber 2526 in concert with instructing the control valve 2516 via the first signals 2540 to vary the flow rate of the fluid passing through the control valve 2516 and/or with instructing the second actuator 2532 via the second signals 2542 to reduce the rate of movement of the waterjet assembly 2530 so as to cause an at least generally consistent eroding power along at least a portion of the processing path.

The first, second, and third signals 2540, 2542, 2550 can be accompanied by electronic communication to the controller 2534 (e.g., via the controller 2538) from the control valve 2516, the second actuator 2532, and the abrasive metering valve 2548, respectively. Similarly, the data 2543 can include two-way communication between the user interface 2536 and the controller 2538. When the control valve 2516 includes an actuator having an electric motor (e.g., a stepper motor), the control valve 2516 can be configured to transmit information regarding operation of the motor to the controller 2534. With reference to FIGS. 1A, 1B, and 25 together, as the end portion 136*b* of the pin 136 approaches the contact surface 148, the force on the pin 136 typically decreases gradually and predictably. When the pin 136 reaches the shutoff position, the end portion 136*b* of the pin 136 presses against the contact surface 148 and the force on the pin 136 typically increases abruptly. These changes in the force on the pin 136 can cause corresponding changes in the current drawn by the electric motor. Therefore, by monitoring the current drawn by the electric motor, the controller 2534 can verify that the pin 136 is in the shutoff position. Furthermore, in at least some cases, the relationship between the pressure of the fluid downstream from the first and second seats 102, 104 and the current drawn by the electric motor can have a mathematical correspondence. The controller 2534 can be configured to use this correspondence to determine the pressure of the fluid upstream from the orifice element 724 and the velocity of the fluid exiting the jet outlet 2528 based on the current drawn by the electric motor and to report the results via the user interface 2536.

Figure 26:
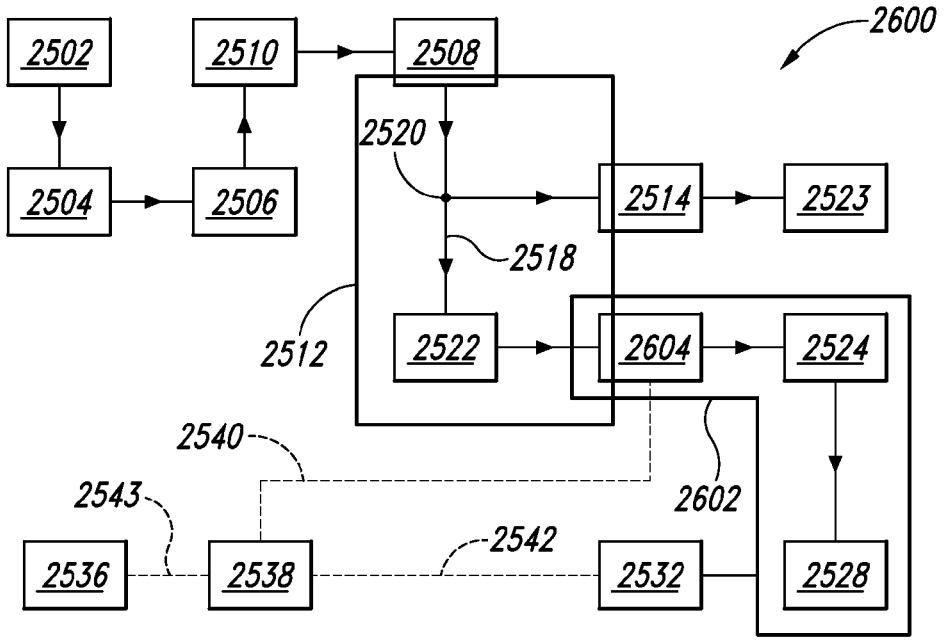

FIG. 26 is a schematic block diagram illustrating a waterjet system 2600 configured in accordance with an embodiment of the present technology. The system 2600 can be similar to the system 2500 shown in FIG. 25, but without the abrasive supply 2544, the abrasive conduit 2546, and the abrasive metering valve 2548. The system 2600 can also include a waterjet assembly 2602 having a control valve 2604 different than the control valve 2516 of the system 2500 shown in FIG. 25. The control valve 2604 can be configured for throttling without complete shut off. For example, the control valve 2604 can include the seat 200 shown in FIG. 2. In some cases, complete shut off of fluid exiting the jet outlet 2528 may be unnecessary. For example, with reference to FIG. 25, it can be undesirable to allow low-pressure fluid to pass through the mixing chamber 2526, because it can wet abrasive material within the abrasive conduit 2546 and cause clogging. With reference again to FIG. 26, when the system 2600 is not configured for use of abrasive material, this advantage of complete shut off may not apply. Accordingly, fluid may trickle from the jet outlet 2528 at a velocity insufficient to erode the workpiece when the system 2600 is on standby or between cutting portions of a processing path.

Figure 27:
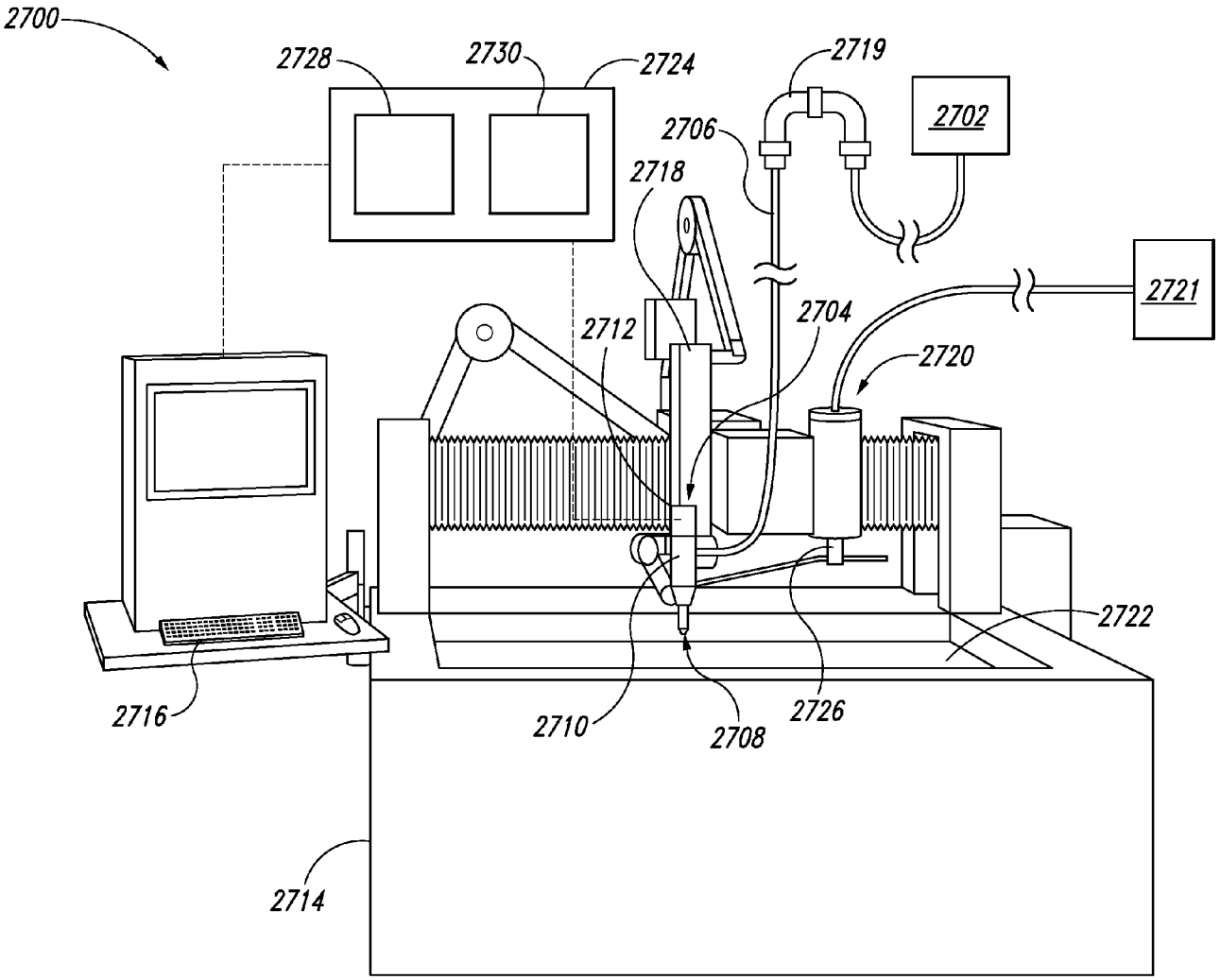
FIG. 27 is a perspective view illustrating a waterjet system including a control valve configured in accordance with an embodiment of the present technology.

FIG. 27 is a perspective view illustrating a waterjet system 2700 configured in accordance with an embodiment of the present technology. The system 2700 can include a fluid-pressurizing device 2702 (shown schematically) (e.g., a pump) configured to pressurize a fluid to a pressure suitable for waterjet processing, and a waterjet assembly 2704 operably connected to the fluid-pressurizing device 2702 via a conduit 2706 extending between the fluid-pressurizing device 2702 and the waterjet assembly 2704. The waterjet assembly 2704 can include a jet outlet 2708 and a control valve 2710 upstream from the jet outlet 2708. The control valve 2710 can be at least generally similar in structure and/or function to the control valves described above with reference to FIGS. 1A-14B. For example, the control valve 2710 can be configured to receive fluid from the fluid-pressurizing device 2702 via the conduit 2706 at a pressure suitable for waterjet processing (e.g., a pressure greater than 30,000 psi) and to selectively reduce the pressure of the fluid (e.g., to two or more different steady-state pressures within a range from 1,000 psi to 25,000 psi) as the fluid flows through the control valve 2710 toward the jet outlet 2708. For example, the control valve 2710 can include a first actuator 2712 configured to control the position of a pin (not shown) within the control valve 2710 and thereby selectively reduce the pressure of the fluid.

The system 2700 can further include a base 2714, a user interface 2716 supported by the base 2714, and a second actuator 2718 configured to move the waterjet assembly 2704 relative to the base 2714 and other stationary components of the system 2700 (e.g., the fluid-pressurizing device 2702). For example, the second actuator 2718 can be configured to move the waterjet assembly 2704 along a processing path (e.g., cutting path) in two or three dimensions and, in at least some cases, to tilt the waterjet assembly 2704 relative to the base 2714. The conduit 2706 can include a joint 2719 (e.g., a swivel joint or another suitable joint having two or more degrees of freedom) configured to facilitate movement of the waterjet assembly 2704 relative to the base 2714. Thus, the waterjet assembly 2704 can be configured to direct a jet including the fluid toward a workpiece (not shown) supported by the base 2714 (e.g., held in a jig supported by the base 2714) and to move relative to the base 2714 while directing the jet toward the workpiece.

The system 2700 can further include an abrasive-delivery apparatus 2720 configured to feed particulate abrasive material from an abrasive material source 2721 to the waterjet assembly 2704 (e.g., partially or entirely in response to a Venturi effect associated with a fluid jet passing through the waterjet assembly 2704). Within the waterjet assembly 2704, the particulate abrasive material can accelerate with the jet before being directed toward the workpiece. In some embodiments the abrasive-delivery apparatus 2720 is configured to move with the waterjet assembly 2704 relative to the base 2714. In other embodiments, the abrasive-delivery apparatus 2720 can be configured to be stationary while the waterjet assembly 2704 moves relative to the base 2714. The base 2714 can include a diffusing tray 2722 configured to hold a pool of fluid positioned relative to the jig so as to diffuse kinetic energy of the jet from the waterjet assembly 2704 after the jet passes through the workpiece. The system 2700 can also include a controller 2724 (shown schematically) operably connected to the user interface 2716, the first actuator 2712, and the second actuator 2718. In some embodiments, the controller 2724 is also operably connected to an abrasive-metering valve 2726 (shown schematically) of the abrasive-delivery apparatus 2720. In other embodiments, the abrasive-delivery apparatus 2720 can be without the abrasive-metering valve 2726 or the abrasive-metering valve 2726 can be configured for use without being operably associated with the controller 2724. The controller 2724 can include a processor 2728 and memory 2730 and can be programmed with instructions (e.g., non-transitory instructions contained on a computer-readable medium) that, when executed, control operation of the system 2700.

Figure 28:
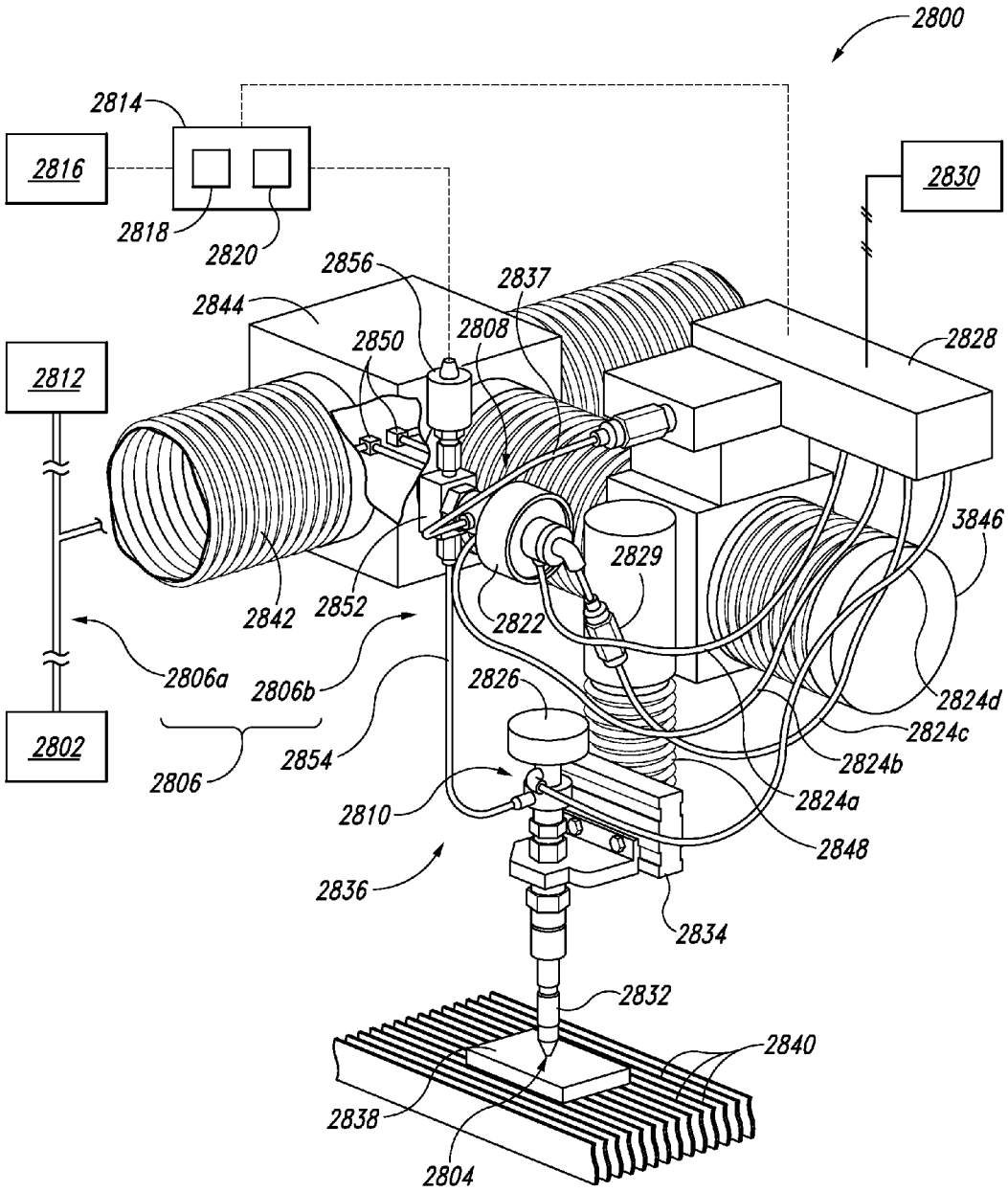
FIG. 28 is a perspective view illustrating a waterjet system including a control valve and a shutoff valve configured in accordance with an embodiment of the present technology.

FIG. 28 is a perspective view illustrating a waterjet system 2800 configured in accordance with an embodiment of the present technology. The system 2800 can include a fluid source 2802, a jet outlet 2804, and a fluid conveyance 2806 extending therebetween. The fluid source 2802, for example, can include a pump, a reservoir, or another suitable component for supplying the fluid at high pressure. The fluid conveyance 2806, for example, can include a conduits, joints, valves, intermediate reservoirs, fittings, and other structures that collectively allow for movement of fluid from the fluid source 2802 to the jet outlet 2804. The system 2800 can further include a control valve 2808 positioned along the fluid conveyance 2806 downstream from the fluid source 2802 and upstream from the jet outlet 2804 as well as a shutoff valve 2810 downstream from the control valve 2808 and upstream from the jet outlet 2804. The fluid conveyance 2806 can include a first portion **2806*a* upstream from the control valve 2808 and a second portion 2806*b* downstream from the control valve 2808. The first portion 2806*a* of the fluid conveyance 2806 can define a first flowpath extending from the fluid source 2802 to the control valve 2808. The second portion 2806*b* of the fluid conveyance 2806 can define a second flowpath extending from the control valve 2808 to the jet outlet 2804**. The first flowpath can be longer than the second flowpath. For example, the length of the first flowpath can be at least twice, at least 5 times, at least 10 times, or at least another suitable multiple of the length of the second flowpath.

The control valve 2808 can be configured to controllably reduce a pressure of fluid within the second portion **2806*b* of the fluid conveyance 2806 relative to a pressure of fluid within the first portion 2806*a* of the fluid conveyance 2806, such as to two or more different pressures including a maximum pressure and a reduced pressure. In some embodiments, the control valve 2808 is configured to controllably reduce the pressure of fluid within the second portion 2806*b* of the fluid conveyance 2806 with infinite or fine incremental variability within a range of pressures. In other embodiments, the control valve 2808 can be configured to controllably reduce the pressure of fluid within the second portion 2806*b* of the fluid conveyance 2806 to a single reduced pressure or to multiple reduced pressures with coarse increment variability. The shutoff valve 2810 can be configured to shut off the flow of the fluid toward the jet outlet 2804. The system 2800 can further include a relief valve 2812 operably connected to the fluid conveyance 2806 downstream from the fluid source 2802 and upstream from the control valve 2808. The relief valve 2812, for example, can be configured to automatically vary a flow rate of fluid exiting the fluid conveyance 2806 in response to the control valve 2808 controllably reducing the pressure of fluid within the second portion 2806***b* of the fluid conveyance 2806. The system 2800 can further include a controller 2814 configured to control operation of the control valve 2808, the relief valve 2812, and/or the shutoff valve 2810 using one or more feedback control loops, in response to input from a user communicated via a user interface 2816, and/or in response to an indication of an operational state of another component within the system 2800. The controller 2814 can include a processor 2818 and memory 2820 and can be programmed with instructions (e.g., non-transitory instructions) that, when executed using the processor 2818, cause a change in operation of the control valve 2808, the relief valve 2812, and/or the shutoff valve 2810 based at least in part on the received input.

Any of the control valves, relief valves, actuators, controllers, or other waterjet system components described herein can be substituted for corresponding components shown in FIG. 28 as appropriate depending on the application. In the illustrated embodiment, the control valve 2808 includes a first actuator 2822 connected to three pneumatic lines 2824 (individually identified as 2824*a-c*) and the shutoff valve 2810 includes a second actuator 2826 operably connected to one pneumatic line 2824*d*. In other embodiments, one or both of the first and second actuators 2822, 2826 can be non-pneumatic or can have other suitable numbers of connections to pneumatic inputs. The pneumatic lines 2824*a-d* can converge at a hub 2828 operably connected to a pneumatic source 2830. The individual pneumatic lines 2824*a-d* can be connected to a primary pneumatic regulator (not shown) disposed within the hub 2828 and operably associated with the controller 2814. In the illustrated embodiment, a secondary regulator 2829 is disposed along the pneumatic line 2824*c* between the hub 2828 and the first actuator 2822. The secondary regulator 2829, for example, can be one-way restriction valve configured to provide a rapid pneumatic feed and a slow pneumatic release, as discussed in further detail below with reference to FIG. 29. In other embodiments, the secondary regulator 2829 can be absent or its functionality combined with a corresponding primary pneumatic regulator within the hub 2828.

The jet outlet 2804 can be at the end of a cutting head 2832 mounted to a block 2834. The control valve 2808, the second portion 2806*b* of the fluid conveyance 2806, the shutoff valve 2810, the block 2834, the cutting head 2832, and the jet outlet 2804 can be included in a waterjet assembly 2836 that is movable relative to stationary components of the system 2800. The waterjet assembly 2836 can further include a u-shaped conduit segment 2837 that is part of the first portion 2806*a* of the fluid conveyance 2806. In at least some embodiments, the fluid source 2802 is stationary and the waterjet assembly 2836 is movable relative to the fluid source 2802. The waterjet assembly 2836 can also be configured to move relative to a stationary workpiece 2838 supported on a series of stationary slats 2840 above a catcher (e.g., a tank containing fluid). In the illustrated embodiment, the waterjet assembly 2836 is movable relative to stationary components of the system 2800 and the workpiece 2838 along a first accordion track 2842 aligned with an x-axis and along a second accordion track 2846 aligned with a y-axis. The first accordion track 2842 can be supported between uprights (not shown) on opposite sides of the catcher and the second accordion track 2846 can be cantilevered from an intermediate junction 2844 along the first accordion track. The waterjet assembly 2836 can further include a z-axis joint 2848 that can be elongated or shortened to move the jet outlet 2804 and nearby portions of the waterjet assembly 2836 relative to other portions of the waterjet assembly 2836. In other embodiments, the waterjet assembly 2836 and portions thereof can be movable in another suitable manner, such as by another suitable mechanism that causes the jet outlet 2804 to be more or less maneuverable than in the illustrated embodiment. For example, in some embodiments, the jet outlet 2804 and nearby portions of the waterjet assembly 2836 are configured to tilt and/or swivel relative to other portions of the waterjet assembly 2836. As another example, the z-axis joint 2848 can be eliminated and the jet outlet 2804 can be movable in unison with the waterjet assembly 2836 in the x-axis and the y-axis only.

The first portion 2806*a* of the fluid conveyance 2806 can extend through the first and second accordion tracks 2842, 2846 and can be configured to accommodate movement of the jet outlet 2804 relative to stationary components of the system 2800 and the workpiece 2838. For example, the first portion 2806*a* of the fluid conveyance 2806 can include joints 2850 (e.g., swivel joints) (two shown in FIG. 28) that rotate, flex, or otherwise move as the waterjet assembly 2836 moves along the x-axis and/or the y-axis. In addition or alternatively, the first portion 2806*a* of the fluid conveyance 2806 can be at least partially flexible. As discussed above, in the context of waterjet systems, joints and flexible conduits tend to be susceptible to damage from fatigue associated with pressure cycling. Coordinated operation of the control valve 2808 and the relief valve 2812 can reduce or prevent this cycling and thereby prolong the operational life of the first portion 2806*a* of the fluid conveyance 2806.

In the illustrated embodiment, the second portion 2806*b* of the fluid conveyance 2806 is downstream from the control valve 2808. This can cause the second portion 2806*b* of the fluid conveyance 2806 to be subjected to pressure cycling to a greater extent that the first portion 2806*a* of the fluid conveyance 2806. In at least some embodiments, the second portion 2806*b* of the fluid conveyance 2806 includes one or more features that reduce or prevent damage associated with this pressure cycling. For example, the second portion 2806*b* of the fluid conveyance 2806 can have a greater average pressure rating than the first portion 2806*a* of the fluid conveyance 2806, such as an average pressure rating at least 50%, at least 100%, or at least 200% greater than the average pressure rating of the first portion 2806*a* of the fluid conveyance 2806. Furthermore, the second portion 2806*b* of the fluid conveyance 2806 can have a greater average fatigue resistance than the first portion 2806*a* of the fluid conveyance 2806, such as an average fatigue resistance at least 50%, at least 100%, or at least 200% greater than the average fatigue resistance of the first portion 2806*a* of the fluid conveyance 2806.

The second portion 2806*b* of the fluid conveyance 2806 for example, can be rigid, without movable joints, and/or mostly or entirely made of tubing having specifications (e.g., material type, wall thickness, etc.) selected to enhance fatigue resistance. In the illustrated embodiment, the system 2800 includes a tee junction 2852 downstream from the control valve 2808, a fatigue resistant conduit segment 2854 operably connected to one leg of the tee junction 2852, and a pressure transducer 2856 (shown without internal detail for clarity) operably connected to the opposite leg of the tee junction 2852. The conduit segment 2854 can form an elbow and extend to the shutoff valve 2810. In other embodiments, the second portion 2806*b* of the fluid conveyance 2806 can have another suitable form between the control valve 2808 and the shutoff valve 2810. The controller 2814 can be configured to receive a detected fluid pressure downstream from the control valve 2808 from the pressure transducer 2856 as input and to use the input in a feedback control loop. Alternatively or in addition, the controller 2814 can communicate input from the pressure transducer 2856 to the user interface 2816 for communication to a user. A user can use information from the pressure transducer 2856, for example, to readily determine the relative eroding power of a jet exiting the jet outlet 2804 in real time or near real time.

Figure 29:
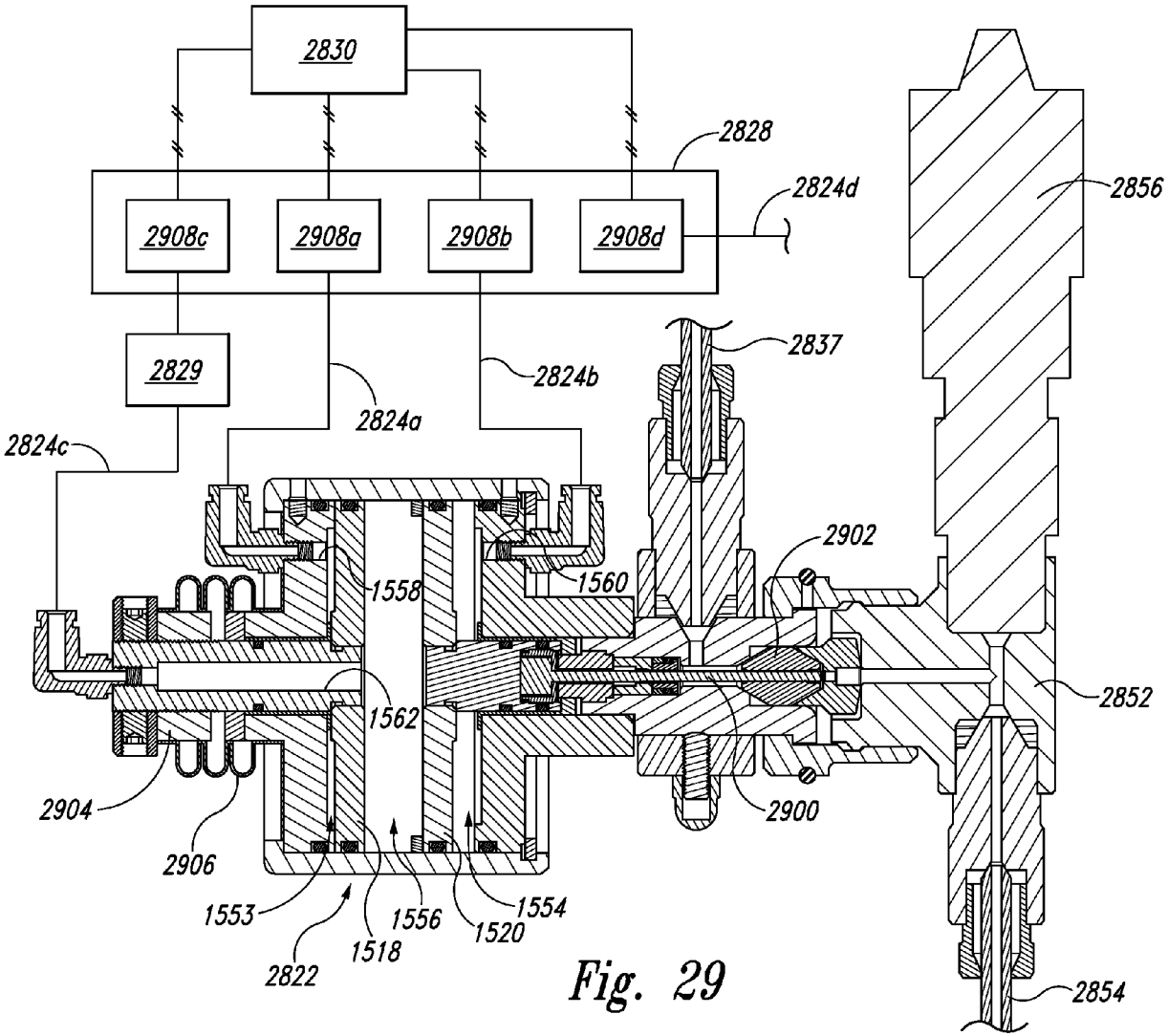
FIG. 29 is a cross-sectional side view illustrating the control valve shown in FIG. 28.
Figure 30:
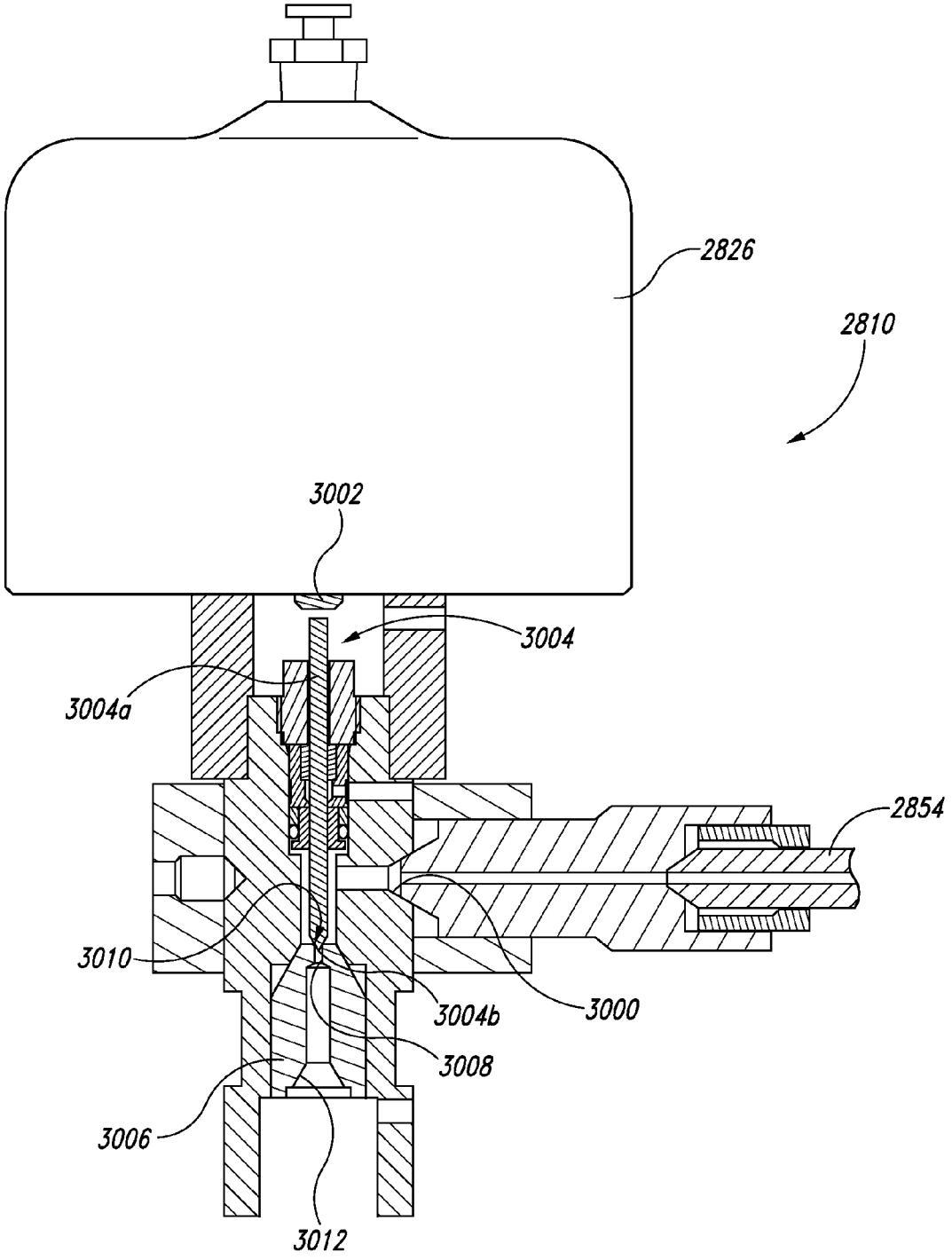
FIG. 30 is a cross-sectional side view illustrating the shutoff valve shown in FIG. 28.

FIGS. 29 and 30 are cross-sectional side views illustrating, respectively, the control valve 2808 and the shutoff valve 2810. Certain components of the control valve 2808 are rotated in FIG. 29 relative to their positions in FIG. 28 for clarity of illustration. As shown in FIG. 29, the first actuator 2822 can be generally similar to the actuator 1502 shown in FIGS. 15A-15C. In contrast to the actuator 1502 shown in FIGS. 15A-15C, however, the first actuator 2822 in the illustrated embodiment includes a spacer ring 2904 positioned around the first plunger 1522 adjacent to a side of the stop 1570 facing the first plunger guide 1526. This can allow a gap between the stop 1570 and the first plunger guide 1526 to be repositioned away from the stop 1570 and fitted within an accordion jacket 2906 secured at one end to the spacer ring 2904 and secured at the opposite end to the first plunger guide 1526.

The first actuator 2822 can be operably connected to a pin 2900 similar to the pin 302 shown in FIG. 3. The pin 2900 can be operably associated with a seat 2902 similar to the first and second seats 102, 104 shown in FIG. 1B if the second passage 146 of the second seat 102 were widened at the contact surface 148 and the channel 156. Certain portions of the control valve 2808 in the vicinity of the pin 2900 and the seat 2902 can be generally similar to similarly situated portions of the control valve 100 shown in FIG. 1. The first actuator 2822 can be configured to move the pin 2900 relative to the seat 2902 to change a spacing between the pin 2900 and the seat 2902 and thereby change an operational state of the control valve 2808. For example, the pin 2900 and the seat 2902 can be spaced apart a first distance when the control valve 2808 is in an open state at which the pressure of fluid downstream from the control valve 2808 is at a maximum pressure (e.g., well suited for cutting) and spaced apart a second, lesser distance when the control valve 2808 is in a throttling state at which the pressure of the fluid downstream from the control valve 2808 is at a reduced pressure (e.g., well suited for piercing). In the illustrated embodiment, the control valve 2808 is configured for throttling functionality without shut-off functionality. In other embodiments, the control valve 2808 can be configured for both throttling and shut-off functionality. In these embodiments, for example, the shutoff valve 2810 may be at least partially redundant.

As shown in FIG. 29, the pneumatic lines 2824*a*, 2824*b*, 2824*c*, 2824*d* can be operably connected to primary regulators 2908*a*, 2908*b*, 2908*c*, 2908*d*, respectively, disposed within the hub 2828. The primary regulators 2908*a*, 2908*b*, 2908*c* can be used to control the pneumatic pressures provided to the first pneumatic port 1558, the second pneumatic port 1560, and the third pneumatic port 1562, respectively, of the first actuator 2822. The secondary regulator 2829 can be positioned along the pneumatic line 2824*c* between the primary regulator 2908*c* and the third elbow fitting 1568. When the shutoff valve 2810 is first opened, if the control valve 2808 is in the throttling state, the pressure at the jet outlet 2804 may briefly spike before stabilizing at a steady-state pressure. The secondary regulator 2829 can be configured to reduce or eliminate this spike. By way of theory and without intending to limit the scope of the present technology, pressure spikes that occur when the shutoff valve 2810 is initially opened and the control valve 2808 is in the throttling state may be associated with the volume of fluid held between the control valve 2808 and the shutoff valve 2810. The pressure downstream from the control valve 2808 when shutoff valve 2810 is first opened, however, is also a function of the flowrate through the control valve 2808. Reduced flowrate through the control valve 2808 and increased fluid volume between the control valve 2808 and the shutoff valve 2810 have opposite effects on the pressure downstream from the control valve 2808 when the shutoff valve 2810 is first opened. Thus, gradually moving the pin 2900 either from its closed position to its throttling position or from a position between its closed position and its throttling position to its throttling position after the shutoff valve 2810 is initially opened can at least partially compensate for the effect of the volume of fluid held between the control valve 2808 and the shutoff valve 2810 and thereby reduce or prevent undesirable pressure spiking.

In the illustrated embodiment, the secondary regulator 2829 allows for unrestricted flow of pneumatic pressure into the third pneumatic port 1562 so as to allow the third space 1556 to be pressurized rapidly thereby allowing the first actuator 2822 to move from the throttle position to the closed position rapidly. The secondary regulator 2829 also restricts flow of pneumatic pressure out of the third pneumatic port 1562 so as to cause the third space 1556 to be depressurized slowly thereby causing the first actuator 2822 to move the control valve 2808 from the close state to the throttle state slowly. In other embodiments, the secondary regulator 2829 can be eliminated and the primary regulator 2908*c* can be electronically controlled to cause depressurization of the third space 1556 at a controlled rate.

Downstream from the seat 2902, the conduit segment 2854 can be coupled to the tee junction 2852 at one end and to an inlet 3000 of the shutoff valve 2810 at the opposite end. The second actuator 2826 (shown without internal detail for clarity) can include a plunger 3002 and the shutoff valve 2810 can include a pin 3004 with a straight shaft 3004*a* and a pointed end portion 3004*b* in line with the plunger 3002. The shutoff valve 2810 can further include a seat 3006 complementary to the pin 3004. When the primary regulator 2908*d* increases pressure within the pneumatic line 2824*d*, the second actuator 2826 can drive the pin 3004 toward the seat 3006. The seat 3006 can include a narrow channel 3008 with a rim 3010 that contacts the end portion 3004*b* of the pin 3004 when the shutoff valve 2810 is closed. The surface area of a contact interface between rim 3010 and the end portion 3004*b* of the pin 3004 can be relatively small, which can facilitate sealing. When the primary regulator 2908*d* decreases pressure within the pneumatic line 2824*d*, the second actuator 2826 can release the pin 3004, thereby allowing unrestricted flow of fluid to exit the shutoff valve 2810 via an outlet 3012.

With reference again to FIG. 28, after exiting the shutoff valve 2810, fluid within the second portion 2806*b* of the fluid conveyance 2806 can flow through the cutting head 2832. The cutting head 2832 can include an orifice element (not shown) having an orifice configured to convert static pressure of the fluid into kinetic energy. The fluid can exit the cutting head 2832 via the jet outlet 2804 as a jet and impact the workpiece 2838. In some embodiments, the cutting head 2832 includes a mixing chamber (not shown) similar to the mixing chamber 2526 described above with reference to FIG. 25. In other embodiments, the cutting head 2832 can be without a mixing chamber. Furthermore, although the waterjet assembly 2836 is shown in FIG. 28 having a single cutting head 2832, in other embodiments, the waterjet assembly 2836 can include additional cutting heads, such as additional cutting heads mounted to the block 2834. Additional cutting heads can be served by the same control valve 2808 and shutoff valve 2810 as the cutting head 2832 or different control valves and/or shutoff valves, such as a separate, independently controllable control valve and/or shutoff valve for each additional cutting head.

CONCLUSION

This disclosure is not intended to be exhaustive or to limit the present technology to the precise forms disclosed herein. Although specific embodiments are disclosed herein for illustrative purposes, various equivalent modifications are possible without deviating from the present technology, as those of ordinary skill in the relevant art will recognize. For example, in the control valves discussed above, the pins can be stationary and the associated seats can be movable or both the pins and the seats can be movable to change the flow rate of fluid passing through the control valves. Similarly, in the relief valves discussed above, the stems can be stationary and the associated seats can be movable or both the stems and the seats can be movable. In some cases, well-known structures and functions have not been shown or described in detail to avoid unnecessarily obscuring the description of the embodiments of the present technology. Although steps of methods may be presented herein in a particular order, in alternative embodiments the steps may have another suitable order. Similarly, certain aspects of the present technology disclosed in the context of particular embodiments can be combined or eliminated in other embodiments. Furthermore, while advantages associated with certain embodiments may have been disclosed in the context of those embodiments, other embodiments can also exhibit such advantages, and not all embodiments need necessarily exhibit such advantages or other advantages disclosed herein to fall within the scope of the present technology. Accordingly, this disclosure and associated technology can encompass other embodiments not expressly shown or described herein.

Certain aspects of the present technology may take the form of computer-executable instructions, including routines executed by a controller or other data processor. In at least some embodiments, a controller or other data processor is specifically programmed, configured, and/or constructed to perform one or more of these computer-executable instructions. Furthermore, some aspects of the present technology may take the form of data (e.g., non-transitory data) stored or distributed on computer-readable media, including magnetic or optically readable and/or removable computer discs as well as media distributed electronically over networks. Accordingly, data structures and transmissions of data particular to aspects of the present technology are encompassed within the scope of the present technology. The present technology also encompasses methods of both programming computer-readable media to perform particular steps and executing the steps.

The methods disclosed herein include and encompass, in addition to methods of practicing the present technology (e.g., methods of making and using the disclosed devices and systems), methods of instructing others to practice the present technology. For example, a method in accordance with a particular embodiment includes pressurizing a fluid within an internal volume of a fluid conveyance to a pressure greater than 25,000 psi, directing the pressurized fluid through a control valve operably connected to the fluid conveyance, varying a flow rate of the fluid by throttling the fluid between a shaft portion of a pin and a tapered inner surface of a seat, and impacting the fluid against a workpiece after varying the flow rate of the fluid. A method in accordance with another embodiment includes instructing such a method.

Throughout this disclosure, the singular terms "a," "an," and "the" include plural referents unless the context clearly indicates otherwise. Similarly, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Additionally, the terms "comprising" and the like are used throughout this disclosure to mean including at least the recited feature(s) such that any greater number of the same feature(s) and/or one or more additional types of features are not precluded. Directional terms, such as "upper," "lower," "front," "back," "vertical," and "horizontal," may be used herein to express and clarify the relationship between various elements. It should be understood that such terms do not denote absolute orientation. Reference herein to "one embodiment," "an embodiment," or similar formulations means that a particular feature, structure, operation, or characteristic described in connection with the embodiment can be included in at least one embodiment of the present technology. Thus, the appearances of such phrases or formulations herein are not necessarily all referring to the same embodiment. Furthermore, various particular features, structures, operations, or characteristics may be combined in any suitable manner in one or more embodiments.

We claim:

1. A method for operating a waterjet system, comprising:

pressurizing a fluid at a hydraulic intensifier;

conveying the fluid within a first fluid conveyance of a waterjet system, the first fluid conveyance defining a first flowpath extending from the intensifier to a control valve of the waterjet system and containing a first portion of the fluid at a given time;

conveying the fluid within a second fluid conveyance of the waterjet system, the second fluid conveyance defining a second flowpath extending from the control valve to a jet outlet of the waterjet system and containing a second portion of the fluid at the given time, the second flowpath being shorter than the first flowpath;

moving a pin of the control valve automatically by an actuator relative to a seat of the control valve, the seat relative to the pin, or both to selectively throttle the fluid between the seat and the pin and thereby controllably reduce the pressure of the second portion of the fluid relative to the pressure of the first portion of the fluid;

directing a jet including fluid from the second portion of the fluid toward a workpiece to erode a portion of the workpiece; and automatically operating the intensifier in concert with the control valve to automatically regulate the pressure of the first portion of the fluid.

2. The method of claim 1 wherein the first flowpath is at least twice as long as the second flowpath.

3. The method of claim 1 wherein:

the waterjet system includes a shutoff valve downstream from the control valve and upstream from the jet outlet; and the method further comprises using the shutoff valve to discontinue flow of the fluid toward the jet outlet.

4. The method of claim 1 wherein controllably reducing the pressure of the second portion of the fluid includes controllably reducing the pressure of the second portion of the fluid to two or more different steady-state pressures within a range from 1,000 psi to 25,000 psi.

5. The method of claim 1, further comprising moving a waterjet assembly relative to the intensifier, the waterjet assembly including the control valve and the jet outlet.

6. The method of claim 5 wherein moving the waterjet assembly includes operating a joint positioned along the first fluid conveyance, the joint including a high-pressure seal.

7. The method of claim 1 wherein controllably reducing the pressure of the second portion of the fluid includes controllably reducing the pressure of the second portion of the fluid from a first steady-state pressure to a second steady-state pressure.

8. The method of claim 7 wherein selectively throttling the fluid includes:

changing a spacing between the seat and the pin from a first spacing to a second spacing using the actuator, wherein a hydraulic force from fluid within the control valve acts against a piston of the actuator in a first direction, force acting against the piston in the first direction tends to increase the spacing, and force acting against the piston in a second direction opposite to the first direction tends to decrease the spacing; and increasing a stability of the second spacing by counteracting a change in the hydraulic force, the change in the hydraulic force occurring along a hydraulic force gradient along which increasing the spacing increases the hydraulic force and decreasing the spacing decreases the hydraulic force.

9. The method of claim 7 wherein:

the seat is a first seat; and the method further comprises pressing an end portion of the pin against a contact surface of a second seat of the control valve to discontinue flow of the fluid through the control valve.

10. The method of claim 9 wherein:

selectively throttling the fluid between the seat and the pin includes selectively throttling the fluid between a tapered inner surface of the seat and a complementary outer surface of the pin; and the method further comprises eroding the contact surface and the tapered inner surface at rates that are at least generally the same.

11. The method of claim 1, wherein:

the jet is a first jet;

directing the first jet includes directing the first jet to pierce the workpiece;

the method further comprises immediately after directing the first jet, controllably increasing the pressure of the fluid conveyed within the second portion of the fluid conveyance, and immediately after increasing the pressure, directing a second jet including fluid from the second portion of the fluid conveyance from the jet outlet toward the workpiece; and moving a waterjet assembly while directing the second jet to cut the workpiece along a cutting path that extends away from a location at which the workpiece was pierced, wherein the waterjet assembly includes the control valve and the jet outlet.

12. The method of claim 11 wherein the first flowpath is at least twice as long as the second flowpath.

13. The method of claim 11 wherein:

the waterjet assembly includes a shutoff valve downstream from the control valve and upstream from the jet outlet; and the method further comprises using the shutoff valve to discontinue flow of the fluid toward the jet outlet after directing the second jet.

14. The method of claim 11, further comprising:

detecting a pressure of the fluid conveyed within the second portion of the fluid conveyance; and displaying the detected pressure.

15. The method of claim 11 wherein controllably reducing the pressure of the fluid conveyed within the second portion of the fluid conveyance includes controllably reducing the pressure of the fluid conveyed within the second portion of the fluid conveyance to two or more different steady-state pressures within a range from 1,000 psi to 25,000 psi.

16. The method of claim 11 further comprising using a feedback control loop to change a force by which the actuator moves the pin relative to the seat, the seat relative to the pin, or both so as to stabilize movement between the pin and the seat.

17. The method of claim 16 wherein stabilizing movement between the pin and the seat includes increasing a positional stability of the pin relative to the seat while the pin is at a selected throttling position within a range of selectable throttling positions.

18. The method of claim 16, further comprising detecting a pressure of the fluid conveyed within the second portion of the fluid conveyance, wherein using the feedback control loop includes using the feedback loop to change the force based on the detected pressure.

19. The method of claim 16, further comprising detecting a position of the pin and/or of a structure that moves in concert with the pin, wherein using the feedback control loop includes using the feedback loop to change the force based on the detected position.

20. The method of claim 16 wherein:

the force is a first force;

the method further comprises detecting a second force exerted against the pin by the fluid; and using the feedback control loop includes using the feedback loop to change the first force based on the detected second force.

21. The method of claim 16 wherein:

the method further comprises detecting a pneumatic pressure at a first side of a piston of the actuator, the piston being operably connected to the pin; and using the feedback control loop includes using the feedback loop to change a pneumatic pressure at a second side of the piston based on the detected pneumatic pressure.

22. The method of claim 21 wherein:

force exerted against the first side of the piston tends to close the control valve; and force exerted against the second side of the piston tends to open the control valve.

23. The method of claim 11 wherein moving the waterjet assembly includes operating a joint positioned along the fluid conveyance, the joint including a high-pressure seal.

24. The method of claim 11 wherein selectively throttling the fluid includes:

changing a spacing between the seat and the pin from a first spacing to a second spacing using the actuator, wherein a hydraulic force from fluid within the control valve acts against a piston of the actuator in a first direction, force acting against the piston in the first direction tends to increase the spacing, and force acting against the piston in a second direction opposite to the first direction tends to decrease the spacing; and increasing a stability of the second spacing by counteracting a change in the hydraulic force, the change in the hydraulic force occurring along a hydraulic force gradient along which increasing the spacing increases the hydraulic force and decreasing the spacing decreases the hydraulic force.

25. The method of claim 24 wherein:

the seat is a first seat; and the method further comprises pressing an end portion of the pin against a contact surface of a second seat of the control valve to discontinue flow of the fluid through the control valve.

26. The method of claim 25 wherein:

selectively throttling the fluid between the seat and the pin includes selectively throttling the fluid between a tapered inner surface of the seat and a complementary outer surface of the pin; and the method further comprises eroding the contact surface and the tapered inner surface at rates that are at least generally the same.

27. The method of claim 1 wherein pressurizing the fluid includes pressurizing the fluid to a pressure within a range from 20,000 psi to 120,000 psi.

28. The method of claim 11 wherein pressurizing the fluid includes pressurizing the fluid to a pressure within a range from 20,000 psi to 120,000 psi.

29. The method of claim 11 wherein:

the waterjet assembly includes a shutoff valve upstream from the control valve; and the method further comprises using the shutoff valve to discontinue flow of the fluid toward the jet outlet after directing the second jet.

30. The method of claim 27, wherein operating the control valve includes operating the control valve to selectively throttle the fluid and thereby controllably reduce the pressure of the second portion of the fluid to a steady-state pressure within a range from 1,000 psi to 25,000 psi.

* * * * *